US007251437B2

(12) United States Patent
Tamoto et al.

(10) Patent No.: US 7,251,437 B2
(45) Date of Patent: Jul. 31, 2007

(54) IMAGE FORMATION APPARATUS HAVING A BODY TO BE CHARGED WITH SPECIFIED PROPERTIES AND INCLUDING THE USE OF A PROTECTIVE MATERIAL

(75) Inventors: Nozomu Tamoto, Shizuoka (JP); Tetsuro Suzuki, Shizuoka (JP); Yasuo Suzuki, Shizuoka (JP); Takahiko Tokumasu, Tokyo (JP); Kazuhiko Watanabe, Tokyo (JP); Hiroshi Nakai, Kanagawa (JP); Kohichi Ohshima, Shizuoka (JP); Noboru Tsukude, Kanagawa (JP); Nekka Matsuura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 239 days.

(21) Appl. No.: 11/068,180

(22) Filed: Mar. 1, 2005

(65) Prior Publication Data

US 2005/0196193 A1 Sep. 8, 2005

(30) Foreign Application Priority Data

Mar. 2, 2004 (JP) ..... 2004-057070

(51) Int. Cl.

| | |
|---|---|
| ***G03G 15/00*** | (2006.01) |
| ***G03G 15/02*** | (2006.01) |
| ***G03G 15/18*** | (2006.01) |
| ***G03G 21/00*** | (2006.01) |

(52) U.S. Cl. ..... 399/159; 399/111; 399/168; 399/346

(58) Field of Classification Search ..... 399/159, 399/168, 174–176, 346, 111; 430/58.05, 430/58.7, 66

See application file for complete search history.

(56) References Cited

U.S. PATENT DOCUMENTS 5,492,784 A 2/1996 Yoshikawa et al.

(Continued)

FOREIGN PATENT DOCUMENTS

JP 5-60503 9/1993

(Continued)

OTHER PUBLICATIONS

U.S. Appl. No. 10/784,872, filed Feb. 24, 2004, Shimada et al.

(Continued)

*Primary Examiner*—William J. Royer
(74) *Attorney, Agent, or Firm*—Oblon, Spivak, McClelland, Maier & Neustadt, P.C.

(57) ABSTRACT

An image formation apparatus including at least a moving body to be charged, a charging device for charging the body to be charged using discharge caused by applying a voltage to a charging member provided in contact with or proximity to the body to be charged, a latent image formation device for forming a latent image on a surface of the body to be charged which is charged by the charging device, and a development device for depositing toner on an image portion of the latent image formed by the latent image formation device, wherein an elastic displacement ratio $\tau e$ for the surface of the body to be charged is equal to or greater than 40% which is defined by the following formula, elastic displacement ratio $\tau e$ (%)=[(maximum displacement)-(plastic displacement)]/(maximum displacement)×100, and the image formation apparatus further includes a protective material feeding device for depositing a protective material on at least a discharge area of the surface of the body to be charged.

24 Claims, 8 Drawing Sheets

U.S. PATENT DOCUMENTS

| | | | | |
|---|---|---|---|---|
| 5,578,405 | A | 11/1996 | Ikegami et al. | |
| 5,665,500 | A | 9/1997 | Suzuki | |
| 5,815,776 | A * | 9/1998 | Nukada | 399/174 |
| 5,871,876 | A | 2/1999 | Ikuno et al. | |
| 5,928,828 | A | 7/1999 | Suzuki | |
| 6,026,262 | A | 2/2000 | Kinoshita et al. | |
| 6,030,733 | A | 2/2000 | Kami et al. | |
| 6,066,428 | A | 5/2000 | Katayama et al. | |
| 6,136,483 | A | 10/2000 | Suzuki et al. | |
| 6,151,468 | A | 11/2000 | Kami et al. | |
| 6,194,535 | B1 | 2/2001 | Katayama et al. | |
| 6,210,848 | B1 | 4/2001 | Nagai et al. | |
| 6,861,188 | B2 | 3/2005 | Ikegami et al. | |
| 7,103,301 | B2 * | 9/2006 | Watanabe et al. | 399/159 |
| 2003/0077531 | A1 | 4/2003 | Suzuki et al. | |
| 2004/0048177 | A1 | 3/2004 | Tamoto et al. | |
| 2004/0053152 | A1 | 3/2004 | Nagai et al. | |
| 2004/0126687 | A1 | 7/2004 | Ikegami et al. | |
| 2004/0180280 | A1 | 9/2004 | Ikegami et al. | |
| 2004/0248024 | A1 | 12/2004 | Suzuki et al. | |
| 2004/0253527 | A1 | 12/2004 | Suzuki et al. | |
| 2005/0008957 | A1 | 1/2005 | Ikegami et al. | |

FOREIGN PATENT DOCUMENTS

| | | |
|---|---|---|
| JP | 6-45770 | 6/1994 |
| JP | 3164426 | 3/2001 |
| JP | 2002-55580 | 1/2002 |
| JP | 2002-156877 | 5/2002 |
| JP | 2002-207308 | 7/2002 |
| JP | 2002-229227 | 8/2002 |
| JP | 2002-244487 | 8/2002 |
| JP | 2002-244516 | 8/2002 |

OTHER PUBLICATIONS

U.S. Appl. No. 10/944,614, filed Sep. 20, 2004, Niimi et al.
U.S. Appl. No. 09/679,480, filed Oct. 5, 2000, Suzuki et al.
U.S. Appl. No. 10/944,003, filed Sep. 20, 2004, Yanagawa et al.
U.S. Appl. No. 10/784,872, filed Feb. 24, 2004, Shimada et al.
U.S. Appl. No. 10/974,814, filed Oct. 28, 2004, Tamoto et al.
U.S. Appl. No. 11/165,279, filed Jun. 24, 2005, Ohshima et al.
U.S. Appl. No. 11/136,488, filed May 25, 2005, Yanagawa et al.
U.S. Appl. No. 11/110,937, filed Apr. 21, 2005, Ohshima et al.
U.S. Appl. No. 11/157,060, filed Jun. 21, 2005, Ikuno et al.
U.S. Appl. No. 11/157,998, filed Jun. 22, 2005, Tamura et al.
U.S. Appl. No. 11/272,826, filed Nov. 15, 2005, Kawasaki et al.
U.S. Appl. No. 11/261,751, filed Oct. 31, 2005, Ohshima et al.
U.S. Appl. No. 11/317,048, filed Dec. 27, 2005, Nagai et al.
U.S. Appl. No. 11/332,545, filed Jan. 17, 2006, Tamoto et al.
U.S. Appl. No. 11/367,786, Mar. 6, 2006, Ohta et al.
U.S. Appl. No. 11/431,716, filed May 11, 2006, Watanabe et al.
U.S. Appl. No. 11/480,517, filed Jul. 5, 2006, Yanagawa et al.
U.S. Appl. No. 11/500,352, Aug. 8, 2006, Toshine et al.
U.S. Appl. No. 11/563,710, filed Nov. 28, 2006, Inaba et al.
U.S. Appl. No. 11/616,523, filed Dec. 27, 2006, Fujiwara et al.
U.S. Appl. No. 11/621,805, filed Jan. 10, 2007, Suzuki et al.

* cited by examiner

FIG.1
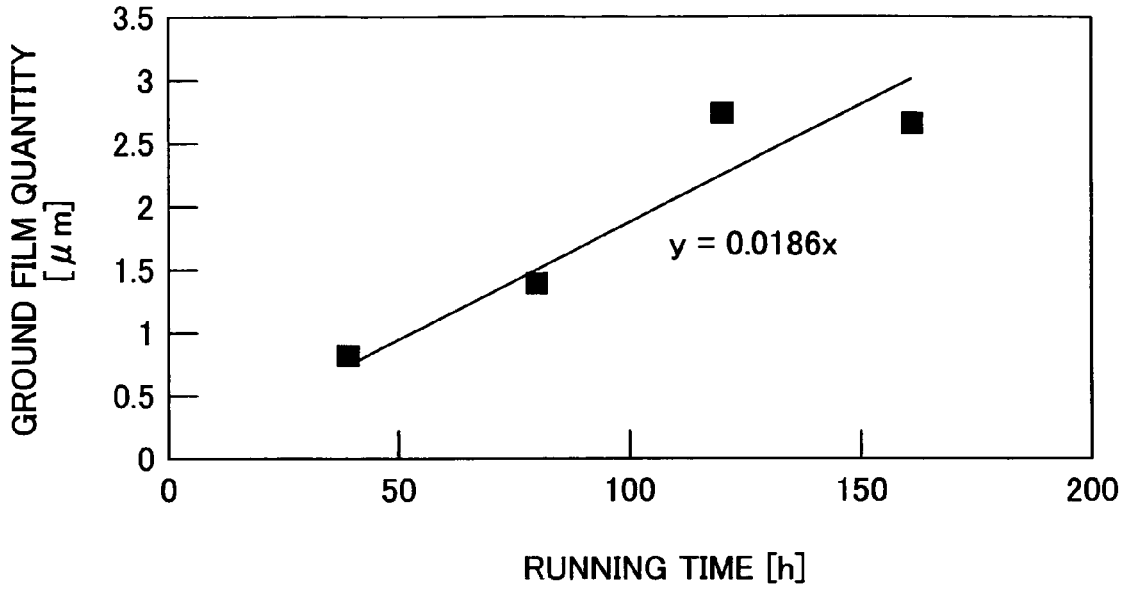
FIG.2A
FIG.2B
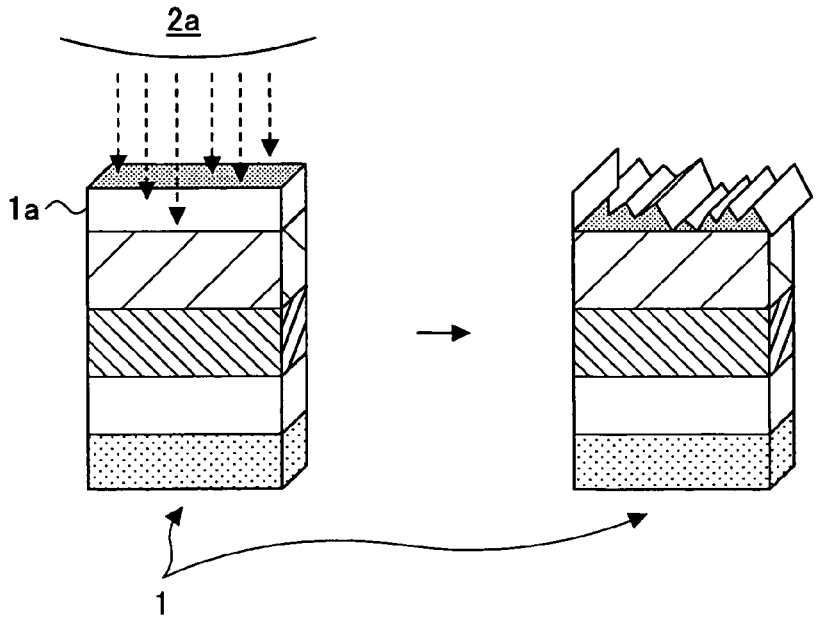

IMAGE FORMATION APPARATUS HAVING A BODY TO BE CHARGED WITH SPECIFIED PROPERTIES AND INCLUDING THE USE OF A PROTECTIVE MATERIAL

BACKGROUND OF THE INVENTION

1. Field of the Invention

The present invention relates to an image formation apparatus using an electrophotographic process and a process cartridge for an image formation apparatus.

2. Description of the Related Art

Conventionally, an image formation apparatus using an electrophotographic process has a charging device for charging the surface of a photoconductor as a body to be charged. One type of charging process used in the charging device is a charging process based on proximity discharge. In this process, the photoconductor surface is charged due to the proximity discharge by contacting a charging member with the photoconductor surface or arranging a charging member close to the photoconductor surface without contact.

Recently, the attainment of high quality image and miniaturization of the apparatus has been increasingly desired and the attainment of high quality image and miniaturization of the charging device has been problematic. Against such a problem, a charging device using a proximity discharge process in which a charging member in contact with or proximity to a photoconductor is employed is useful since no large charging device is needed.

However, it is found that the photoconductor surface is deteriorated in the charging process due to the proximity discharge, since the discharge concentrates in proximity to the photoconductor surface. The deterioration of the photoconductor surface caused by the proximity discharge is different from the case of mechanical friction and occurs also when a member contacting to the photoconductor is not used.

FIG. 1 is the result of a measurement with respect to the change of the film thickness of a photoconductor surface when only a charging member was arranged in proximity to the photoconductor surface but did not contact it and charging tests were performed continuously for approximately 150 hours, in order to investigate the degree of deterioration of the photoconductor surface caused by the proximity discharge.

The photoconductor used herein was an organic photoconductor that contains polycarbonate as a binder resin in the charge transportation layer of the surface thereof. Also, all members contacting the photoconductor were removed and charging was carried out using a non-contact charging roller to which a voltage with an AC bias superposed to a DC bias was applied. As a result we found the fact that ground film quantity of the photoconductor surface gradually increased and the film thickness of the photoconductor gradually decreased. The mechanism of the decrease of the film thickness has not been clear and has been under consideration until now. However, as the photoconductor with the reduced film thickness was analyzed, a carboxylic acid was detected whereby it is considered that the polycarbonate composing the photoconductor was decomposed. Thus, since a material was detected whereby it is considered that a component composing the photoconductor is decomposed by the proximity discharge, the reduction mechanism of the film thickness of the photoconductor is considered to be as follows.

FIG. 2A is a diagram that illustrates an example of the state of a photoconductor surface when the surface of the photoconductor 1 is deteriorated by proximity discharge and FIG. 2B is a diagram that illustrates an example of such a state that a charging roller 2*a* opposes a photoconductor surface via a narrow gap.

As the proximity discharge is caused, the energy of particles (ozone, an electron, excited molecules, ions, plasma, and the like) generated by the discharge is applied to a charge transportation layer 1*a* of the photoconductor surface in a discharge area on the photoconductor surface. The energy resonates a bonding energy of a molecule composing the photoconductor surface and is absorbed. As shown in FIG. 2A, in the charge transportation layer 1*a*, a chemical deterioration is caused such as the decrease of a molecular weight by cutting a chain of a resin molecule, the decrease of the entanglement of the chains of the polymer molecules, and evaporation of the resin. It is considered that the film thickness of the charge transportation layer 1*a* of the photoconductor surface gradually decreases by such a chemical deterioration of the photoconductor caused by the proximity discharge. In such a situation, when mechanical friction is applied to the photoconductor surface using a cleaning blade, the abrasion of the photoconductor is further accelerated.

Thus, it is found that a countermeasure to the reduction of the film thickness by the chemical deterioration of the photoconductor surface caused by the proximity discharge is needed beside a countermeasure to the reduction of the film thickness caused by the mechanical friction, which has been taken conventionally. Herein, it is considered that since the aforementioned reduction of the film thickness of the photoconductor surface caused by the proximity discharge occurs due to the energy of the particles generated by the discharge, the reduction does not only occur in the case of using polycarbonate but also occurs in the case of using a photoconductor made of another material.

Conventionally employed countermeasures to prevent the film thickness of the photoconductor surface from decreasing are as follows. For example, a photoconductor surface is coated with amorphous silicon carbide to improve an abrasive resistance. Also, for example, Japanese Laid-Open Patent Applications No. 2002-207308 and No. 2002-229227 disclose that an inorganic material such as alumina is dispersed in a charge transportation layer (CTL) being a surface layer of an organic photoconductor so as to improve an abrasive resistance of the photoconductor. However, such a structure can improve the resistance to a mechanical abrasion but cannot prevent the chemical deterioration of the photoconductor surface caused by the proximity discharge. In this case, since the photoconductor surface becomes difficult to be refaced by improving the mechanical abrasive resistance, a matter of the photoconductor surface, which is deteriorated by the proximity discharge, becomes easy to remain and it causes the generation of an image deletion or each kind of an image defect.

Recently, proximity discharge prevails in a charging device used in an image formation apparatus and the influence of chemical deterioration caused by the proximity discharge cannot be avoided. Therefore, the aforementioned method for improving the mechanical abrasive resistance of a photoconductor causes the elimination of a deteriorated matter on a photoconductor surface to be difficult and accelerates the generation of an image defect, and, in fact, the attainment of long life of the photoconductor has not been achieved yet. Furthermore, it is found that taking only the improvement of the mechanical abrasive resistance of the photoconductor reduces the resistance of a cleaning blade and inadequate cleaning or the generation of filming tends to be induced. Therefore, in order to realize the long life of a photoconductor and an image formation apparatus using it, while the abrasive resistance of the photoconductor is enhanced, the stability of an image has to be balanced with it. Accordingly, a method for not only improving the mechanical abrasive resistance of a photoconductor but also suppressing the chemical deterioration of the photoconductor caused by proximity discharge has been strongly desired.

Japanese Laid-Open Patent applications No. 2002-055580 and No. 2002-244487 disclose image formation apparatuses with a device for applying zinc stearate on the surface of an image supporter. These methods are similar to a discharge deterioration prevention means described below with respect to the present invention and the objects of applying zinc stearate in these methods are to lower a friction coefficient of a photoconductor surface in order to prevent inadequate cleaning on the photoconductor surface.

Additionally, Japanese Laid-Open Patent Applications No. 2002-244516 and No. 2002-156877 similarly disclose image formation apparatuses with a device for applying zinc stearate on a photoconductor surface. The objects of these techniques are to suppress fusion or filming of a developer caused by activating the photoconductor surface with discharge and, therefore, zinc stearate is applied.

SUMMARY OF THE INVENTION

It is an object of the present invention to provide an image formation apparatus using a charging process of proximity discharge, for suppressing chemical deterioration of the surface of a body to be charged (also referred as a photoconductor, below) which is caused by the proximity discharge, for suppressing a side effect of image quality degradation in repeated use of the photoconductor, being excellent in an abrasive resistance and the stability of image quality, and capable of outputting a high quality image stably over a long period of time.

The object of the present invention described above is achieved by an image formation apparatus comprising at least a moving body to be charged, a charging device for charging the body to be charged using discharge caused by applying a voltage to a charging member provided in contact with or proximity to the body to be charged, a latent image formation device for forming a latent image on a surface of the body to be charged which is charged by the charging device, and a development device for depositing toner on an image portion of the latent image formed by the latent image formation device, wherein an elastic displacement ratio $\tau e$ for the surface of the body to be charged is equal to or greater than 40% which is defined by the following formula $$\text{elastic displacement ratio } \tau e\ (\%)=[(\text{maximum displacement})-(\text{plastic displacement})]/(\text{maximum displacement})\times 100$$

and the image formation apparatus further comprises a protective material feeding device for depositing a protective material on at least a discharge area of the surface of the body to be charged.

In addition, a process cartridge for an image formation apparatus that is used in the image formation apparatus as described above is also provided, wherein a body to be charged and at least one device selected from the group consisting of a charging device for charging the body to be charged using discharge caused by applying a voltage to a charging member provided in contact with or proximity to the body to be charged, a latent image formation device for forming a latent image on a surface of the body to be charged which is charged by the charging device, a development device for depositing toner on an image portion of the latent image formed by the latent image formation device, a toner elimination device for eliminating toner remaining on the surface of the body to be charged, and a protective material feeding device for depositing a protective material on at least a discharge area of the surface of the body to be charged, are integrated.

BRIEF DESCRIPTION OF THE DRAWINGS

Other objects, features and advantages of the present invention will become more apparent from the following detailed description when read in conjunction with the accompanying drawings, in which:

FIG. 1 is a result of a measurement for change of a film thickness of a photoconductor when only a charging member is arranged in proximity to a photoconductor surface and a charging test is continuously performed for approximately 150 hours;

FIGS. 2A and 2B are diagrams that illustrate the states of a photoconductor surface when the photoconductor surface is deteriorated by proximity discharge;

DETAILED DESCRIPTION OF THE PREFERRED EMBODIMENTS

As described above, an attempt to improve a cleaning property or to suppress filming has been performed by applying and depositing zinc stearate on a photoconductor surface and the inventors found that a material such as zinc stearate deposited on a photoconductor surface has a protective effect of suppressing the chemical deterioration of the photoconductor surface which is caused by proximity discharge and the material acts as a protective material for protecting a photoconductor.

However, even if the chemical deterioration caused by the proximity discharge can be suppressed by depositing the protective material on the photoconductor surface, the influence of image degradation increases and the sufficient stability of image quality of a photoconductor and an image formation apparatus using it has not been achieved. For example, as the deposition quantity of the protective material is inadequate or the deposition quantity is not uniform, the resolution of an image may be reduced. Also, as a photoconductor surface is damaged, stripe-like background contamination or image deletion may generate. Further, as a deteriorated protective material remains on a photoconductor surface, filming or fusing of toner may be accelerated. Therefore, the inventors have performed a keen examination and, consequently, found that an image formation apparatus having a photoconductor with a high abrasive resistance and capable of outputting a high quality image over a long period of time even in repeated use can be provided by limiting an elastic displacement ratio of a photoconductor surface.

Figure 3A:
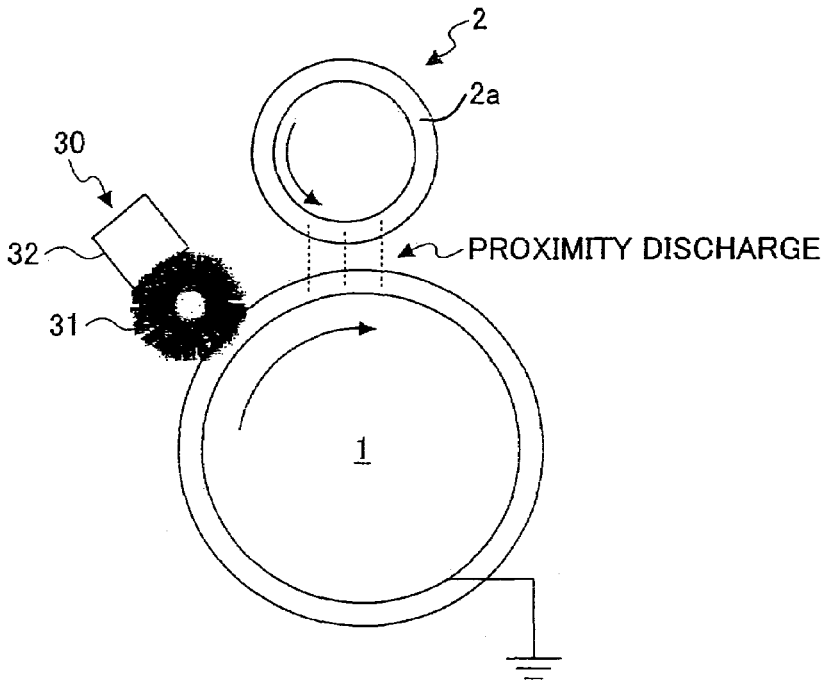
FIG. 3A is a schematic diagram of a laboratory device for confirming the suppression of the deterioration of a photoconductor caused by proximity discharge.
Figure 3B:
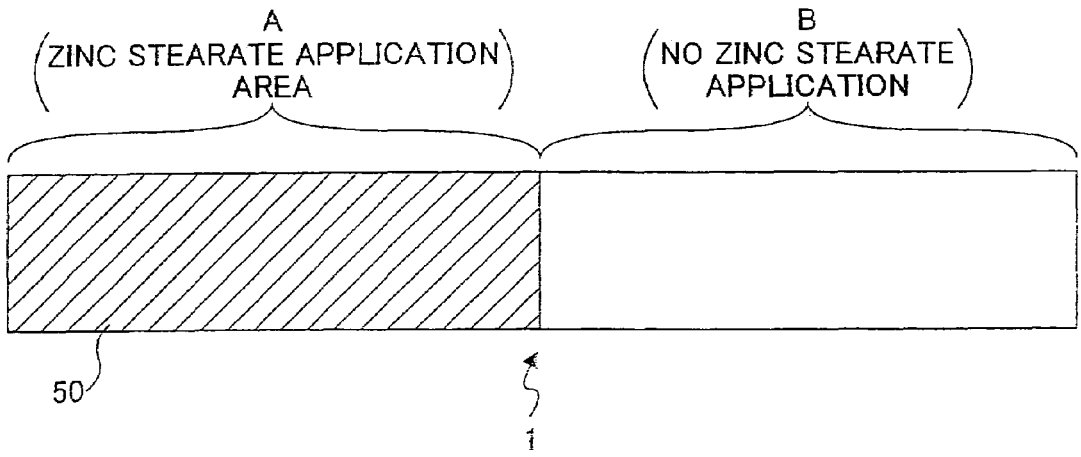
FIG. 3B is a diagram that illustrates a photoconductor surface compartmented into a portion A provided with a protective material and a portion B provided with no protective material.

Herein, the suppression of chemical deterioration of a photoconductor surface by the application of a protective material is described below. FIG. 3A is a schematic diagram of a laboratory device for confirming that chemical deterioration of a photoconductor, caused by proximity discharge, can be suppressed by providing a protective material 32 on the photoconductor. Also, FIG. 3B is a diagram that illustrates a photoconductor surface, which is compartmented into a portion A provided with a protective material and a portion B provided with no protective material.

For performing the experiment, all members except a charging roller 2*a* and a protective material applying device 30 were previously removed and the protective material applying device 30 applied a protective material 32 by a fur brush 31 on a half of a surface area along the axial direction, of a photoconductor 1. Then, after the photoconductor 1, a charging device 2, and the protective material applying device 30 were continuously driven, the deterioration of the photoconductor surface was examined. The conditions of the experiment were as follows.

Charging condition:

Vpp(a peak-to-peak value of an AC voltage)=2.12 [kV]

f (a frequency of AC voltage)=877.2 [Hz]

DC voltage value=−660 [V]

Movement velocity of photoconductor surface v=125 [mm/s]

Protective material: zinc stearate

Linear velocity of fur brush 31=216 [mm/sec]

Figure 4:
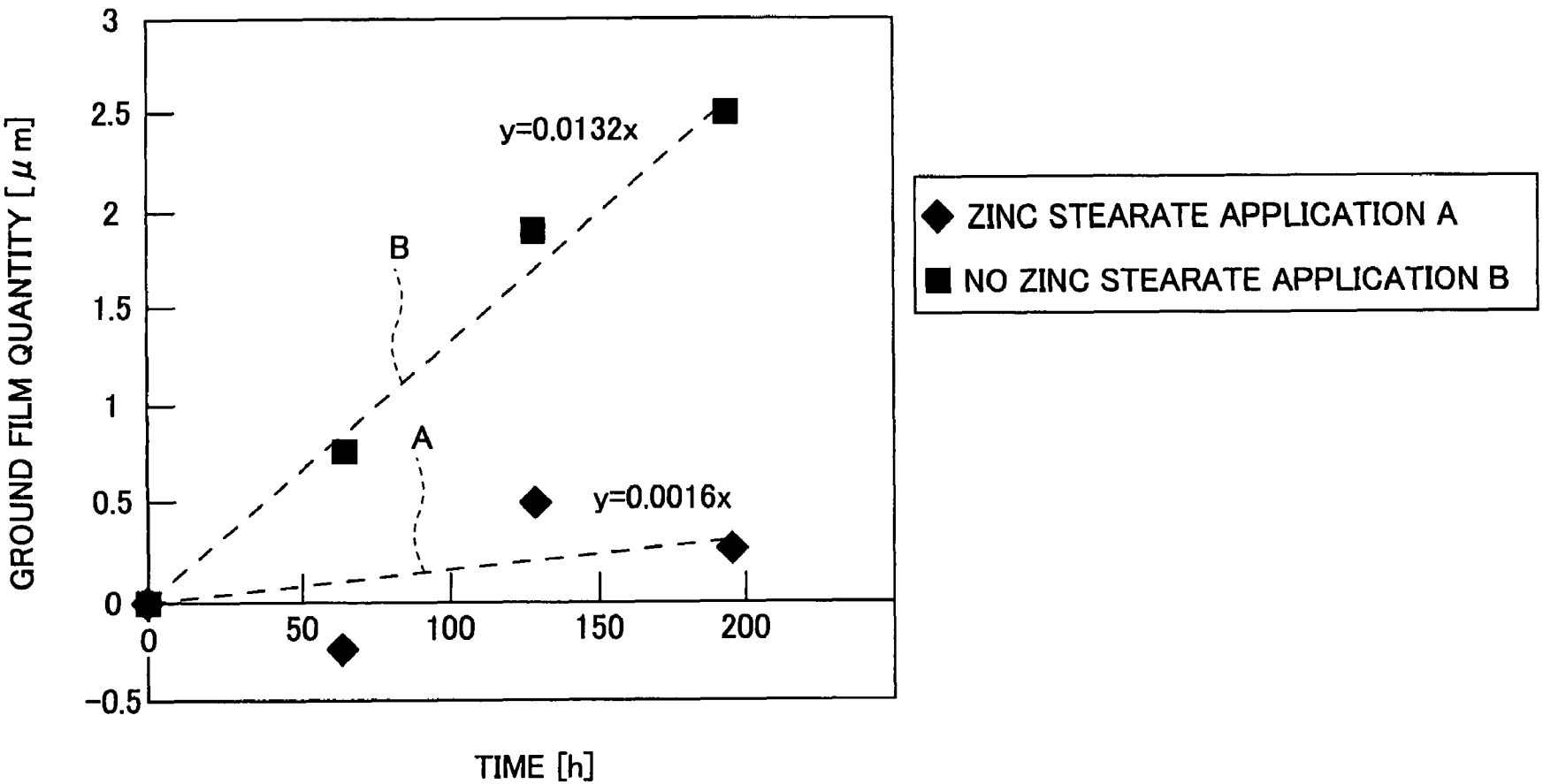
FIG. 4 is a graph showing an evaluation result of ground film quantity with time when charging is continuously applied to a photoconductor.

As illustrated in FIG. 3B, zinc stearate as a protective material was applied on a half area A along the longitudinal direction, of the surface of the photoconductor 1 and no protective material was applied on the residual half area B, on which the surface of the photoconductor 1 was exposed as it is. Also, as an index of the surface deterioration of the photoconductor 1, ground film quantity of a photoconductive layer was measured. Thus, charging was continuously applied to the photoconductor 1 for approximately 200 hours and the ground film quantities were evaluated with time. The obtained results are shown in FIG. 4.

On the area B with no protective material 32, the ground film quantity increased with time passage and the film thickness decreased by approximately 2.5 after 200 hours passed. On the other hand, on the area A with the protective material 32, the decrease of the film thickness was suppressed to one-eighth or less. Further, the surface of the photoconductor 1 used in the experiment was visually observed after 200 hours passed. Then, a mirroring surface as similar to that of a new product of the photoconductor 1 was maintained on the area A with the protective material 32, whereas a photoconductor surface was stained in white and altered on the area B with no protective material 32.

From the experimental results, it is demonstrated that the deterioration of a photoconductor surface caused by discharge is suppressed by providing a protective material 32 on the photoconductor surface.

Although it is demonstrated that chemical deterioration of a photoconductor surface caused by proximity discharge can be suppressed by applying and depositing a protective material on a photoconductor surface, there are a development device, a transfer device, and a cleaning device, in general use, and, thereby, a photoconductor contacts toner, a paper, and a cleaning blade. Therefore, the photoconductor surface is continuously rubbed with them, as the photoconductor is repeatedly used. Consequently, the surface is damaged or mechanically abraded.

As the damage formed on the photoconductor surface grows in the repeated use, the protective material gets into the inside of the damage and the protective material easily remains on the photoconductor surface. As the protective material excessively exists on the photoconductive surface, it absorbs moisture in the atmosphere and easily incorporates a contaminant, so that the generation of an image defect such as image deletion and background contamination is caused in a portion of an image. As the result, even if the chemical deterioration of the photoconductor can be suppressed, the stability of image quality lowers and long life cannot be attained. Therefore, in order to suppress chemical deterioration caused by proximity discharge and avoid the side effect of an image defect so that the stability of image quality is improved, means for depositing a necessary quantity of a protective material on a photoconductor surface uniformly and preventing the local and excess storage of it are needed.

Also, the suppression of the chemical deterioration on the photoconductor surface by the application of the protective material is due to the absorption of discharge energy by the protective material and the applied protective material is deteriorated by the discharge instead. As the protective material is deteriorated by the discharge, not only the effect of suppressing the chemical deterioration of the photoconductor surface lowers, but also the material itself enhances the stickiness thereof, which draws a contaminant onto the photoconductor surface so as to cause filming or fusing of toner. Particularly, as a deteriorated protective material exists in a damage formed on the photoconducter surface, the elimination of it is impossible unless the photoconducter is abraded, and an image defect is caused due to the filming or fusing of toner. In particular, when the mechanical abrasive resistance of the photoconducter is improved, much time or many printing number is necessary for eliminating the protective material through the abrasion, and the image defect remains or is not eliminated over a long period of time.

Therefore, it is necessary to eliminate the deteriorated protective material produced by the discharge and adhering to the photoconductor surface immediately, and to feed a new protective material onto the photoconductor surface constantly without leaving the deteriorated protective material on the photoconductor surface for a long time, in order to maintain a high quality image.

Furthermore, even if the chemical deterioration caused by the proximity discharge can be suppressed by the deposition of the protective material, the abrasion caused by the mechanical friction as another factor cannot be suppressed. When a material with a lubricity such as zinc stearate is employed as a protective material, the friction is reduced and the influence of the mechanical friction tends to be reduced but the influence cannot be completely suppressed. Therefore, in order to enhance the abrasive resistance of a photoconductor and attain long life of an image formation apparatus, the mechanical resistance of the photoconductor is improved, while the chemical deterioration of the photoconductor caused by proximity discharge is suppressed.

According to the present invention, an elastic displacement ratio $\tau e$ of a photoconductor surface is equal to or greater than 40%, whereby stress caused by the mechanical friction due to an object contacting the photoconductor can be reduced and thereby the damage resistance of the photoconductor surface can be significantly enhanced.

It is demonstrated that a protective material is deposited on a surface of an electrophotographic photoconductor, which surface has an elastic displacement ratio equal to or greater than 40%, thereby suppressing abrasion of the photoconductor without the side effect to image quality, even in repeated use over a long period of time, according to the present invention. Also, when a dynamic hardness, a surface roughness Rz, a friction coefficient, and a contact angle satisfy the conditions of the present invention, the uniform application of a protective material as well as the improvement of the damage resistance of a photoconductor can be attained. In addition, since it becomes easy to eliminate the applied protective material before the deterioration of it, the side effect to an image caused by depositing the protective material is suppressed and further improvement of the stability of the image is realized. Consequently, both the mechanical deterioration and the chemical deterioration caused by proximity discharge, of the photoconductor can be suppressed according to the present invention. Therefore, the abrasion of the photoconductor can be almost avoided when applying a DC voltage with superposed an AC voltage for the charging, and further, the simultaneous suppression of the side effect of an image defect such as image deletion and background contamination is realized. Thus, since both the abrasive resistance of a photoconductor and the stability of image quality can be attained, the attainment of long life of a photoconductor and an image formation apparatus using it is realized, and it is also realized to provide an image formation apparatus and a process cartridge for an image formation apparatus which have a high resistance, high performance, and high reliability.

Specific Embodiment 1

Figure 5:
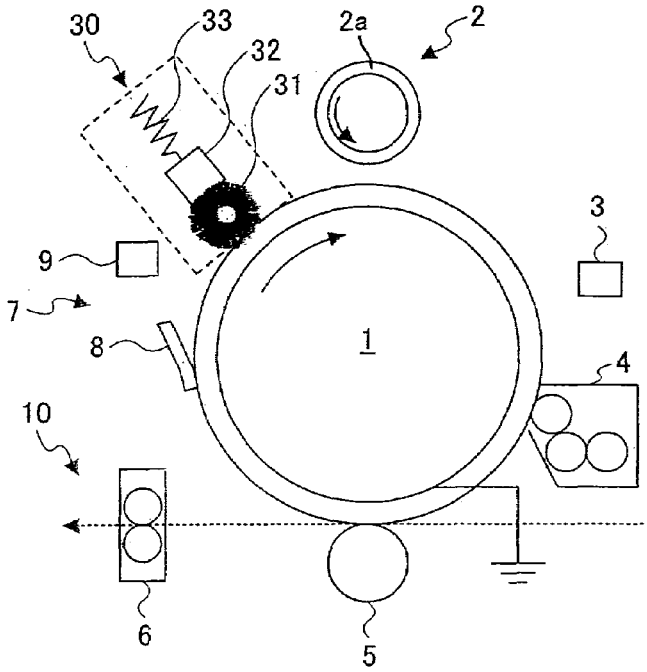
FIG. 5 is a schematic diagram showing one example of the embodiment of an image formation apparatus according to the present invention.

A specific embodiment 1 of an image formation apparatus to which the present invention is applied is described below. However, this is one example of the present invention and the present invention is not limited to this embodiment. FIG. 5 illustrates one example of an image formation apparatus having a structure common to each example described below. The image formation apparatus has a photoconductor 1 as an image supporter that is made of an organic photoconductor. The photoconductor 1 is characterized by, at least, having an elastic displacement ratio $\tau e$ equal to or greater than 40%.

(Overall Structure)

In FIG. 5, the photoconductor 1 is rotationally driven using a driving device not shown in the figure and the surface of it is charged to a predetermined polarity by a charging roller 2*a* of a charging device 2 that uses a proximity charging process. The charged surface of the photoconductor 1 is exposed to light by using a latent image formation device 3 and a latent image is formed according to image information. The latent image is developed with toner by a developer fed from a development device 4 onto the surface of the photoconductor 1 and visualized as a toner image.

Meanwhile, a transfer paper as a recording medium is fed from a paper feed part not shown in the figure to the photoconductor 1. The toner image on the photoconductor 1 is transferred onto the transfer paper by using a transfer device 5 that is arranged to be opposite to the photoconductor 1. After the transfer paper on which the toner image is transferred is separated from the photoconductor 1, the transfer paper is conveyed to a fixation device 6 along a transfer material conveying route 10, by which the toner image is fixed. After the toner image is transferred onto the transfer paper, transfer residual toner as residual toner remaining on the photoconductor 1 is eliminated from the photoconductor 1 by using a cleaning device 7. Also, after the transfer residual toner is eliminated, a residual charge on the photoconductor surface is eliminated using a charge elimination device 9. Thus, the photoconductor 1 is repeatedly used. Herein, the image formation apparatus of this embodiment has an application device 30, which is described below.

Also, in the image formation apparatus of this embodiment, the photoconductor 1, the charging roller 2*a*, the development device 4, and the cleaning device 7 are constructed as one unit, that is, a process cartridge for an image formation apparatus attachable to and detachable from a main body of the image formation apparatus. Since such a process cartridge is exchanged as it is one unit, the quantity of a protective material contained in the application device 30 and an initial film thickness of the photoconductor 1 are easily set to proper values. Consequently, it is suitable for the present invention.

(Charging)

Next, the charging device 2 used in the image formation apparatus of embodiment 1 is described. The charging device 2 charges a photoconductor by means of proximity discharge. As a process for charging a photoconductor 1 using the proximity discharge, a contact charging process for which a rotatable roller-shaped charging member (referred as a charging roller, below) 2*a* is arranged to contact a photoconductor 1 and a non-contact charging process for which a charging roller 2*a* is arranged not to contact a photoconductor 1 are provided. In embodiment 1, a non-contact charging process is employed.

The present invention is also applied to the contact charging process. For the contact charging process, it is preferable to employ an elastic member that improves the contact with a photoconductor surface and gives no mechanical stress to the photoconductor. However, when an elastic member is employed, a charging nip width widens, whereby a protective material may be easily deposited at the side of the charging roller. Therefore, for the attainment of high resistance, it is advantageous to employ a non-contact charging process. In embodiment 1, a non-contact charging process for which the charging roller 2*a* is arranged to be opposite to at least an image formation areas of the photoconductor surface via a predetermined charging gap.

Figure 6:
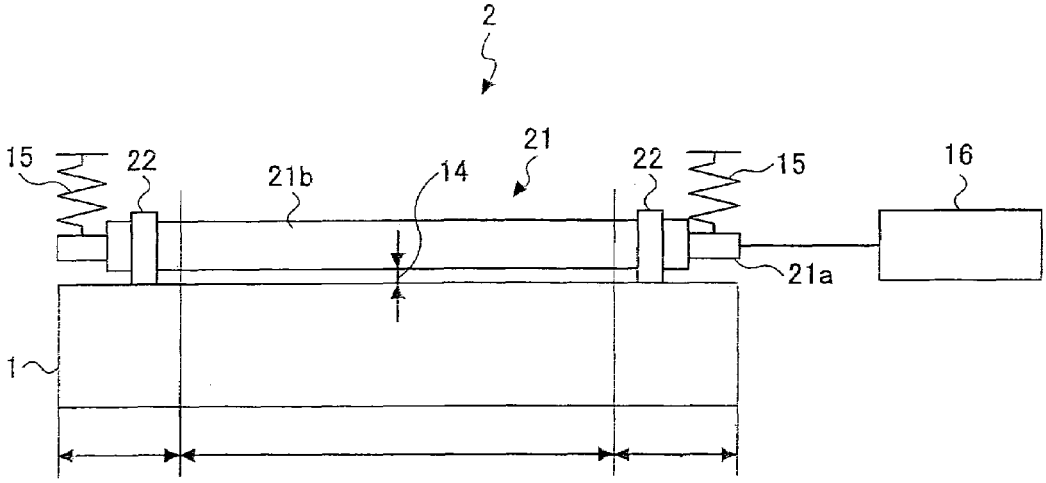
FIG. 6 is a diagram illustrating one example of a charging device used in the image formation apparatus illustrated in FIG. 5.

FIG. 6 is a diagram illustrating the charging device 2 used in the image formation apparatus of embodiment 1.

The charging roller 2*a* is composed of an axial part 21*a* and a roller part 21*b*. The roller part 21*b* is rotatable due to the rotation of the axial part 21*a* and a portion opposite to an image formation area 11 of the surface of the photoconductor 1, on which area an image is formed, does not contact the photoconductor 1. A dimension of the charging roller 2*a* along the longitudinal direction (axial direction) is set to be slightly longer than the image formation area and spacers 22 are provided on both edges along the longitudinal direction. The two spacers 22 contact a no image formation area 12 at both edges of the photoconductor surface whereby a micro gap 14 is provided between the photoconductor 1 and the charging roller 2*a*. The micro gap 14 is provided so that the distance at the proximal position between the charging roller 2*a* and the photoconductor 1 is maintained to 1 through 100 μm. The micro gap 14 is preferably 10-80 μm, more preferable 30-65 μm, and set to 50 μm for the apparatus of embodiment 1. Also, the axial part 21*a* is pressurized toward the side of the photoconductor 1 by pressurizing springs 15 composed of a spring. Thereby, the micro gap 14 is maintained with a high precision. Also, the charging roller 2*a* rotates with the photoconductor 1 surface cooperatively due to the spacers 22.

The charging roller 2*a* is connected to a power supply 16 for charging. Thereby, the photoconductor surface is uniformly charged using proximity discharge at the micro gap 14 between the photoconductor surface and a charging roller surface. As an applied voltage, an alternating voltage is employed in embodiment 1, in which an AC voltage as an AC component is superposed on a DC voltage as a direct-current component. When an alternating voltage in which an AC voltage is superposed on a DC voltage is applied as a voltage applied on the charging roller 2*a*, the influence of dispersion of electric potential for charging caused by the variation of the micro gap 14 is suppressed so as to achieve an uniform charging.

The charging roller 2*a* has a mandrel as an electrically conductive support having a cylindrical shape and an electrical resistance adjustment layer formed on a peripheral surface of the mandrel. It is desirable that the surface of the charging roller 2*a* is hard. A rubber member can be used as the roller member. However, if it is an easily deformable member as the rubber member, it is difficult to maintain the micro gap 14 with the photoconductor 1 constantly and only a central part of the charging roller 2*a* can suddenly contact the photoconductor surface dependent on the condition of image formation. Since it is difficult to address the turbulence of the protective material caused by the local and sudden contact of the charging roller 2*a* with the photoconductive surface, a hard member with slight distortion is desirable in the case of using a non-contact charging process.

As the specific example of the charging roller 2*a* with a hard surface, for example, a roller is provided which is obtained by forming the electrical resistance adjustment layer of a thermoplastic resin composition (polyethylene, polypropylene, poly(methyl methacrylate), polystyrene, and copolymers thereof) in which a polymer-type ion conductive agent is dispersed, and cured-coat-treating the surface of the electrical resistance adjustment layer with a curing agent. Also, for example, the cured-coat treatment is performed dipping the electrical resistance adjustment layer in a treatment liquid that contains an isocyanate-containing compound. Otherwise, it may be performed forming a cured coat layer on the surface of the electrical resistance adjustment layer. In this embodiment, the charging roller 2*a* with ϕ10 mm (a diameter of 10 mm) was formed.

(Photoconductor)

Next, the photoconductor 1 used in the present invention is described.

The photoconductor 1 of this embodiment is obtained by forming, at least, a photoconductive layer on an electrically conductive support and an elastic displacement ratio τe of the photoconductive surface is equal to or greater than 40%.

It is possible to suppress chemical deterioration of the photoconductor surface caused by proximity discharge by applying and depositing a protective material on the photoconductor surface. However, when the protective material is excessively applied or the application quantity is not constant, the protective material absorbs moisture in the atmosphere and easily incorporates a contaminant, thereby causing a side effect of generating an image defect such as image deletion and background contamination on a portion or the whole of an image. Also, the protective material deteriorated by the discharge easily incorporates a contaminant whereby the influence of an image defect may increase to cause filming. Therefore, it is necessary to apply the protective material to be applied on a photoconductor surface, uniformly on the photoconductor surface and to eliminate it uniformly before the deterioration of the protective material proceeds so that no excessive protective material remains on the photoconductor surface, in order to reduce the side effect to image quality and enhance the stability of image quality.

Meanwhile, the photoconductor repeatedly contacts toner, an external additive thereof, a powdery paper, a cleaning blade, and a transfer member, in repeat use. As the photoconductor surface is damaged thereby, the protective material is stored in the recesses, whereby an image defect such as image deletion and background contamination is generated. As the protective material gets into the recesses of damage formed on the photoconductor, the elimination of it is impossible unless the photoconductor is abraded, and the influence of an image defect further increases due to further growth of the damage and the deterioration of the protective material caused by discharge. Therefore, it is necessary to enhance the damage resistance of the photoconductor and to prevent excessive protective material from storing on the photoconductor surface so as to suppress the side effect of the protective material, in order to suppress the chemical deterioration caused by the proximity discharge and the adhesion of the protective material for the attainment of long life.

According to the present invention, an elastic displacement ratio τe of a photoconductor surface is equal to or greater than 40%, whereby stress caused by the mechanical friction due to an object contacting the photoconductor can be reduced and thereby the damage resistance of the photoconductor surface can be significantly enhanced. Therefore, a protective material does not locally remain on the photoconductor surface and the side effect of an image defect due to the excess storage of the protective material or the retention of the deteriorated protective material caused by discharge can be suppressed. Thereby, it is also possible to improve the abrasive resistance of the photoconductor significantly against mechanical friction with an object contacting the photoconductor. Then, it is possible to improve the abrasive resistance of the photoconductor drastically, with the effect of suppressing the chemical deterioration caused by the proximity discharge and the adhesion of the protective material, thereby attaining the reduction of the abrasion of the photoconductor.

Figure 7:
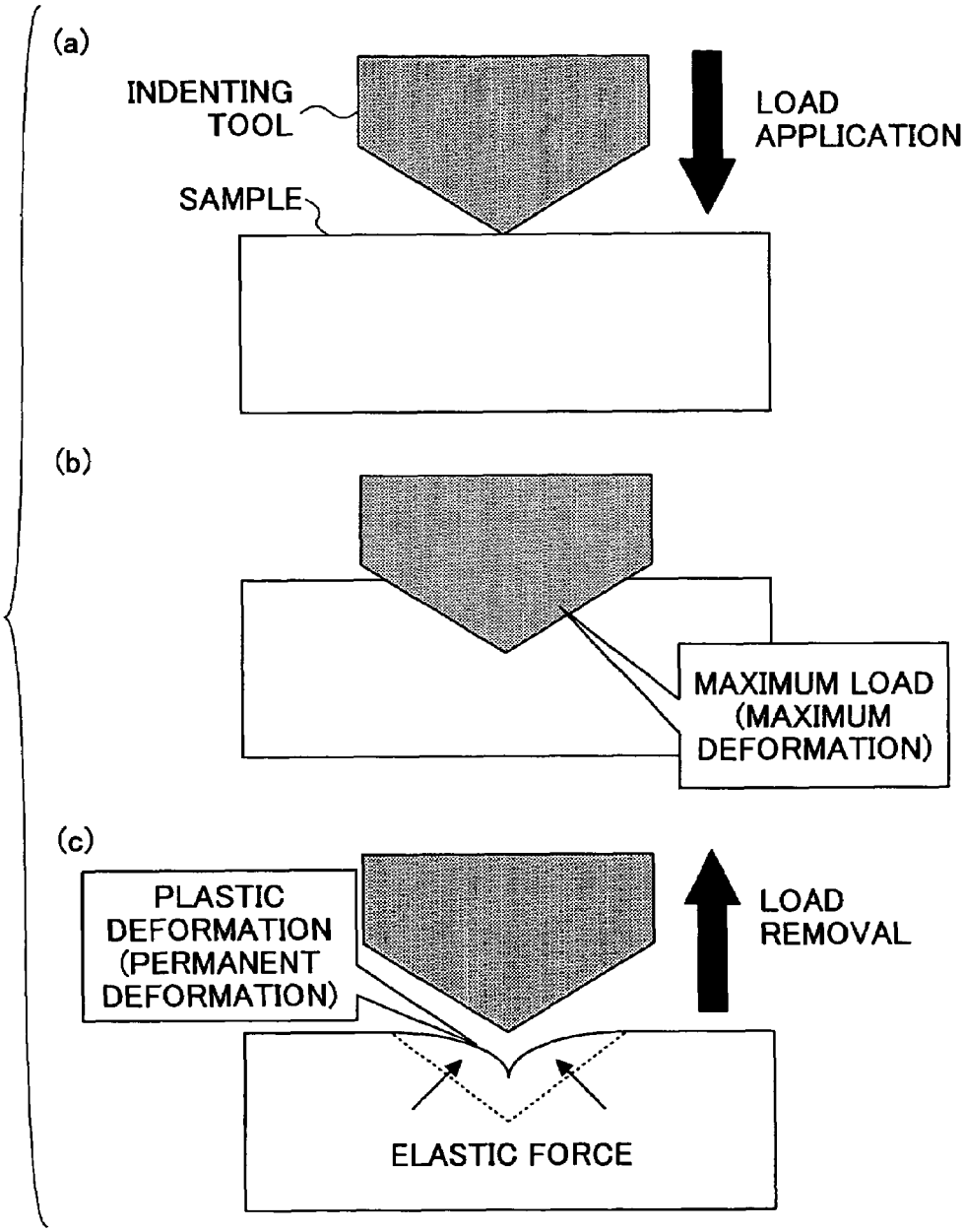
FIG. 7 is a diagram showing a method for measuring an elastic displacement ratio.
Figure 8:
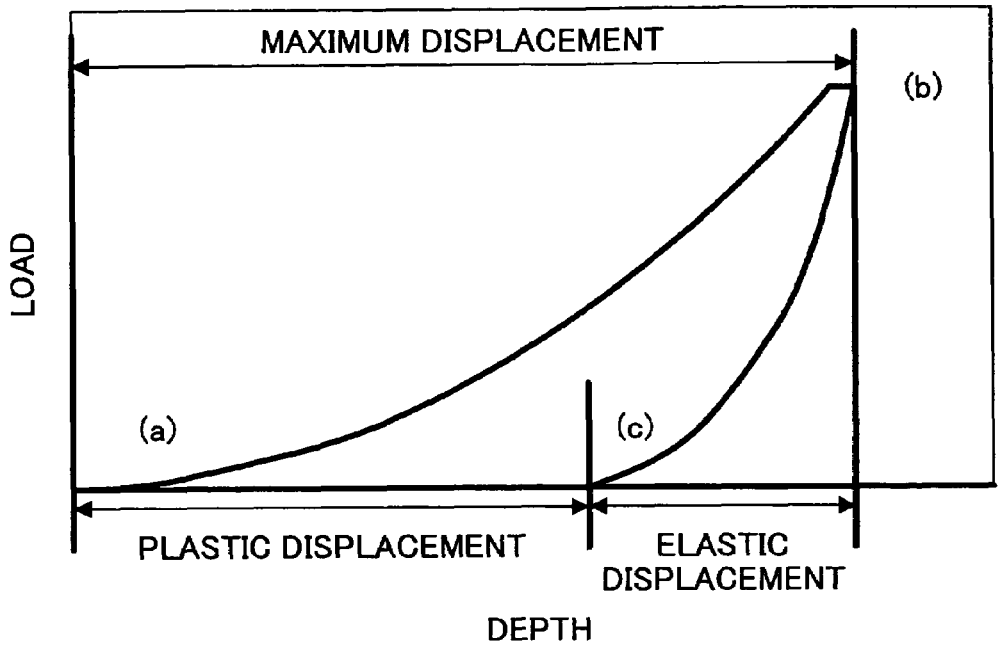
FIG. 8 is a graph showing a relationship of an indentation depth and a load, which is obtained by the method for measuring an elastic displacement ratio.

In the present invention, an elastic displacement ratio τe is measured by a load application—load removal test using a diamond indenting tool. As illustrated in FIG. 7, the indenting tool is driven from a point (a) at which the indenting tool contacts into a sample with a constant load application speed (a load application process). Then, it stops for a certain time period at a maximum displacement (b) at which the load reaches to a set load. Further, the indenting tool is pulled up with a constant load removal speed (a load removal process) and finally, a point at which no load is applied to the indenting tool is a plastic displacement (c). Then, an obtained curve indicating the relationship of an indentation depth and a load is recorded as shown in FIG. 8 and the elastic displacement ratio τe is calculated from the maximum displacement (b) and the plastic displacement (c) according to the following formula:

elastic displacement ratio $\tau e(\%)=[(\text{maximum displacement})-(\text{plastic displacement})]/(\text{maximum displacement})\times 100$.

Such a measurement for an elastic displacement ratio is performed at certain humidity and an elastic displacement ratio in the present invention means a measurement value obtained by the aforementioned test that is performed under the environmental conditions of a temperature of 22° C. and a relative humidity of 55%.

In the present invention, a dynamic ultra-micro surface hardness meter DUH-201 (produced by Shimazu Seisakusho) and a Berkovich indenting tool (115°) are used but the measurement can be performed using any of apparatuses having a performance comparable to the above combination. In an actual measurement, a photoconductor manufactured by stacking at least a photoconductive layer and a surface layer on an aluminum cylinder was appropriately cut and the cut photoconductor was employed. Since the elastic displacement ratio τe is influenced with a spring characteristic of a substrate, a stiff metal plate, or a slide glass beside the aluminum cylinder are appropriate as the substrate. Further, since a factor such as the hardness or elasticity of a under layer (for example, a charge transportation layer, or a charge generation layer) for the surface layer has an influence, the regulated load was adjusted so that the maximum displacement is 1/10 of the film thickness of the surface layer so as to reduce these influences. As only a surface layer is singularly manufactured on the substrate, the inclusion of an under layer component to the surface layer or the adhesion property of the surface layer with the under layer are changed and the surface layer of the photoconductor cannot necessarily be reproduced with accuracy, which is not preferable.

Furthermore, for the surface of a photoconductor of embodiment 1, a dynamic hardness of the photoconductor surface is preferably equal to or greater than 22 mN/μm2. Accordingly, not only an abrasive resistance of the photoconductor against mechanical friction can be improved, but also a further effect of improving a damage resistance of the photoconductor surface is exerted. Therefore, a necessary quantity of a protective material can be uniformly applied over a long period of time. Also, a deteriorated protective material is uniformly eliminated and the residue of the deteriorated protective material on the photoconductor surface can be reduced. Consequently, chemical deterioration caused by proximity discharge can be suppressed without the side effect of an image defect such as image deletion and background contamination, and a high quality image and a high stability of an image formation apparatus can be attained.

The dynamic hardness is neither a Vickers hardness nor a Knoop hardness and is measured by the indentation of an indenting tool into a sample. Generally, the dynamic hardness (DH) is defined by the following formula:

$$DH=\alpha\times P/D^2$$

P: test load (mN)

D: indentation quantity of indenting tool into sample (indentation depth) (μm)

α: constant value dependent on shape of indenting tool

α=3.8584 for 115° triangular pyramid indenting tool and Vickers indenting tool 15.018 for 100° triangular pyramid indenting tool.

The dynamic hardness is a hardness obtained from a load and an indentation depth in a process of driving the indenting tool into a sample. Also, the dynamic hardness corresponds to the strength characteristic of a material, including an elastic deformation as well as a plastic deformation and is suitable for the present invention.

In the present invention, a dynamic hardness of a photoconductor is measured under the environmental conditions of a temperature of 22° C. and relative humidity of 55% using a dynamic ultra-micro surface hardness meter DUH-201 (produced by Shimazu Seisakusho). As an indenting tool used for the measurement, a triangular pyramid indenting tool (150°) (a Berkovich indenting tool), a triangular pyramid indenting tool (110°), a Vickers indenting tool, and a Knoop indenting tool are provided, which are chosen and used dependent on the purpose of a measurement. In the actual measurement, a standard triangular pyramid indenting tool (115°) was used.

Preferably, the surface layer of the photoconductor 1 of this embodiment has been cured by means of heating or light energy irradiation and is insoluble to an organic solvent.

Both an appropriate hardness and an appropriate elastic displacement ratio are attained by curing a surface layer of a photoconductor by means of heating or light energy irradiation and by selecting cross-linking conditions of the surface layer. Accordingly, the mechanical deterioration of the photoconductor is low even in repeated use over a long period of time and the damage resistance of the photoconductor surface is significantly improved. Therefore, the chemical deterioration caused by the adhesion of a protective material and proximity discharge can be suppressed without a side effect and a high quality image and high stability can be attained. Particularly, since the photoconductor surface is insoluble to an organic solvent, it can be confirmed that the surface has been sufficiently cured and the fusion of the applied protective material to the photoconductor can be avoided. Therefore, the deteriorated protective material is uniformly eliminated by cleaning, so that the degradation of image quality caused by the retention of the protective material can be suppressed.

Preferably, a surface roughness of the photoconductor 1 of this embodiment is a ten point height of irregularities Rz equal to or less than 1.0 μm.

A surface roughness of a photoconductor influences the uniform application of a protective material and the uniform elimination of a deteriorated protective material. Since the ten point height of irregularities Rz of a photoconductor is equal to or less than 1.0 μm, a protective material can be uniformly applied on the whole of a photoconductor surface and the influence of proximity discharge can be suppressed over the whole of the photoconductor. Also, when cleaning is performed using a cleaning blade 8, the efficiency of eliminating a deteriorated protective material from the photoconductor surface is excellent and the side effect of the degradation of image quality caused by the protective material can be a minimum.

A surface roughness Rz in the present invention is a ten point height of irregularities measured in accordance with JIS B0601-1982 standard. Also, although SURFCOM 1400D (produced by TOKYO SEIMITSU CO., LTD.) is used for the measurement, an apparatus for the measurement is not limited to this apparatus.

Preferably, a friction coefficient of a surface of the photoconductor 1 of this embodiment is equal to or greater than 0.3 in a measurement according to an Euler—belt method.

A friction coefficient of a photoconductor surface influences the application quantity of a protective material applied on the photoconductor surface. When the friction coefficient is less than 0.3, the applied protective material does not adhere to the photoconductor and, therefore, the protection effect of the present invention against proximity discharge cannot be obtained. In particular, a lubricating material such as zinc stearate among the protective materials strongly shows such a tendency. As the friction coefficient of the photoconductor surface is equal to or greater than 0.3, a necessary quantity of a protective material can adhere to the photoconductor surface and the effect of the present invention can be obtained immediately.

Figure 9:
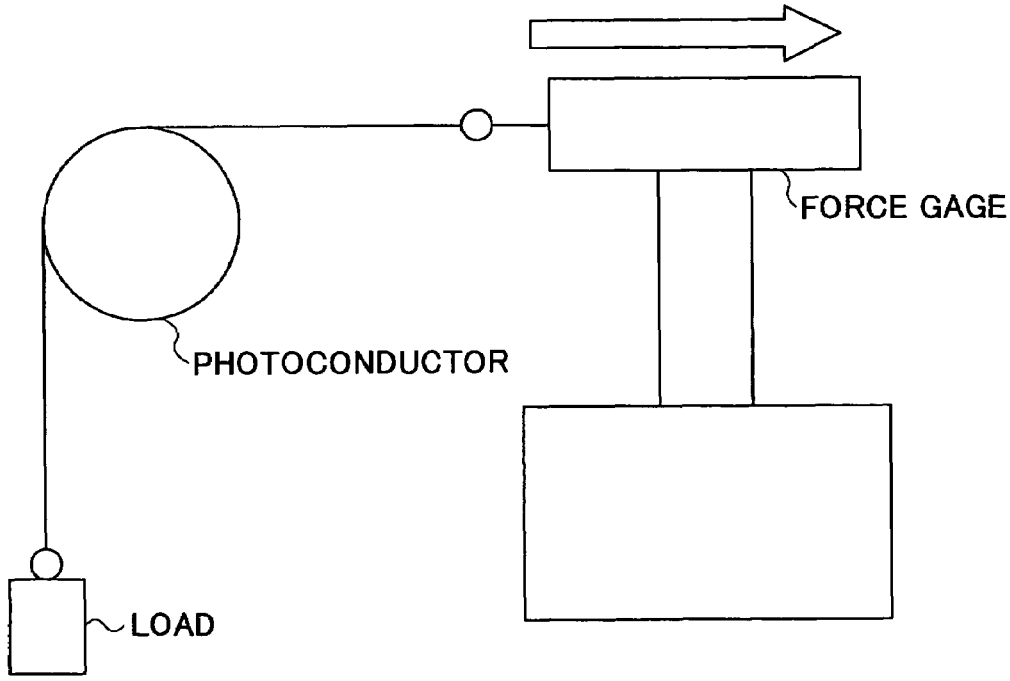
FIG. 9 is a schematic view of an apparatus for measuring a friction coefficient in accordance with an Euler-belt method.

A friction coefficient of the present invention is measured by means of an Euler—belt method. FIG. 9 is a schematic view showing an apparatus for the measurement. A PPC paper (produced by Ricoh Company, Ltd.) cut into a strip with a width of 3 cm contacts a ¼ portion of a peripheral surface of a cylinder-shaped photoconductor so that the direction of conveying the paper is the longitudinal direction thereof. Also, a load (100 g) is applied to one side (a lower side) of the paper and a force gage is connected to the other side. Then, the force gage is moved with a constant speed, and when the paper starts to move, a force (a peak value) is read by using the force gage. Finally, the frictional coefficient is calculated according to the following formula:

$$\mu s = 2/\pi \times \ln(F/W)$$

μs: static friction coefficient

F: read value on force gage

W: load (100 g).

Preferably, a contact angle of water contacting the photoconductor 1 of this embodiment is less than 100°.

A contact angle of a drop of water contacting a photoconductor surface is an index indicating an adhesion property of the surface. When the contact angle is equal to or larger than 100°, the surface has a high water repellency and, therefore, a protective material cannot adhere to the photoconductor surface. In particular, a lubricating material such as zinc stearate among the protective materials strongly shows such a tendency and the protection effect of the present invention against proximity discharge cannot be obtained. As the contact angle is equal to or larger than 100°, a protective material such as zinc stearate can adhere to the photoconductor surface and the effect of the present invention can be obtained sufficiently.

For the measurement of the contact angle, FACE Contact Angle Meter Model CA-W produced by KYOWA Interface Science Co., Ltd. was used but an apparatus for the measurement is not limited to this apparatus. The photoconductor was fixed and ion-exchanged water was dropped at the top of the photoconductor. Then, the contact angle of the water drop was measured. These operations were repeated 5 times and an averaged value of the measured contact angles was calculated. Additionally, the contact angle and the aforementioned friction coefficient do not necessarily exhibit the same tendency. Even if the friction coefficient is equal to or greater than 0.3, the contact angle may exhibit 100° or greater. Although the effect of the present invention is exerted satisfying either the friction coefficient equal to or greater than 0.3 or the contact angle less than 100°, it is more preferable to satisfy the friction coefficient equal to or greater than 0.3 and the contact angle less than 100°.

(Layer Structure of Photoconductor)

As examples of the layer structure of a photoconductor, provided are the following structures, (1) electrically conductive support/photoconductive layer, in which the photoconductive layer has an elastic displacement ratio τe equal to or greater than 40%, (2) electrically conductive support/charge generation layer/charge transportation layer, in which the charge transportation layer has an elastic displacement ratio τe equal to or greater than 40%, (3) electrically conductive support/photoconductive layer/surface layer, in which the surface layer has an elastic displacement ratio τe equal to or greater than 40%, (4) electrically conductive support/charge generation layer/surface layer, in which the surface layer has an elastic displacement ratio τe equal to or greater than 40%, (5) electrically conductive support/charge generation layer/charge transportation layer/surface layer, in which the surface layer has an elastic displacement ratio τe equal to or greater than 40%, and (6) electrically conductive support/charge transportation layer/charge generation layer/surface layer, in which the surface layer has an elastic displacement ratio τe equal to or greater than 40%.

(Surface Layer)

For the present invention, any photoconductor can be used if the elastic displacement ratio τe of a photoconductor surface is equal to or greater than 40%. Although the elastic displacement ratio τe of a photoconductor surface is mainly determined by the characteristic of a film-forming binder resin, any binder resin can be used if the elastic displacement ratio τe of a photoconductor surface is equal to or greater than 40%. As the dynamic hardness of the photoconductor surface is equal to or greater than 22 mN/μm$^2$, which is particularly useful in the present invention, the damage resistance of the photoconductor surface can be further enhanced. As a binder resin that satisfies these conditions, a curing-type resin is excellent and is used usefully in the present invention. As the curing-type resin, thermosetting resins, photo-setting resins, and electron-beam-setting resins are provided. Among these, an ultra-violet-rays-setting resin has a high hardness and excellent damage resistance and is used efficiently in the present invention. For example, urethane resin, acrylic resin, epoxy resin, silicone resin, etc. are preferably used.

However, for satisfying the electrostatic characteristics of a photoconductor, it is necessary to provide a surface layer with a charge transportation function. If the charge transportation function is not provided, the elevation of residual electric potential or the degradation of photosensitivity is caused, thereby lowering the stability of image quality of the photoconductor significantly. Although the provision of the charge transportation function to the surface layer may be able to be attained by dispersing an electrically conductive material such as an electrically conductive filler in the surface layer, the surface roughness may increase or the electrostatic characteristics may be unstable. Consequently, the effect of the present invention could not be obtained sufficiently. Also, the cross-linking may be inhibited and a sufficient hardness may not be obtained. Therefore, the dispersion of the electrically conductive filler is not so preferable in the present invention.

Preferably, a radical-polymerizable monomer having no charge transporting structure and a radical-polymerizable compound having a charge transporting structure are cured, whereby the effect of the present invention can be obtained sufficiently while the electrostatic characteristics are stabilized, in the present invention. On the other hand, when a low-molecular-weight charge transportation material with no functional group is contained in the surface layer, precipitation or the low-molecular-weight charge transportation material or white turbidity is caused due to the low compatibility thereof and the generation of an image defect is caused by lowering of the mechanical strength of the surface layer, the elevation of the residual electric potential, the degradation of the photosensitivity, the increase of the surface roughness, etc. Therefore, it is preferable to employ a radical-polymerizable compound having a charge transportation function and a functional group and to make it to react with the radical-polymerizable monomer, in order to provide the surface layer with the charge transportation function.

A two or more functional radical-polymerizable compound having a charge transportation structure can be used if the smoothness, the electrostatic characteristics, or the durability of the photoconductor surface are not failed. When two or more functional radical-polymerizable compound having a charge transportation structure is contained, the crosslink density increases and the elastic displacement ratio $\tau e$ exhibits a comparatively larger value but bulky hole transporting compounds entwine via a number of bonds whereby the distortion of the surface layer occurs and the curing reaction proceeds ununiformly. Therefore, a restoring force against external stress lowers locally and the dispersion of the elastic displacement ratio $\tau e$ increases. Thereby, irregularities generate locally and the effect of the present invention may be reduced. Therefore, the use of a one-functional radical-polymerizable compound having a charge transportation structure is more preferable than the use of a two or more functional radical-polymerizable compound having a charge transportation structure.

As a radical-polymerizable monomer having no charge transporting structure that is cured with the aforementioned radical-polymerizable compound having a charge transportation structure, a one-functional or two functional radical-polymerizable monomer may be used but the crosslinkages are rare in the surface layer and the drastic enhancement of the damage resistance may not be attained. In the present invention, the use of a three or more-functional radical-polymerizable monomer in the surface layer is more preferable and a three-dimensional network structure grows. Then, the degree of crosslinking and the elastic displacement ratio tend to be enhanced and both a high elastic displacement ratio and a high hardness are attained more easily. Thus, as the curing is performed using a multiple functional radical-polymerizable monomer, not only the mechanical abrasive resistance of the photoconductor but also the damage resistance of it can be significantly enhanced and the use of the multiple functional radical-polymerizable monomer is useful and effective for image quality stabilization in the present invention.

Accordingly, in the present invention, a surface layer obtained by curing at least a three or more-functional radical-polymerizable monomer having no charge transporting structure and a one-functional radical-polymerizable compound having a charge transportation structure is most preferred. Thereby, both stabilization of the electrostatic characteristics and significant improvement of the damage resistance are attained, and both high durability and the stabilization of quality image can be attained without a side effect caused by the adhesion of a protective material.

Next, components of a coating liquid for surface layer in the present invention are described.

A three or more-functional radical-polymerizable monomer having no charge transporting structure used for the present invention is a monomer having neither a hole transporting structure such as triarylamine, hydrazone, pyrazoline, and carbazole nor an electron transporting structure such as a condensed polycyclic quinone, diphenoquinone, and an electron-withdrawing aromatic ring with a cyano group or a nitro group, and having three or more radical-polymerizable functional groups. The radical-polymerizable functional group is not particularly limited if the radical-polymerizable functional group has a carbon-carbon double bond and is a radical-polymerizable group.

As the radical-porymerizable functional group, for example, a 1-substituted ethylene functional group and a 1,1-substituted ethylene functional group described below are provided.

(1) As the 1-substituted ethylene functional group, for example, a functional group represented by the following formula 10:

$$CH_2{=}CH{-}X_1{-} \qquad \text{formula 10}$$

can be provided. In formula 10, $X_1$ is an arylene group such as phenylene group and naphthylene group which may have a substituent, an alkenylene group which may have a substituent, —CO— group, —COO— group, —CON($R_{10}$)— group, or —S— group, wherein $R_{10}$ is hydrogen, an alkyl group such as methyl group and ethyl group, an aralkyl group such as benzyl group, naphthylmethyl group, and phenethyl group, and an aryl group such as phenyl group and naphthyl group.

As these substituents are specifically explained with examples, vinyl group, styryl group, 2-methyl-1,3-butadienyl group, vinylcarbonyl group, acryloyloxy group, acryloylamino group, and vinylthioethr group can be provided.

(2) As the 1,1-substituted ethylene functional group, for example, a functional group represented by the following formula 11:

$$CH_2{=}C(Y){-}X_2{-} \qquad \text{formula 11}$$

can be provided.

In formula 11, Y is an alkyl group which may have a substituent, an aralkyl group which may have a substituent, an aryl group such as phenyl group and naphthyl group which may have a substituent, a halogen atom, cyano group, nitro group, an alkoxy group such as methoxy group and ethoxy group, —$COOR_{11}$, group, or —$CONR_{12}R_{13}$, wherein $R_{11}$ is a hydrogen atom, an alkyl group such as methyl group and ethyl group which may have a substituent, an aralkyl group such as benzyl group and phenethyl group which may have a substituent or an aryl group such as phenyl group and naphthyl group which may have a substituent, each of $R_{12}$ and $R_{13}$ is an hydrogen atom, an alkyl group such as methyl group and ethyl group which may have a substituent, an aralkyl group such as benzyl group, naphthylmethyl group, and phenethyl group which may have a substituent, or an aryl group such as phenyl group and naphthyl group which may have a substituent, and $R_{12}$ and $R_{13}$ may be identical to or different from each other. Also, $X_2$ is the same substitutent as $X_1$ in formula 10, a single bond, or an alkylene group. Herein, at least one of Y and $X_2$ is oxycarbonyl group, cyano group, an alkenylene group or an aromatic ring.

As these substituents are specifically explained with examples, α-acryloyloxy chloride group, methacryloyloxy group, α-cyanoethylene group, α-cyanacryloyloxy group, α-cyanophenylene group, and methacryloylamino group can be provided.

Herein, as a substituent for substituting these substituents $X_1$, $X_2$, and Y, for example, a halogen atom, nitro group, cyano group, an alkyl group such as methyl group and ethyl group, an alkoxy group such as methoxy group and ethoxy group, an aryloxy group such as phenoxy group, an aryl group such as phenyl group and naphthyl group, and an aralkyl group such as benzyl group and phenethyl group can be provided.

Among these radical-polymerizable functional groups, particularly, acryloyloxy group and methacryloyloxy group are useful, and a compound having three or more acryloyloxy groups can be obtained, for example, by esterification reaction or transesterification reaction using a compound having three or more hydroxyl groups in the molecule thereof and an acrylic acid, an acrylate salt, an acryloyl halide, or an acrylate ester. Also, a compound having three or more methacryloyloxy groups can be similarly obtained. Additionally, radical-porymerizable functional groups in a monomer having three or more radical-porymerizable functional group may be identical to or different from each other.

As a three or more-functional radical-porymerizable monomer having no charge transporting structure, the following compounds are provided as examples but the monomer is not limited to these compounds.

That is, as the aforementioned radical-porymerizable monomer used for the present invention, for example, trimethylolpropane triacrylate (TMPTA), trimethylolpropane trimethacrylate, HPA-modified trimethylolpropane triacrylate, EO-modified trimethylolpropane triacrylate, PO-modified trimethylolpropane triacrylate, caprolactone-modified trimethylolpropane triacrylate, HPA-modified trimethylolpropane trimethacrylate, penta-erythritol triacrylate, penta-erythritol tetraacrylate (PETTA), glycerol triacrylate, ECH-modified glycerol triacrylate, EO-modified glycerol triacrylate, PO-modified glycerol triacrylate, tris(acryloxyethyl)isocyanurate, di-penta-erythritol hexaacrylate (DPHA), caprolactone-modified di-penta-erythritol hexaacrylate, di-penta-erythritol hydroxypentaacrylate, alkyl-modified di-penta-erythritol pentaacrylate, alkyl-modified di-penta-erythritol tetraacrylate, alkyl-modified di-penta-erythritol triacrylate, dimethylolpropane tetraacrylate (DTMPTA), penta-erythritol ethoxytetraacrylate, EO-modified phosphoric acid triacrylate, and 2,2,5,5-tetrahydroxymethylcyclopentanone tetraacrylate, etc. can be provided and these compounds can be used singularly or in combination.

Also, it is desired that a functional group ratio (molecular weight/number of functional groups) in the three or more-functional radical-porymerizable monomer having no charge transporting structure used for the present invention is equal to or less than 250, in order to form a dense crosslinkage in the surface layer. Thereby, a tendency is seen such that the elastic displacement ratio and hardness of the surface layer are improved and the damage resistance of the photoconductor surface is raised. Also, the content of the three or more-functional radical-porymerizable monomer component having no charge transporting structure used for the surface layer is 20-80% by weight, preferably 30-70% by weight, of the total weight of the surface layer but substantially depends on the rate of the three or more-functional radical-porymerizable monomer in a solid content of coating liquid. When the content of the monomer component is less than 20% by weight, the density of a three dimensional crosslinkage in the surface layer is low and the drastic improvement of the damage resistance may not be attained compared to the case of using a conventional thermoplastic binder resin. Also, When the content of the monomer component is greater than 80% by weight, the content of the charge transportation compound is low and the degradation of the electrostatic characteristics, particularly, the elevation of the residual electric potential and the degradation of the photosensitivity occur. Although required abrasive resistance and electrostatic characteristics depend on a used process, the content is most preferably in a range of 30-70% by weight, in view of the balance of abrasive resistance and electrostatic characteristics.

The one-functional radical-polymerizable compound having a charge transporting structure used for the present invention is a compound having a hole transporting structure such as triarylamine, hydrazone, pyrazoline, and carbazole or an electron transporting structure such as condensed polycyclic quinone, diphenoquinone, and an electron-withdrawing aromatic ring with a cyano group or a nitro group, and having one radical-polymerizable functional group. As this radical-polymerizable functional group, the radical-polymerizable functional group described above can be provided and, particularly, acryloyloxy group and methacryloyloxy group are useful. Also, as the charge transporting structure, a triarylamine structure is effective and, among these, when a compound having a structure represented by general formula (1):

General formula (1)

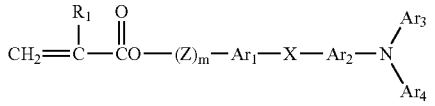

or general formula (2):

General formula (2)

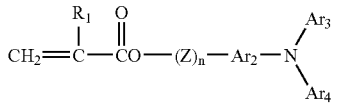

the electrostatic characteristics such as the photosensitivity and the residual electric potential are maintained well.

In general formulas (1) and (2), $R_1$ is a hydrogen atom, a halogen atom, an alkyl group which may have a substituent, an aralkyl group which may have a substituent, an aryl group which may have a substituent, cyano group, nitro group, an alkoxy group, —$COOR_7$, a carbonyl halide group, or —$CONR_8R_9$, wherein $R_7$ is a hydrogen atom, an alkyl group which may have a substituent, an aralkyl group which may have a substituent, or an aryl group which may have a substituent, each of $R_8$ and $R_9$ is a hydrogen atom, a halogen atom, an alkyl group which may have a substituent, an aralkyl group which may have a substituent, or an aryl group which may have a substituent, and $R_8$ and $R_9$ may be identical to or different from each other. Each of $Ar_1$ and $Ar_2$ is a substituted or non-substituted arylene group, and $Ar_1$ and $Ar_2$ may be identical to or different from each other. Each of $Ar_3$ and $Ar_4$ is a substituted or non-substituted aryl group, and $Ar_3$ and $Ar_4$ may be identical to or different from each other. X is a single bond, a substituted or non-substituted alkylene group, a substituted or non-substituted cycloalkylene group, a substituted or non-substituted alkylene ether group, oxygen atom, sulfur atom, or vinylene group. Z is a substituted or non-substituted alkylene group, a substituted or non-substituted alkylene ether group, or alkyleneoxycarbonyl group. Each of m and n is an integer of 0 through 3.

Specific examples of the substituents in general formulas (1) and (2) are shown below.

With respect to a substituent for $R_1$ in general formulas (1) and (2), for example, as the alkyl group, methyl group, ethyl group, propyl group, butyl group, etc. can be provided. As the aryl group, phenyl group and naphthyl group, etc. can be provided. As the aralkyl group, benzyl group, phenethyl group, naphthylmethyl group, etc. can be provided. As the alkoxy group, methoxy group, ethoxy group, propoxy group, etc. can be provided. The substituents for $R_1$ may be further substituted with a halogen atom, nitro group, cyano group, an alkyl group such as methyl group and ethyl group, an alkoxy group such as methoxy group and ethoxy group, an aryloxy group such as phenoxy group, an aryl group such as phenyl group and naphthyl group, or an aralkyl group such as benzyl group and phenethyl group.

Among substituents $R_1$, a hydrogen atom and a methyl group are particularly preferable.

$Ar_3$ and $Ar_4$ are substituted or non-substituted aryl groups and as the aryl group, a condensed polycyclic hydrocarbon group, a not-condensed cyclic hydrocarbon group, and a heterocyclic group can be provided.

As the condensed polycyclic hydrocarbon group, the number of carbons that form a ring thereof is preferably equal to or less than 18, and, for example, pentanyl group, indenyl group, naphthyl group, azulenyl group, heptalenyl group, biphenylenyl group, as-indacenyl group, s-indacenyl group, fluorenyl group, acenaphthylenyl group, pleiadenyl group, acenaphthenyl group, phenalenyl group, phenanthryl group, anthryl group, fluoranthenyl group, acephenanthrylenyl group, aceanthrylenyl group, triphenylenyl group, pyrenyl group, chrysenyl group, and naphthacenyl group can be provided.

As the not-condensed cyclic hydrocarbon group, monovalent groups of a monocyclic hydrocarbon compound such as benzene, diphenyl ether, poly(ethylene-diphenylether), diphenylthioether, and diphenylsulfone, monovalent groups of a not-condensed polycyclic hydrocarbon compound such as biphenyl, polyphenyl, a diphenylalkane, a diphenylalkene, a diphenylalkyne, triphenylmethane, distyrylbenzene, a 1,1-diphenylcycloalkane, a polyphenylalkane, and a polyphenylalkene, and monovalent groups of a ring assembly hydrocarbon compound such as 9,9-diphenylfluorene can be provided.

As the heterocyclic group, monovalent groups of carbazole, dibenzofuran, dibenzothiophene, oxadiazole, and thiadiazole can be provided.

The aryl group represented by $Ar_3$ and $Ar_4$ may have a substituent, for example, as shown below.

(1) A halogen atom, cyano group, nitro group, etc.

(2) An alkyl group

The alkyl group is preferably $C_1$-$C_{12}$, more preferably $C_1$-$C_8$, most preferably $C_1$-$C_4$ straight or branched alkyl group, and the alkyl group may have a fluorine atom, hydroxyl group, cyano group, a $C_1$-$C_4$ alkoxy group, phenyl group, or a phenyl group substituted with a halogen atom, a $C_1$-$C_4$ alkyl group, or a $C_1$-$C_4$ alkoxy group. Specifically, methyl group, ethyl group, n-butyl group, i-propyl group, t-butyl group, s-butyl group, n-propyl group, trifluoromethyl group, 2-hydroxyethyl group, 2-ethoxyethyl group, 2-cyanoethyl group, 2-methoxyethyl group, benzyl group, 4-chlorobenzyl group, 4-methylbenzyl group, and 4-phenylbenzyl group can be provided.

(3) An alkoxy groups (—$OR_2$), wherein $R_2$ is an alkyl group defined in (2) above.

Specifically, methoxy group, ethoxy group, n-propoxy group, i-propoxy group, t-butoxy group, n-butoxy group, s-butoxy group, i-butoxy group, 2-hydroxyethoxy group, benzyloxy group, and trifluoromethoxy group can be provided.

(4) An aryloxy group

As the aryl group, phenyl group and naphthyl group can be provided. The aryloxy group may contain a $C_1$-$C_4$ alkoxy group, a $C_1$-$C_4$ alkyl group, or a halogen atom as a substituent. Specifically, phenoxy group, 1-naphthyloxy group, 2-naphthyloxy group, 4-methoxyphenoxy group, and 4-methylphenoxy group can be provided.

(5) An alkylmercapto group or an arylmercapto group

Specifically, methylthio group, ethylthio group, phenylthio group, and p-methylphenylthio group can be provided.

(6) A substituent represented by the following formula:

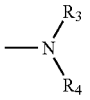

wherein each of $R_3$ and $R_4$ is independently a hydrogen atom, an alkyl group defined in (2) above, or an aryl group. As the aryl group, for example, phenyl group, biphenyl group, and naphthyl group can be provided and the aryl group may contain a $C_1$-$C_4$ alkoxy group, a $C_1$-$C_4$ alkyl group, or a halogen atom as a substituent. $R_3$ and $R_4$ may collectively form a ring.

Specifically, amino group, diethylamino group, N-methyl-N-phenylamino group, N,N-diphenylamino group, N,N-di(tolyl)amino group, dibenzylamino group, piperidino group, morpholino group, and pyrrolidino group can be provided.

(7) An alkylenedioxy group and an alkylenedithio group such as methylenedioxy group and methylenedithio group can be provided.

(8) A substituted or non-substituted styrylgroup, a substituted or non-substituted β-phenylstyryl group, diphenylaminophenyl group, ditolylaminophenyl group.

The arylene group represented by $Ar_1$ and $Ar_2$ are divalent groups derived from the aryl groups represented by $Ar_3$ and $Ar_4$.

X is a single bond, a substituted or non-substituted alkylene group, a substituted or non-substituted cycloalkylene group, a substituted or non-substituted alkylene ether group, an oxygen atom, a sulfur atom, or vinylene group.

The substituted or non-substituted alkylene group is $C_1$-$C_{12}$, preferably $C_1$-$C_8$, more preferably $C_1$-$C_4$ straight or branched alkylene group and, further, the alkylene group may have a fluorine atom, hydroxyl group, cyano group, a $C_1$-$C_4$ alkoxy group, a phenyl group, or a phenyl group substituted with a halogen atom, a $C_1$-$C_4$ alkyl group, or a $C_1$-$C_4$ alkoxy group.

Specifically, methylene group, ethylene group, n-butylene group, i-propylene group, t-butylene group, s-butylene group, n-propylene group, trifluoromethylene group, 2-hydroxyethylene group, 2-ethoxyethylene group, 2-cyanoethylene group, 2-methoxyethylene group, benzylidene group, phenylethylene group, 4-chlorophenylethylene group, 4-methylphenylethylene group, and 4-biphenylethylene group can be provided.

The substituted or non-substituted cycloalkylene group is a $C_5$-$C_7$ cyclic alkylene group and the cyclic alkylene group may have a fluorine atom, hydroxyl group, a $C_1$-$C_4$ alkyl group, or a $C_1$-$C_4$ alkoxy group. Specifically, cyclohexylidene group, cyclohexylene group, and 3,3-dimethylcyclohexylidene group can be provided.

The substituted or non-substituted alkylene ether group is ethyleneoxy group, propyleneoxy group, ethylene glycol, propyleneglycol, diethylene glycol, tetraethylene glycol, or tripropylene glycol and an alkylene group of the alkylene ether group may have a substituent such as hydroxyl group, methyl group, or ethyl group.

As the vinylene group, a substituent represented by the following general formula

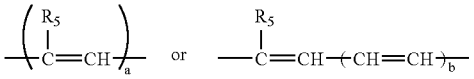

can be provided, wherein $R_5$ is hydrogen, an alkyl group (being the same alkyl group as that defined in (2) above), an aryl group (being the same aryl group as that represented by $Ar_3$ or $Ar_4$ above), a is 1 or 2, and b is 1 through 3.

Z is a substituted or non-substituted alkylene group, a substituted or non-substituted alkylene ether group, or alkyleneoxycarbonyl group.

As the substituted or non-substituted alkylene group, the alkylene group as X above can be provided.

As the substituted or non-substituted alkylene ether group, the alkylene ether group as X above can be provided.

As the alkyleneoxycarbonyl group, a caprolactone-modified group can be provided.

Also, as the one-functional free-radical-polymerizable compound having a charge transporting structure in the present invention, more preferably, a compound represented by general formula (3):

can be provide, wherein each of o, p, and q is an integer of 0 or 1, Ra is a hydrogen atom or a methyl group, each of Rb and Rc is a alkyl group in which the number of carbons is 1 through 6, where if the number of Rb or Rc is a plural number, the plural Rbs or Rcs may be different from each other, each of s and t is an integer of 0 through 3, and Za is a single bond, a methylene group, an ethylene group,

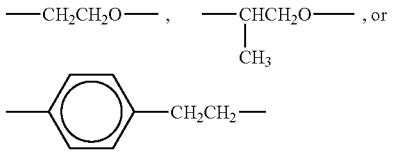

In the compound represented by general formula (3), a compound in which substituents Rb and Rc are independently methyl group or ethyl group is particularly preferable.

The one-functional radical-polymerizable compound having a charge transporting structure represented by general formula (1), (2), or (3) (especially (3)) used for the present invention does not become a terminal structure and is incorporated in a chaining polymer since the carbon-carbon double bond opens toward both sides thereof for polymerization. In the cross-linked polymer by the polymerization with the three or more-functional radical-polymerizable monomer, the one-functional radical-polymerizable compound having a charge transporting structure is incorporated in a main chain of the polymer or a cross-linking chain between main chains. Herein, the cross-linking chain includes an intermolecular cross-linking chain between a main chain of one polymer molecule and a main chain of another polymer molecule and an intramolecular cross-linking chain between the first portion of a main chain of a folded polymer molecule and the second portion of it, which is away from the first portion. Whether the one-functional radical-polymerizable compound is incorporated in the main chain or the cross-linking chain, a triarylamine structure bonding to the chain has at least three aryl groups extending toward three radial directions from a nitrogen atom and is bulky but bonds to the chain indirectly via a carbonyl group, etc. Accordingly, the triarylamine structures are secured flexibly in regard to the configuration and can be located spatially adjacent to each other in moderation in the polymer, so that structural distortion of the molecule is low. Then, the polymer is used as a material for a surface layer of an electrophotographic photoconductor, it is considered that the molecular structure of the polymer can be comparatively free from breaking of a route for charge transportation.

General formula (3)

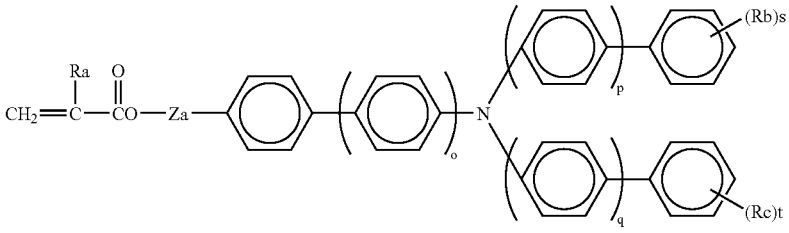

Specific examples of the one-functional radical-polymerizable compound having a charge transporting structure for the present invention are shown below but the compound is not limited to these examples.
No. 1
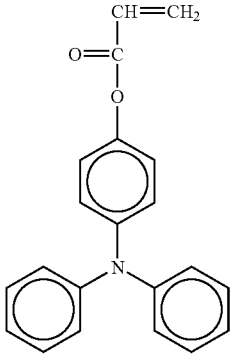
No. 2
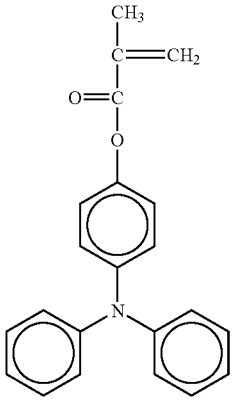
No. 3
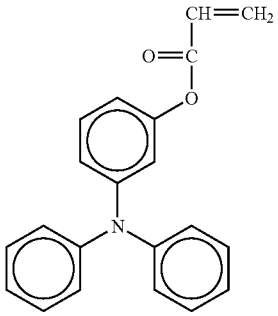
No. 4
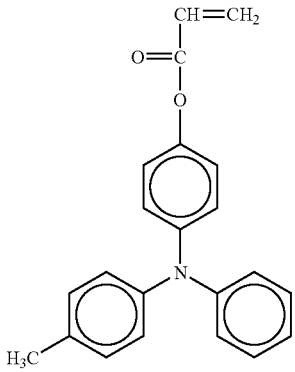
-continued
No. 5
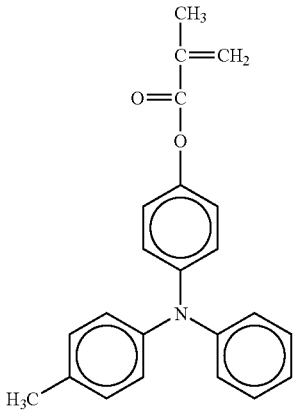
No. 6
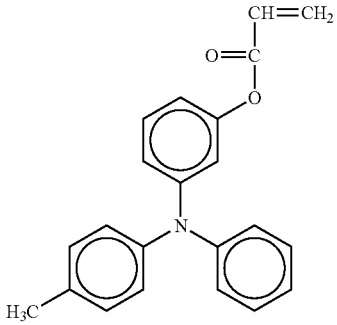
No. 7
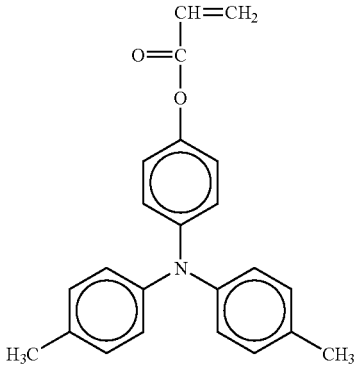
No. 8
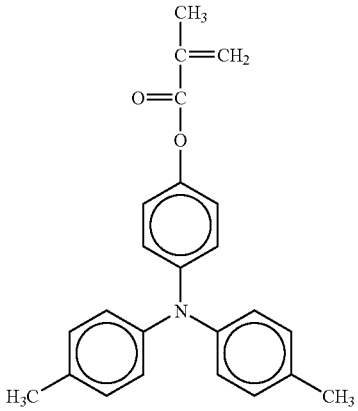

-continued
No. 9
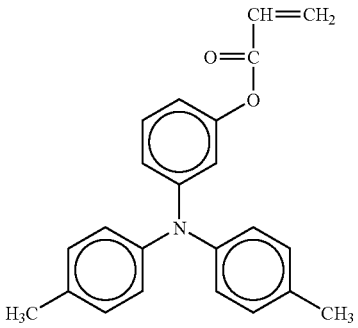
No. 10
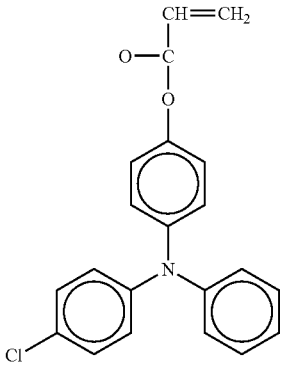
No. 11
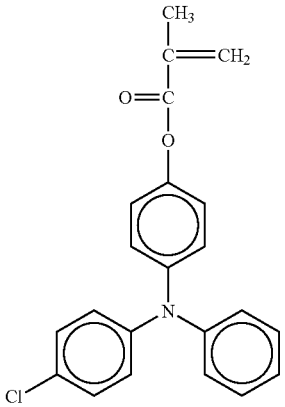
No.12
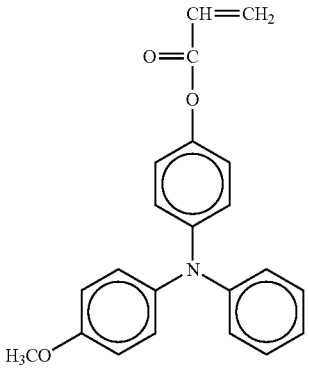
-continued
No. 13
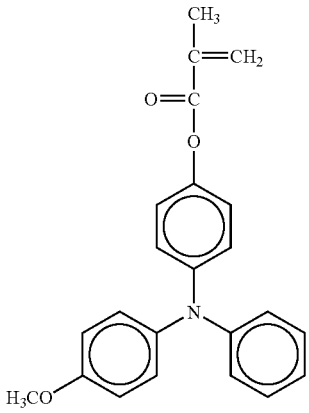
No. 14
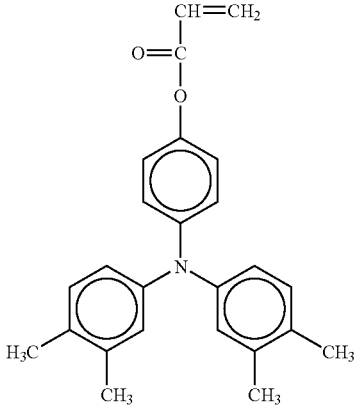
No. 15
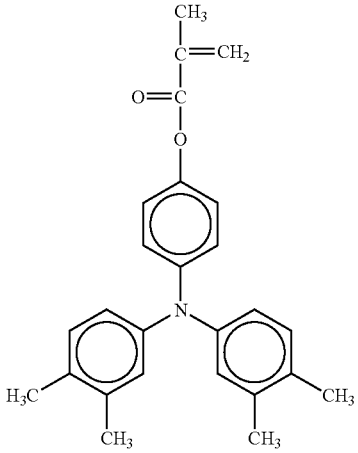
No. 16
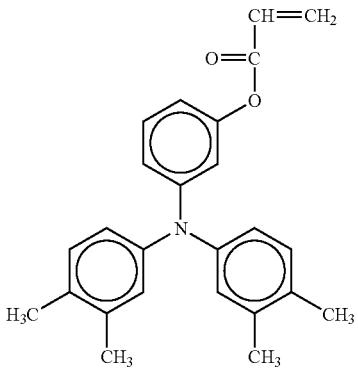

-continued
No. 17
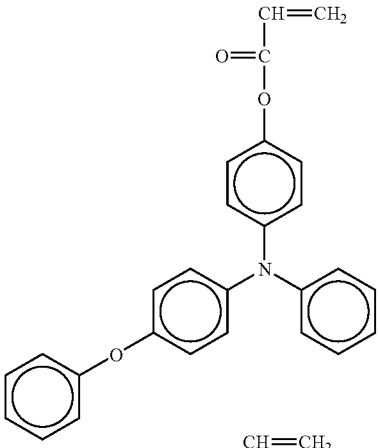
No. 18
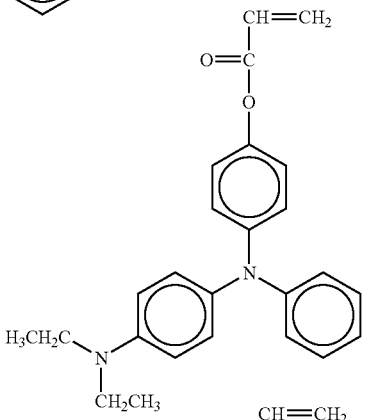
No 19
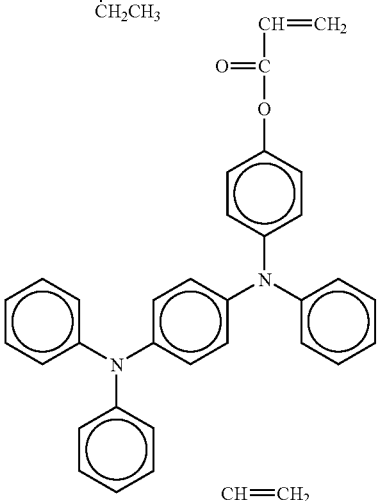
No. 20
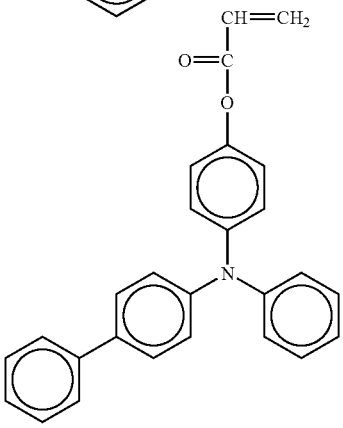
-continued
No. 21
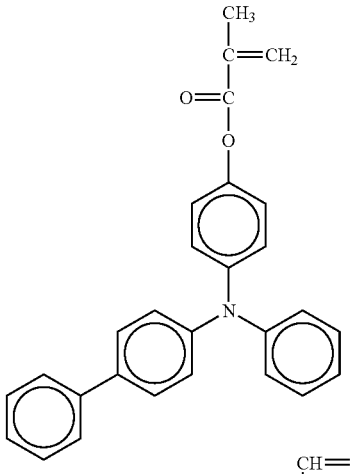
No. 22
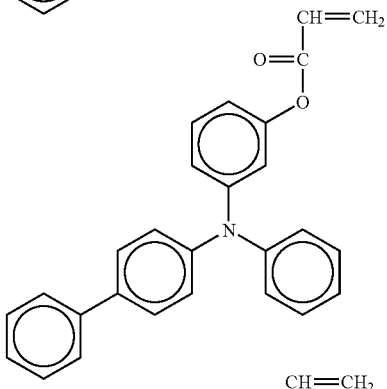
No. 23
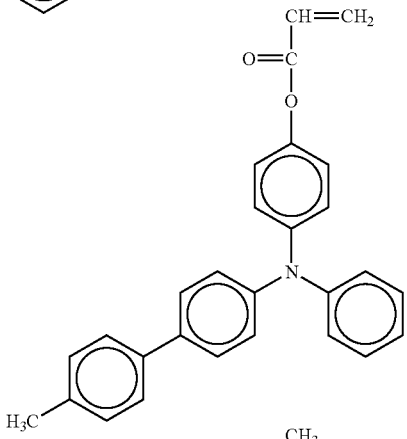
No. 24
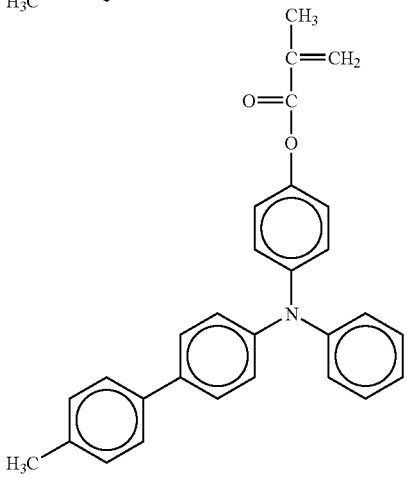

-continued
No. 25
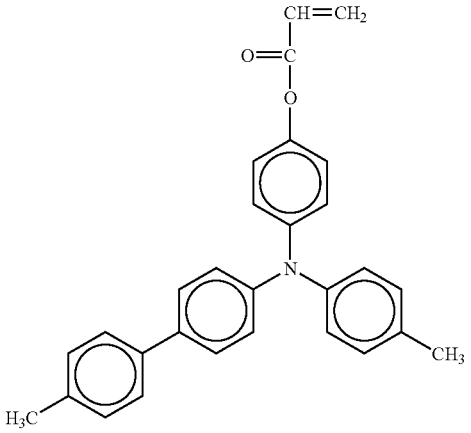
No. 26
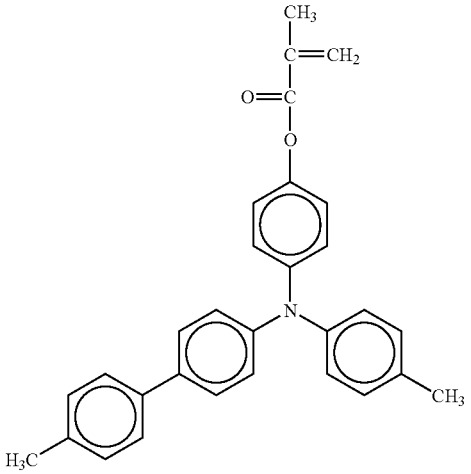
No. 27
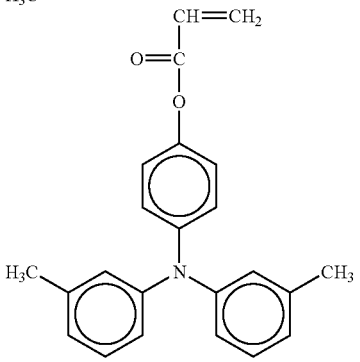
No. 28
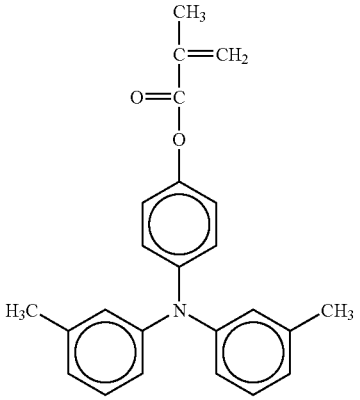
-continued
No. 29
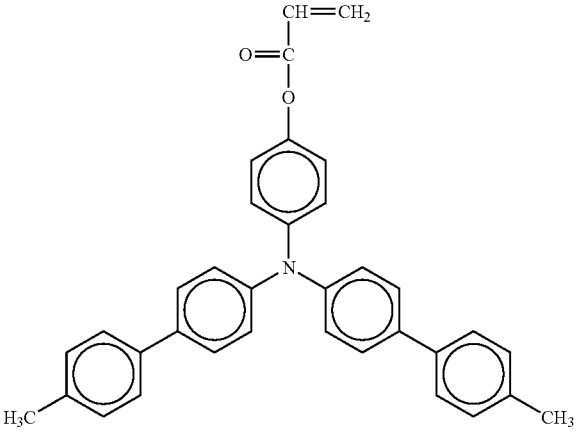
No. 30
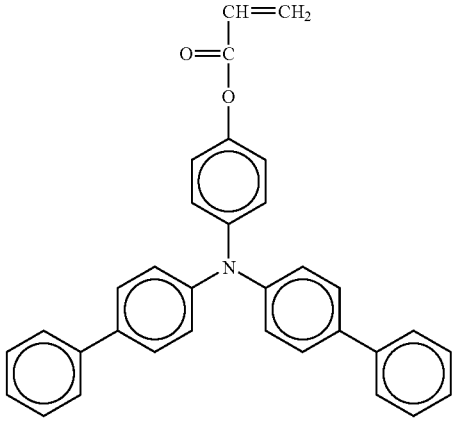
No. 31
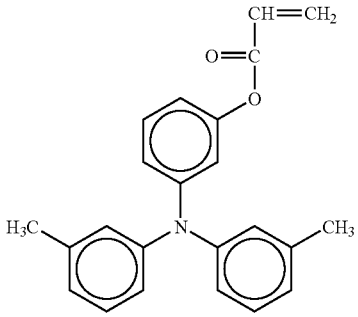
No. 32
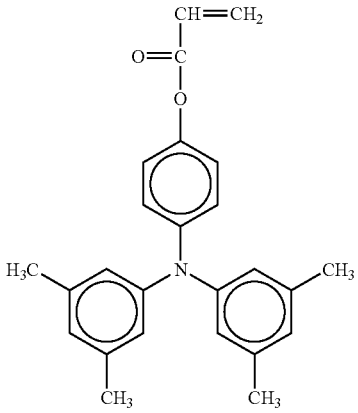

-continued
No. 33
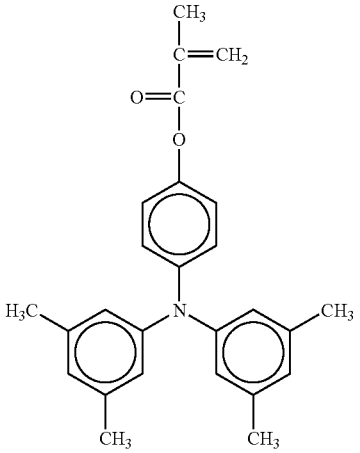
No. 34
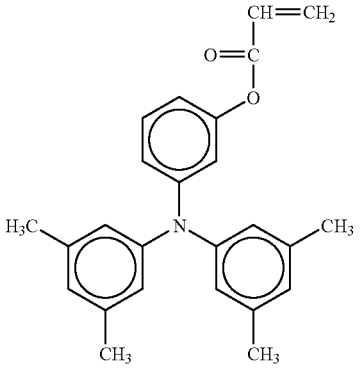
No. 35
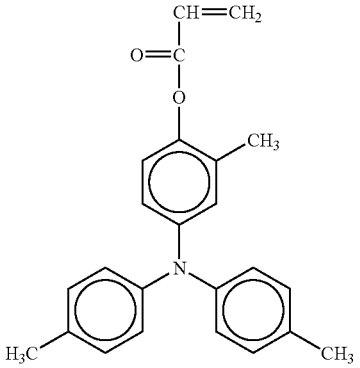
No. 36
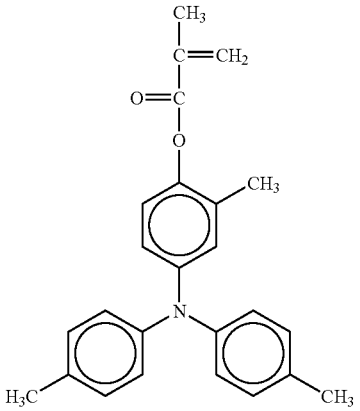
-continued
No. 37
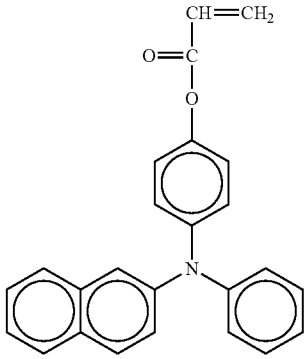
No. 38
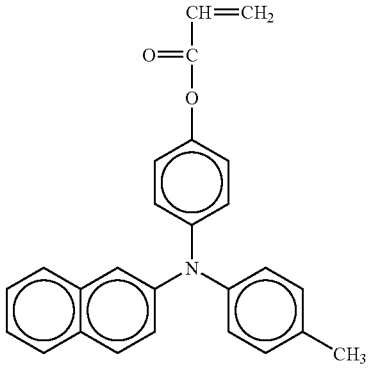
No. 39
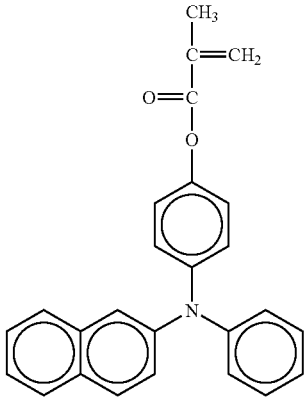
No. 40
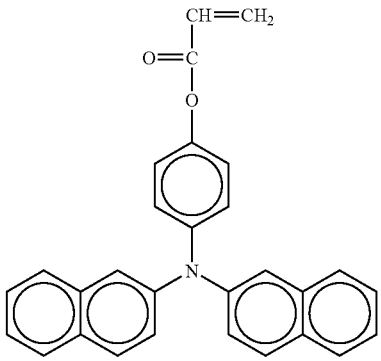

-continued
No. 41
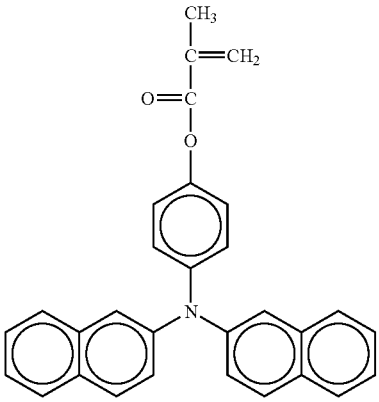
No. 42
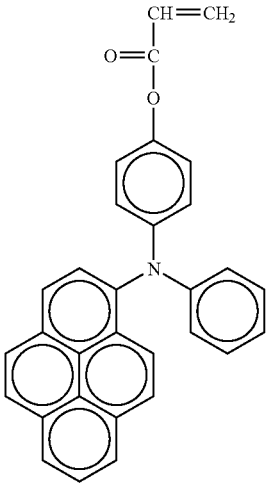
No. 43
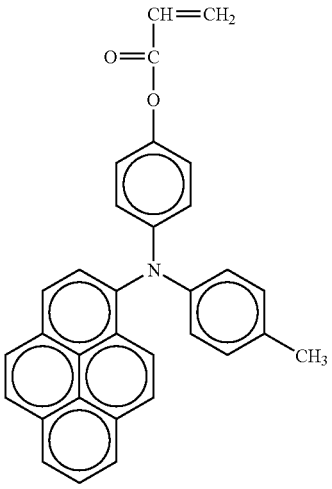
-continued
No. 44
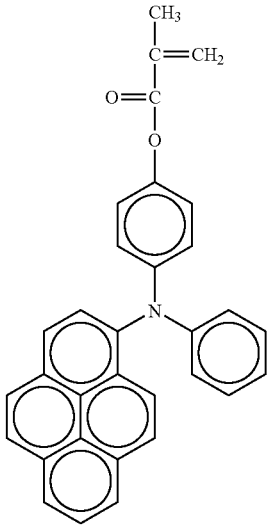
No. 45
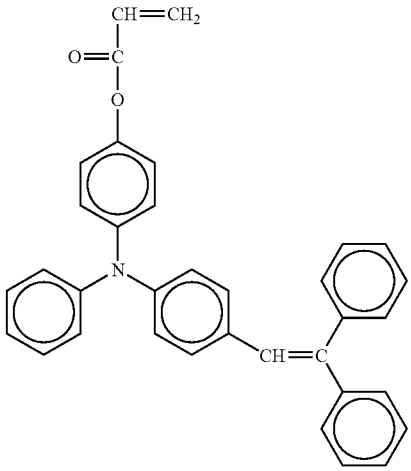
No. 46
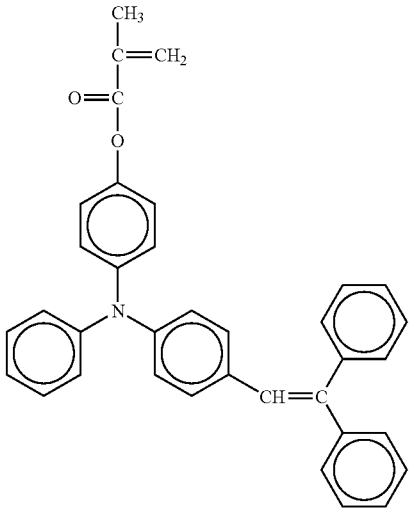

-continued
No. 47
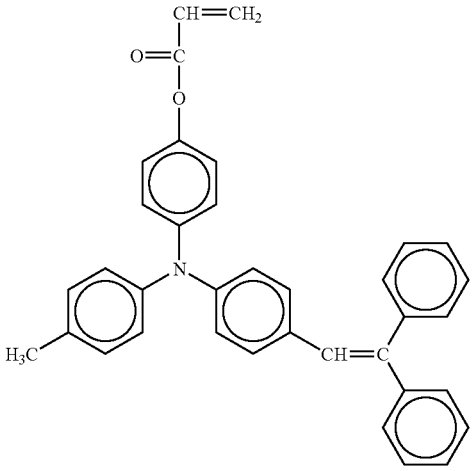
No. 48
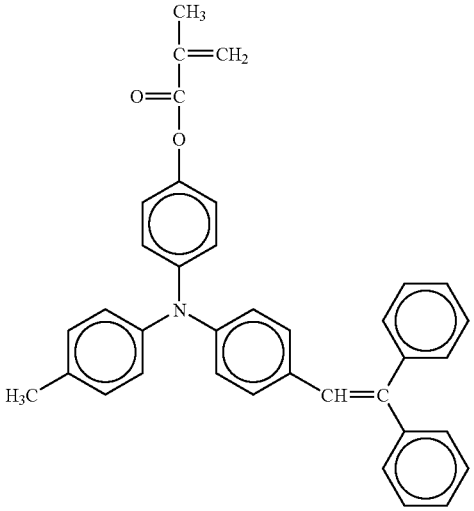
No. 49
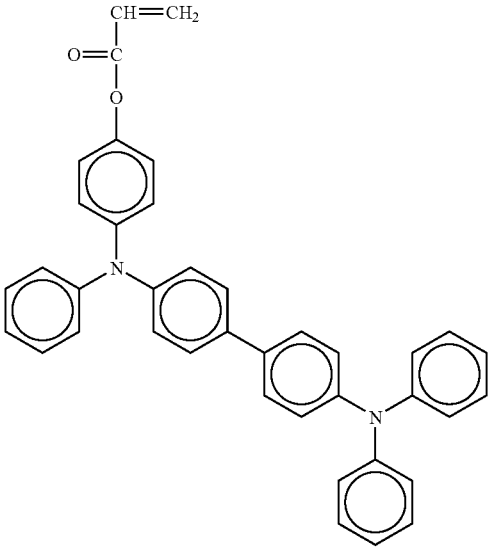
-continued
No. 50
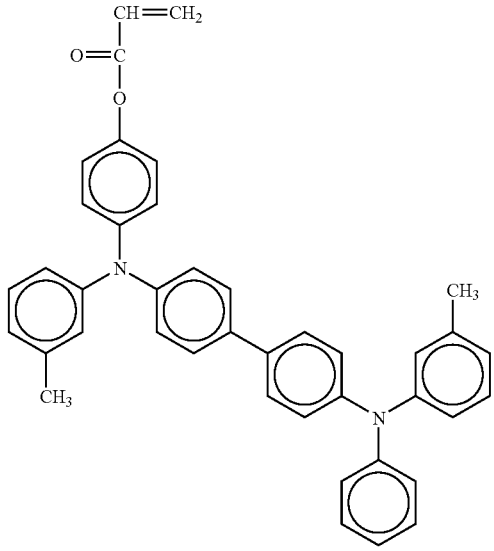
No. 51
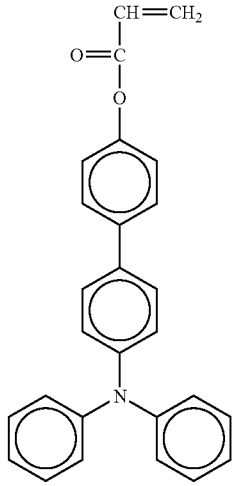
No. 52
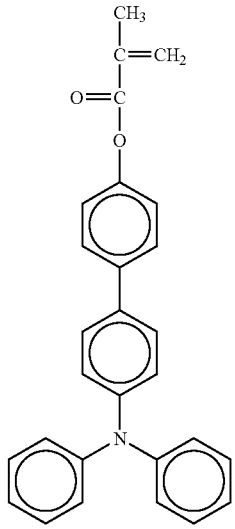

-continued
No. 53
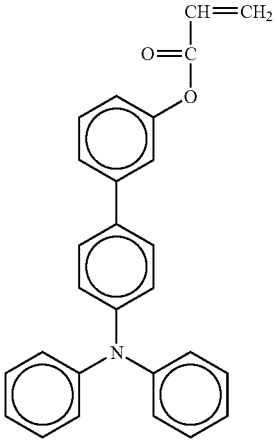
No. 54
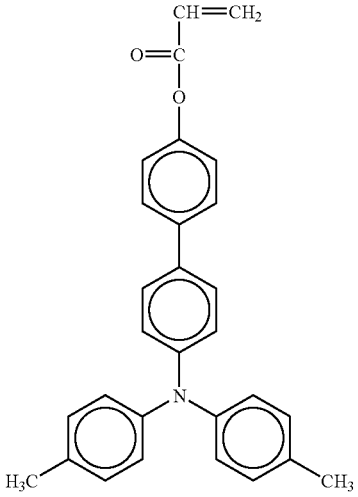
No. 55
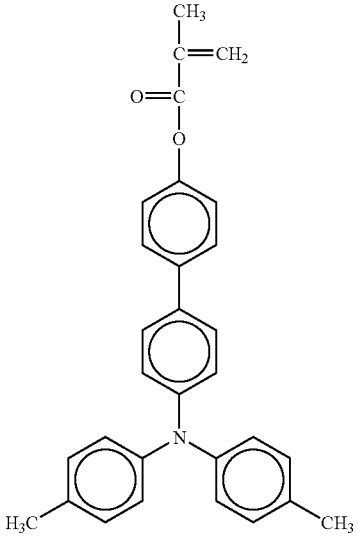
-continued
No. 56
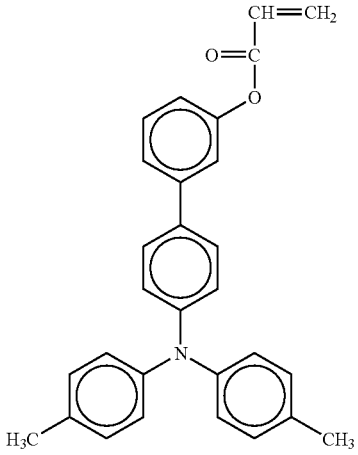
No. 57
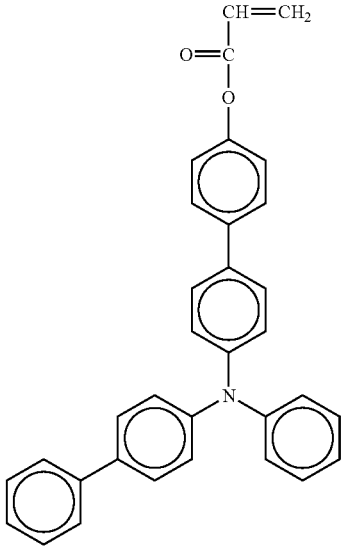
No. 58
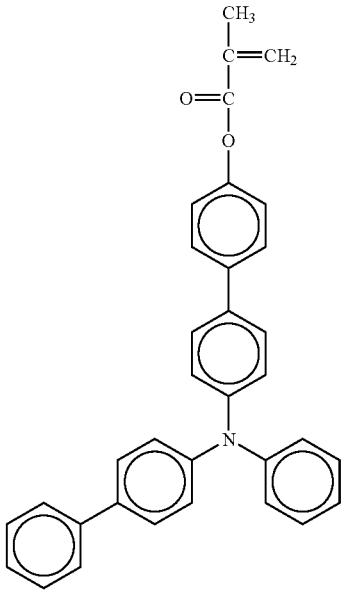

-continued
No. 59
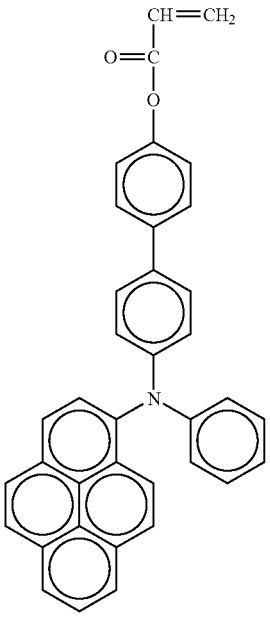
No. 60
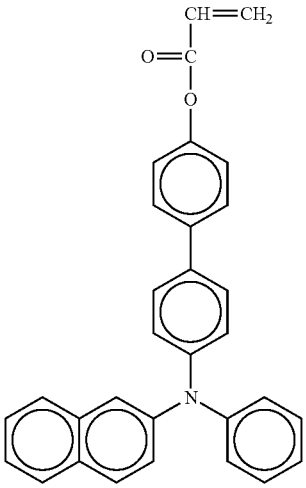
No. 61
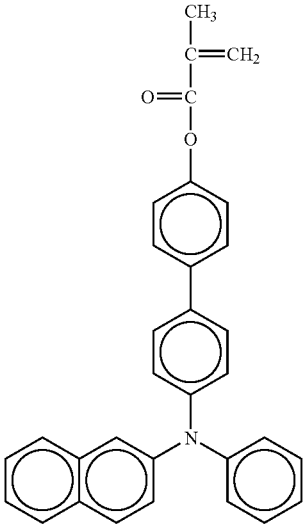
-continued
No. 62
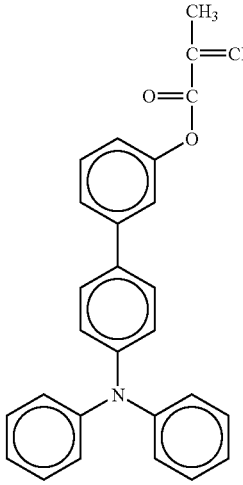
No. 63
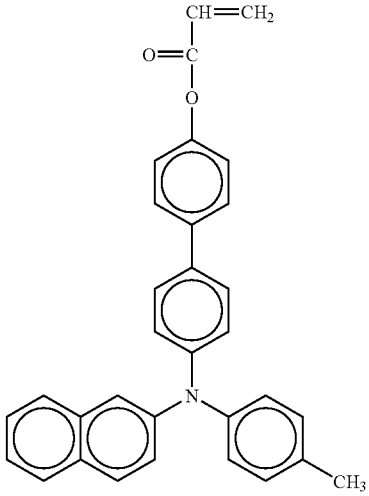
No. 64
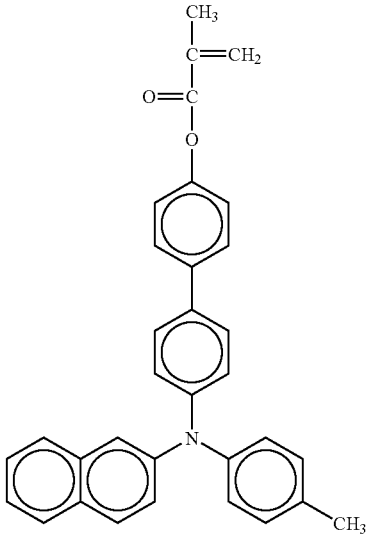

-continued
No. 65
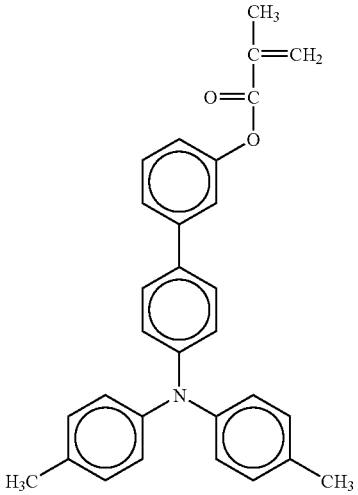
No. 66
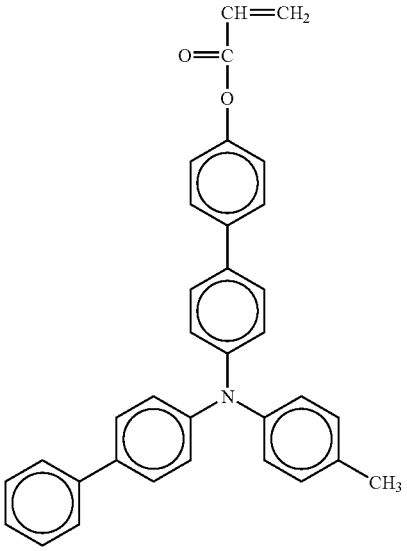
No. 67
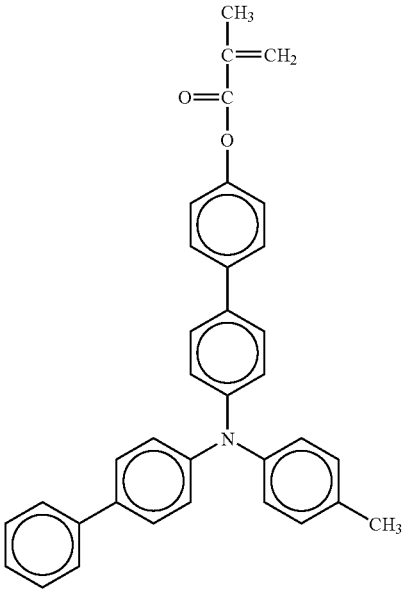
-continued
No. 68
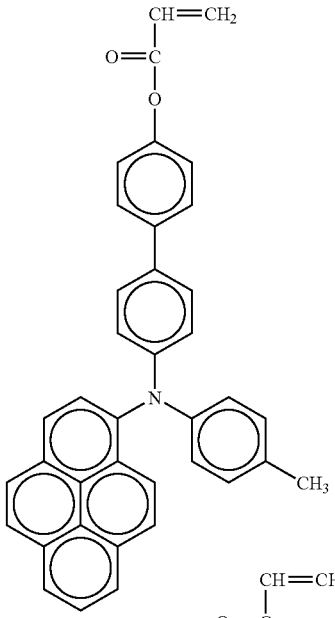
No. 69
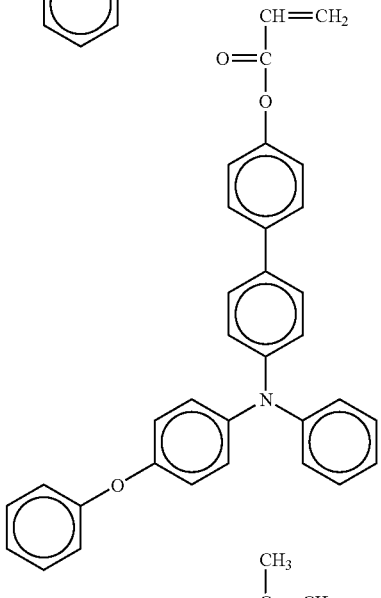
No. 70
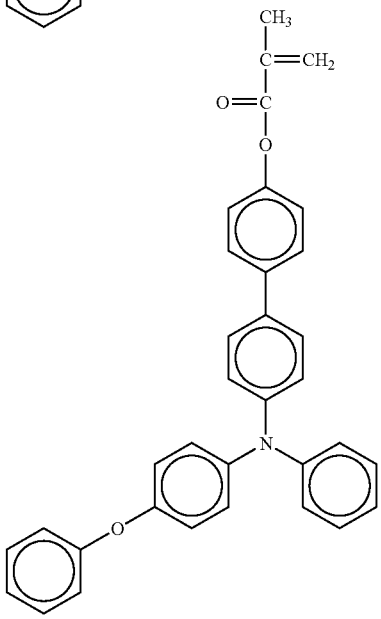

-continued
No. 71
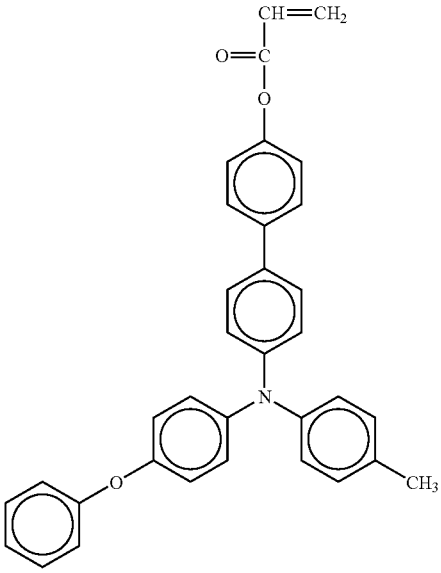
No. 72
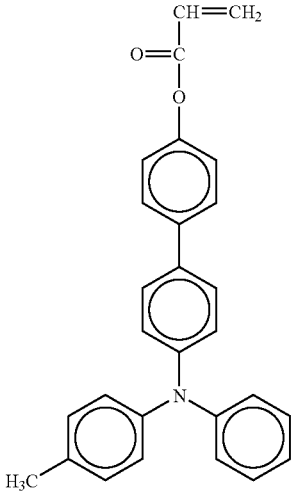
No. 73
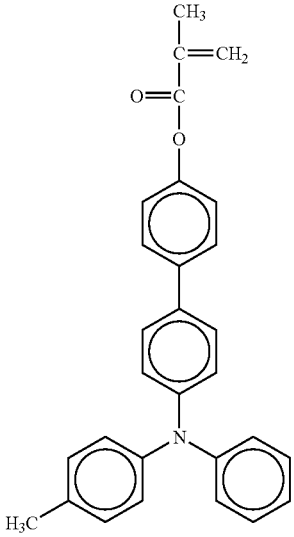
-continued
No. 74
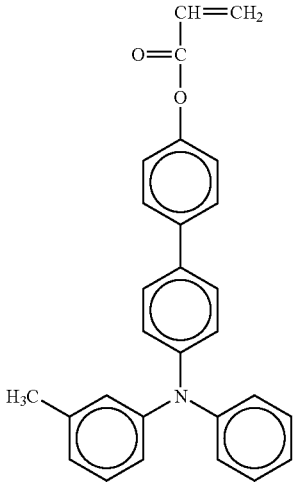
No. 75
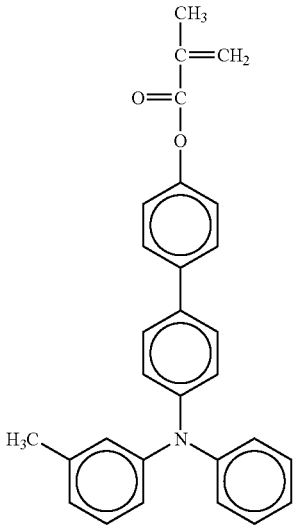
No. 76
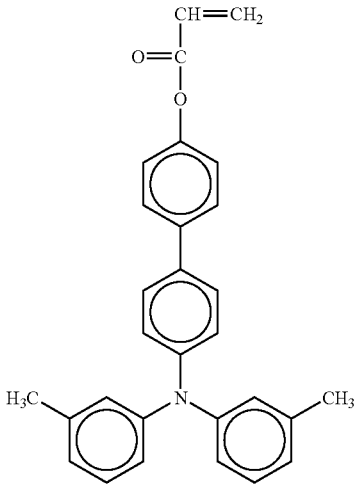

-continued
No. 77
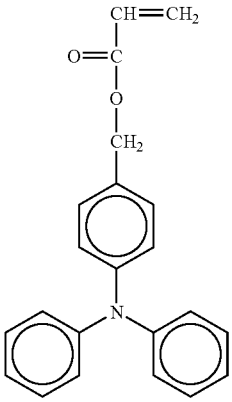
No. 78
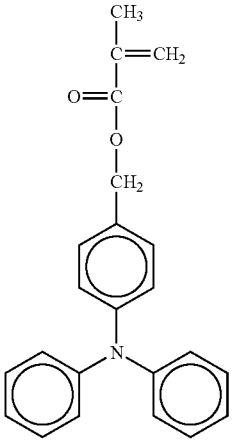
No. 79
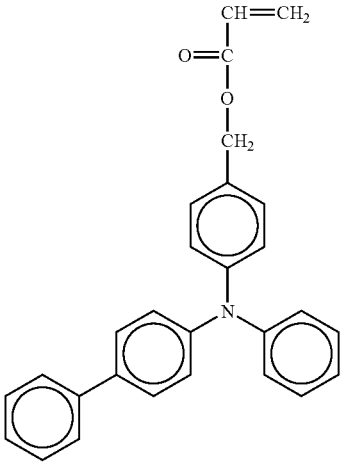
-continued
No. 80
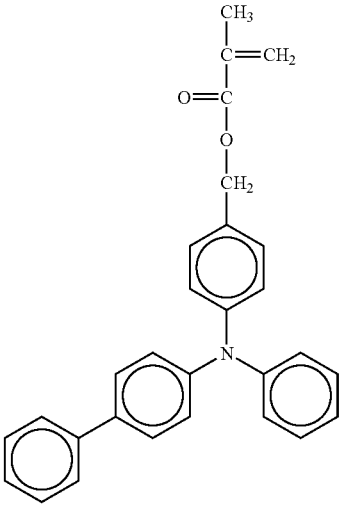
No. 81
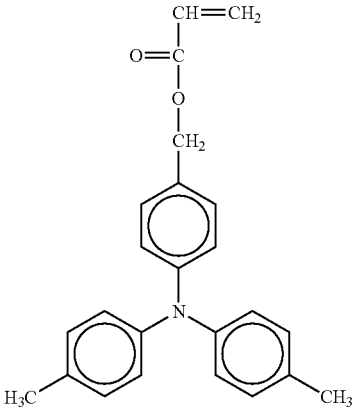
No. 82
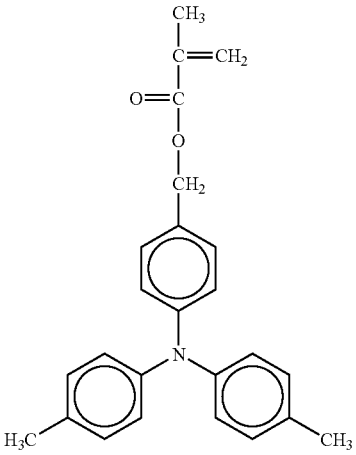

-continued
No. 83
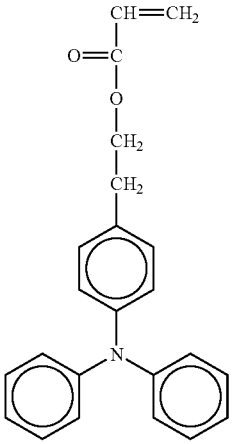
No. 84
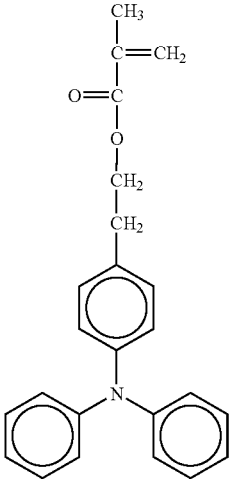
No. 85
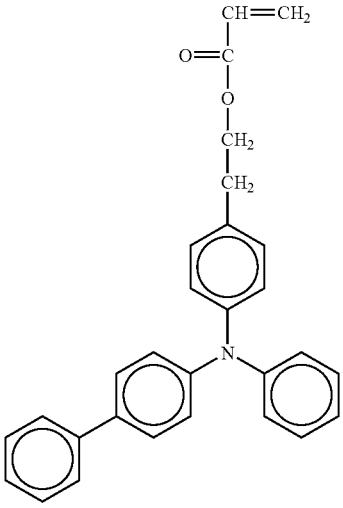
-continued
No. 86
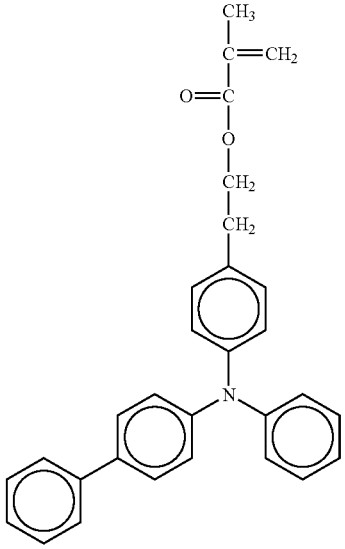
No. 87
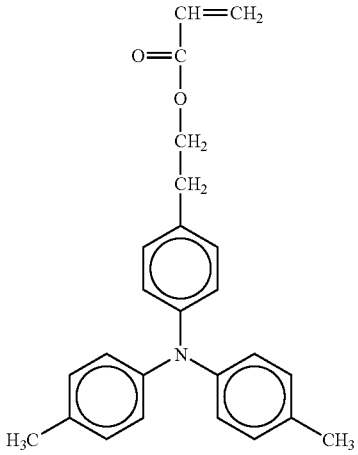
No. 88
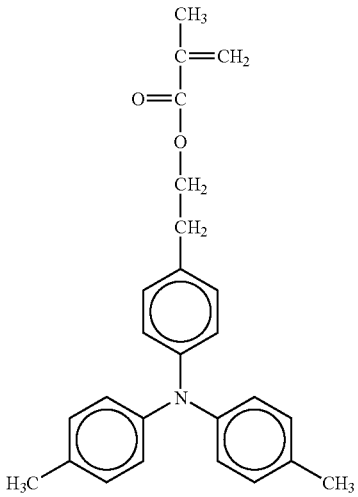

-continued
No. 89
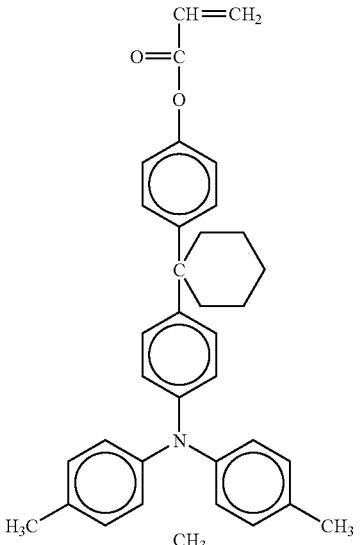
No. 90
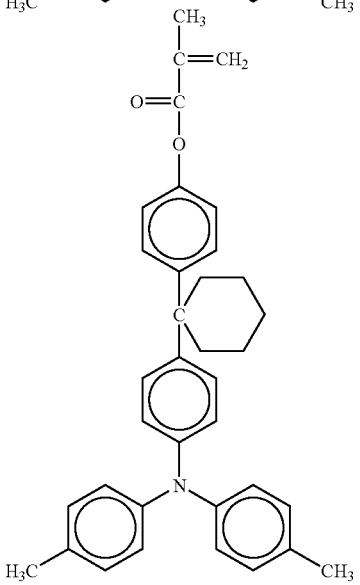
No. 91
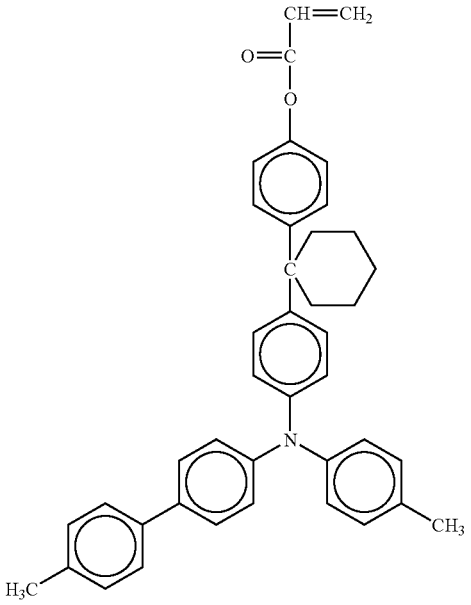
-continued
No. 92
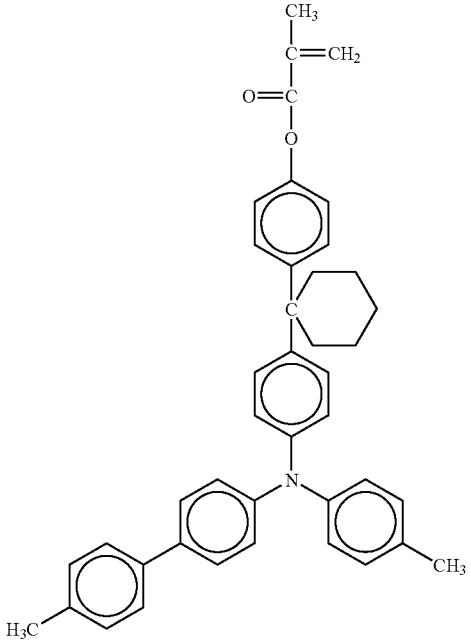
No. 93
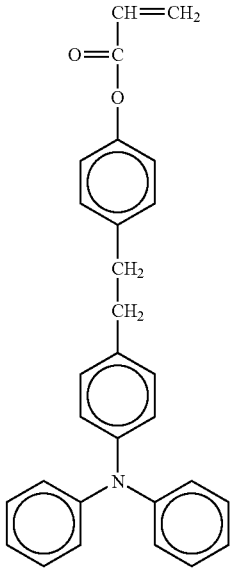

-continued
No. 94
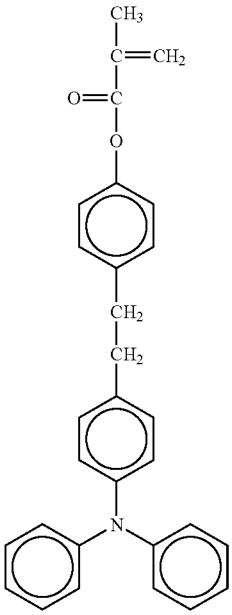
No. 95
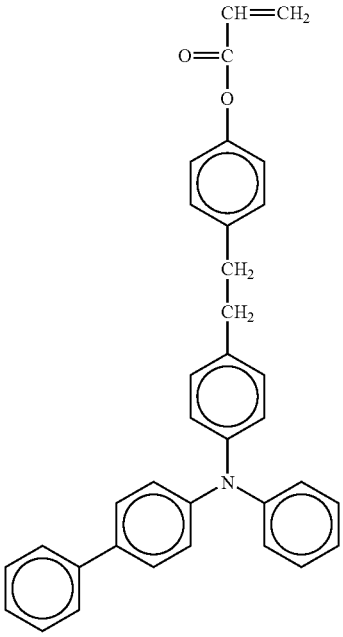
-continued
No. 96
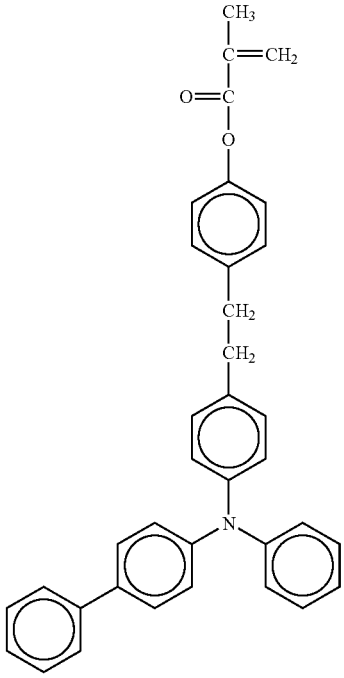
No. 97
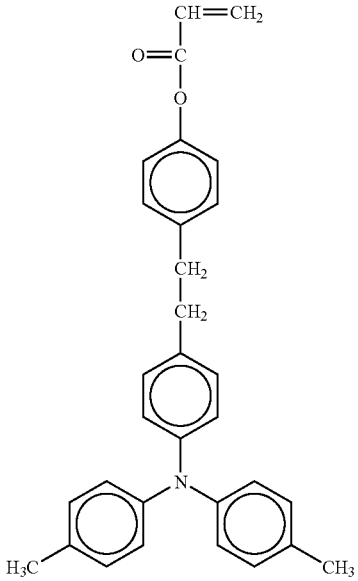

-continued
No. 98
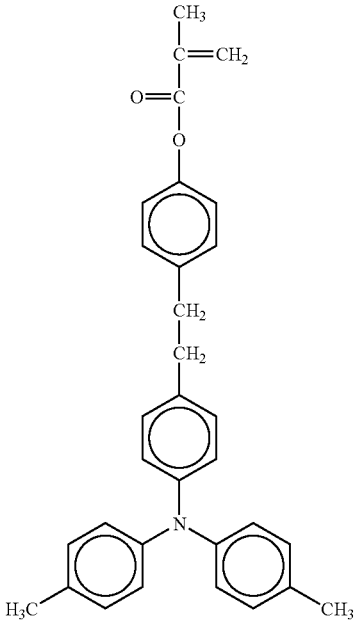
No. 99
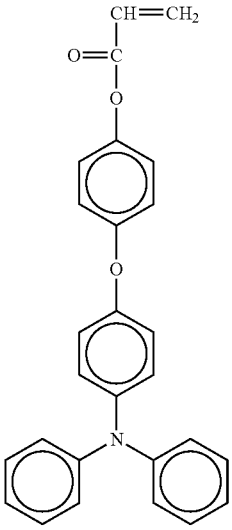
-continued
No. 100
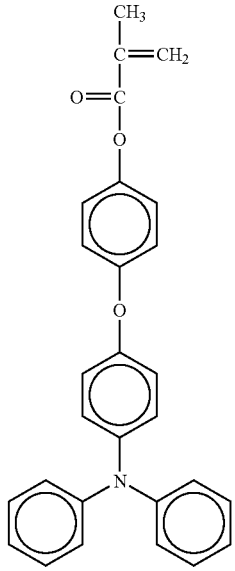
No. 101
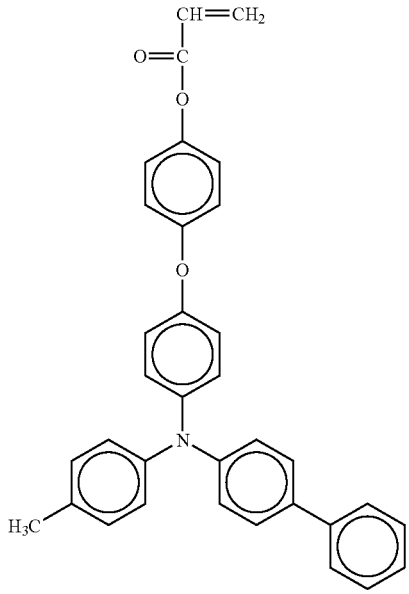

-continued
No. 102
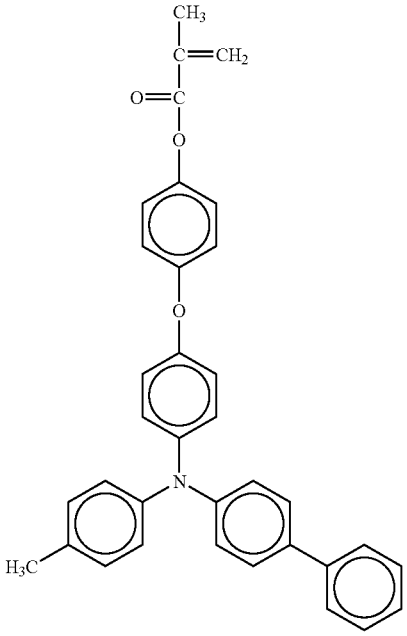
No. 103
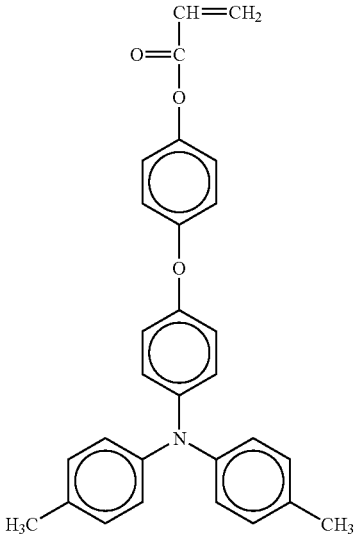
-continued
No. 104
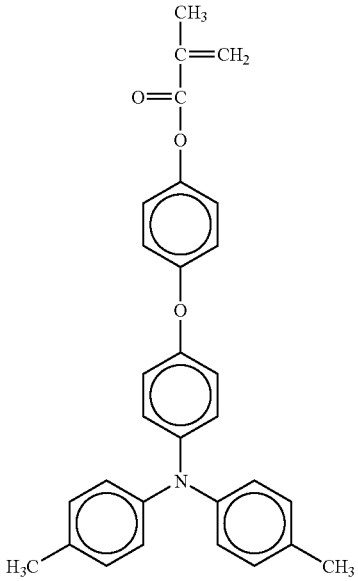
No. 105
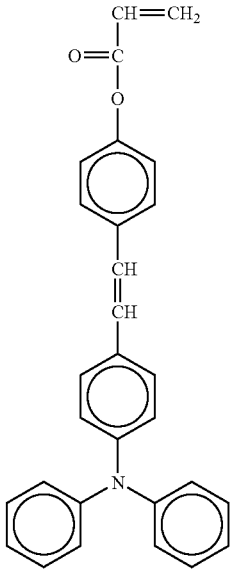

-continued
No. 106
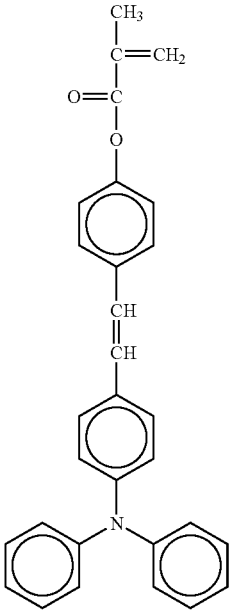
-continued
No. 108
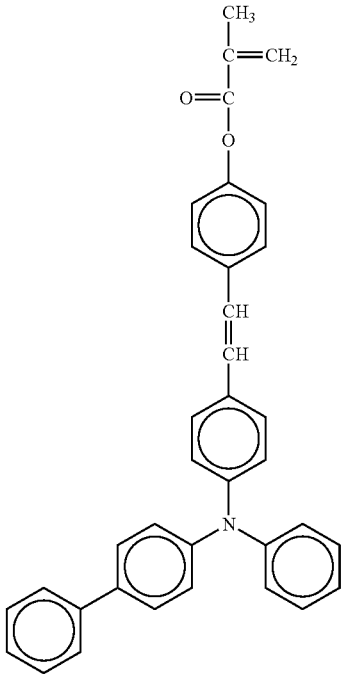
No. 107
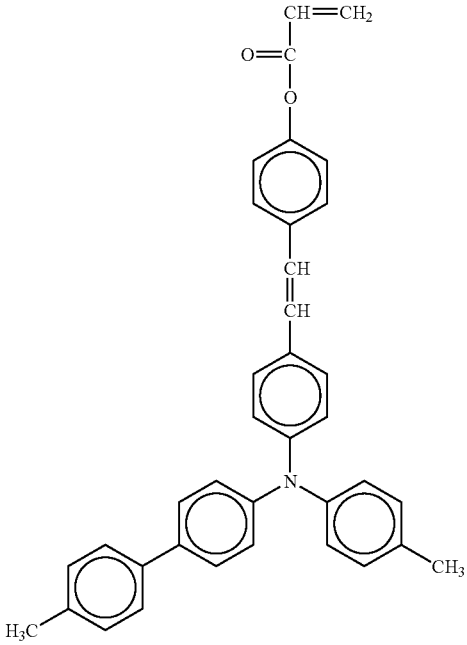
No. 109
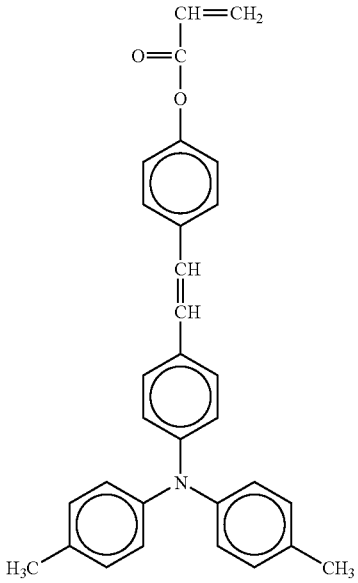

-continued
No. 110
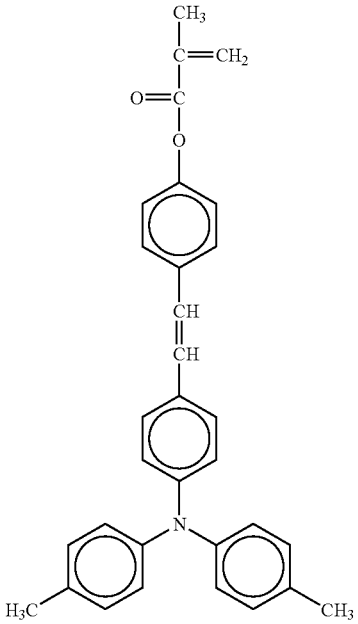
No. 111
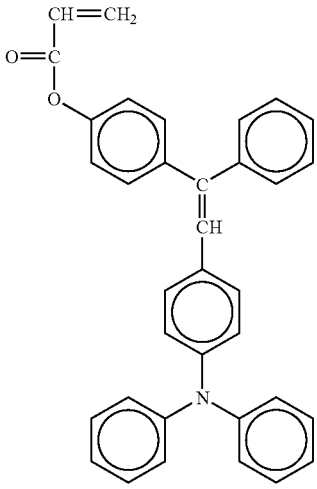
No. 112
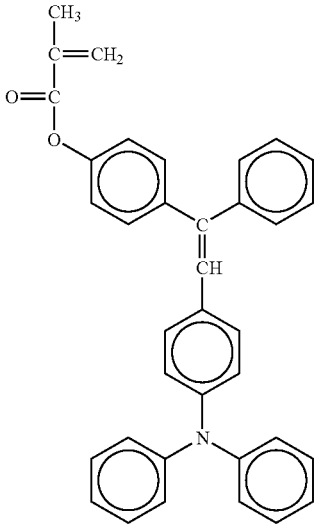
-continued
No. 113
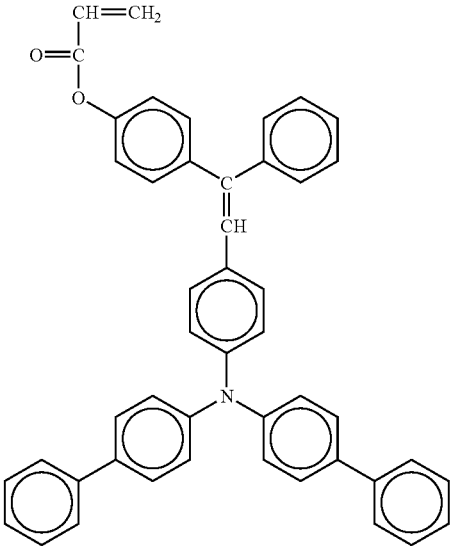
No. 114
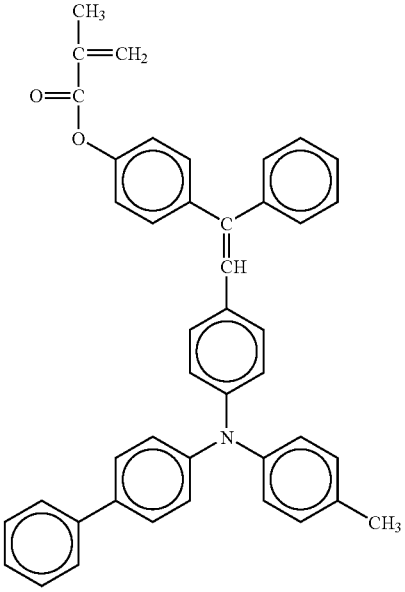
No. 115
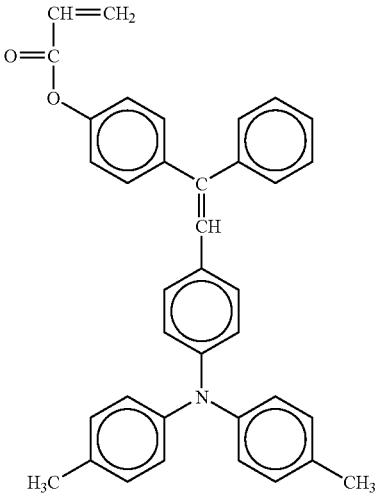

-continued
No. 116
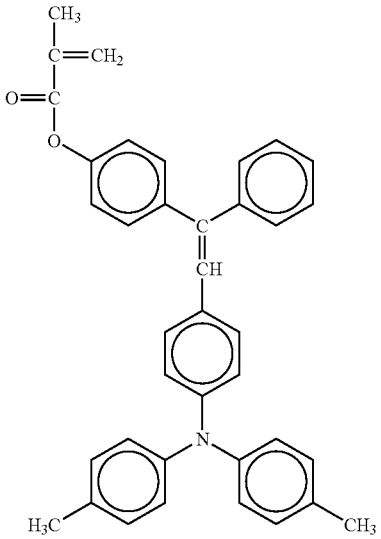
No. 117
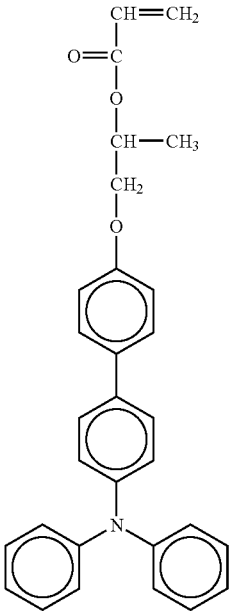
-continued
No. 118
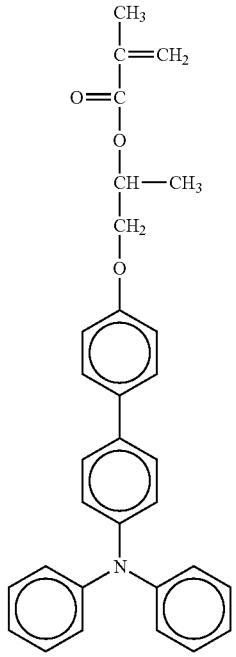
No. 119
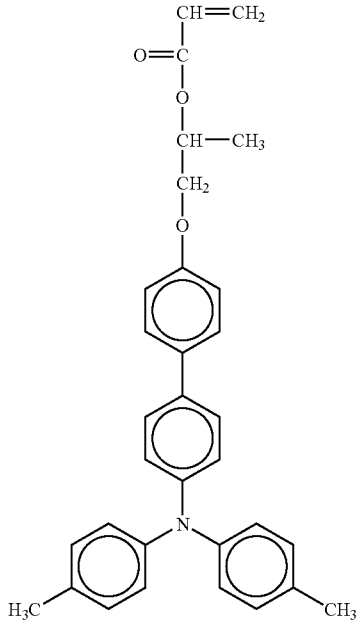

-continued
No. 120
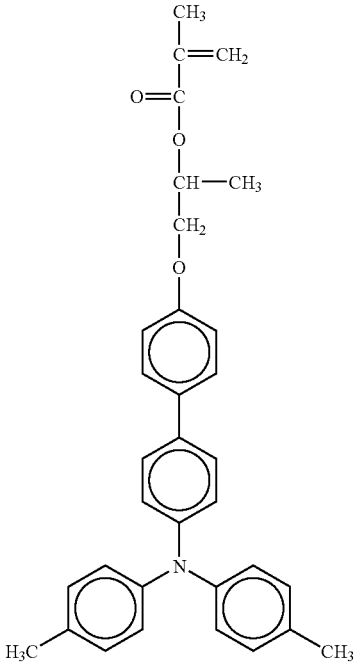
-continued
No. 122
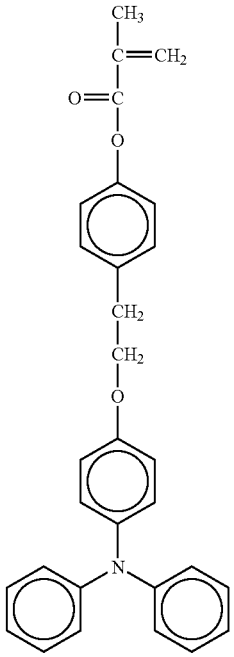
No. 121
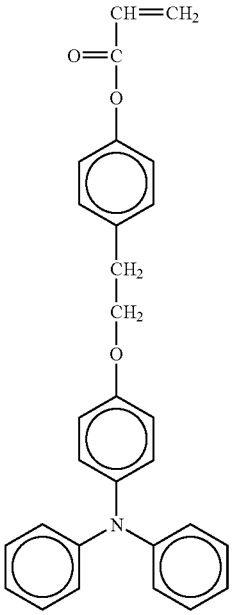
No. 123
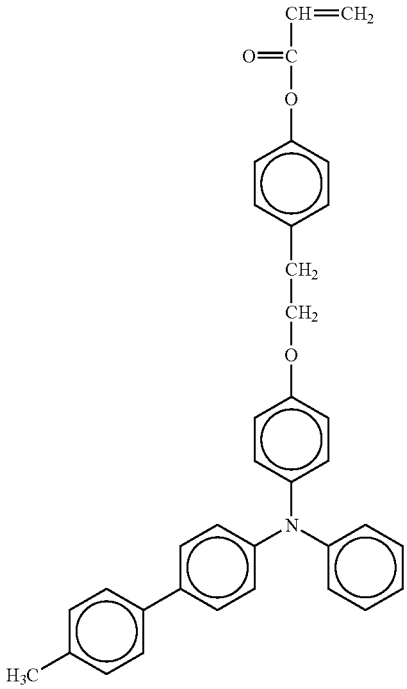

-continued
No. 124
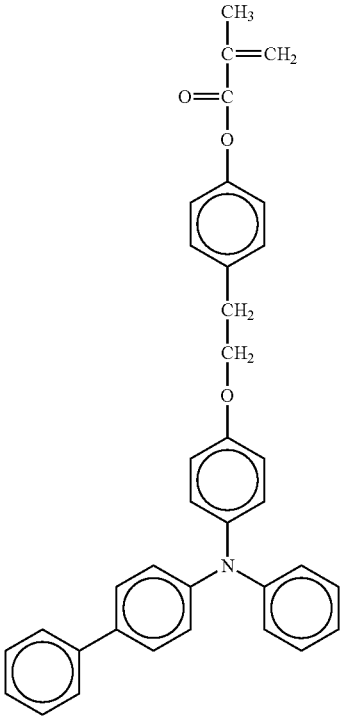
No. 125
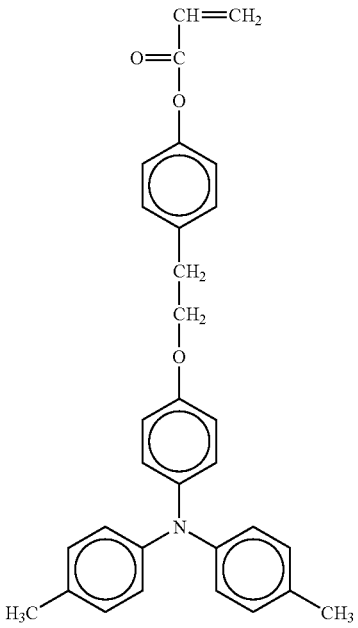
-continued
No. 126
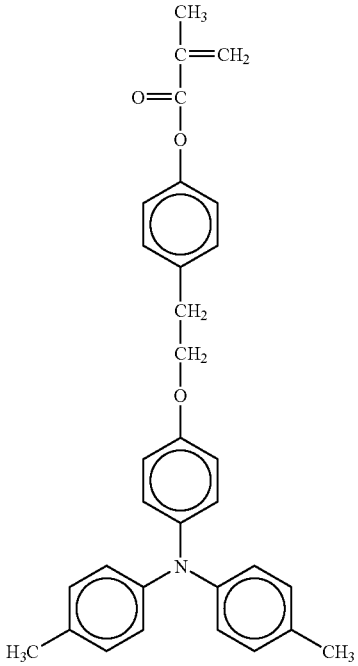
No. 127
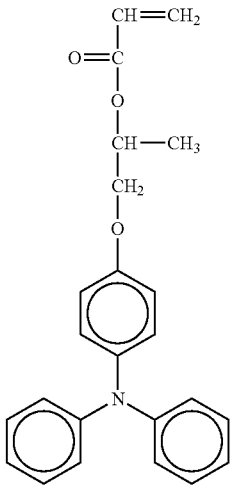

-continued
No. 128
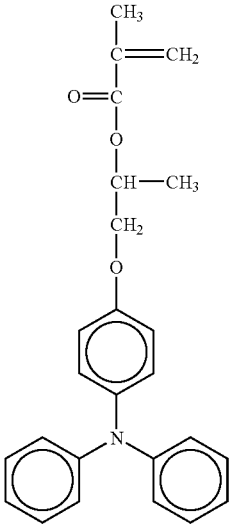
No. 129
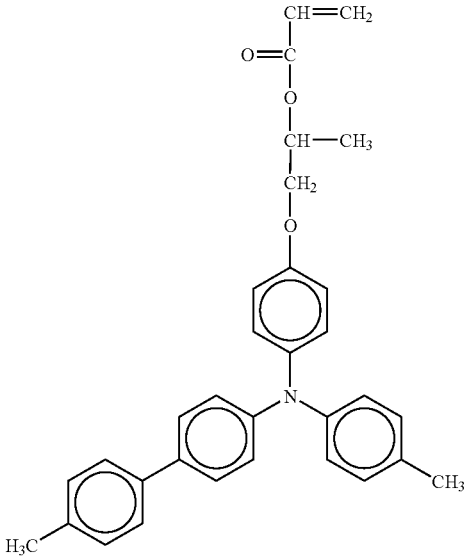
-continued
No. 130
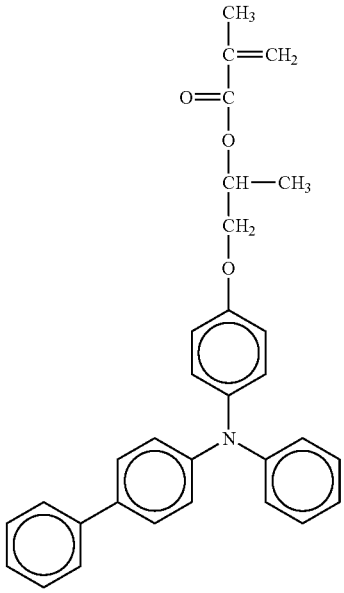
No. 131
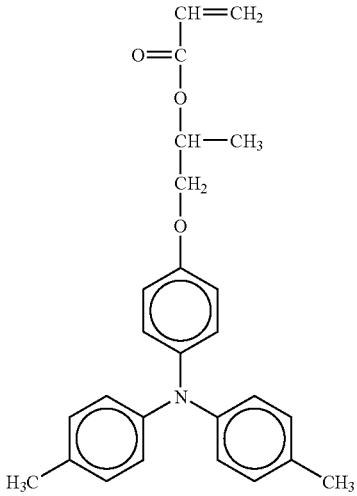
No. 132
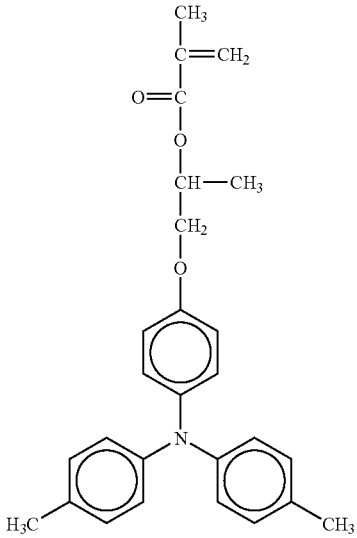

-continued
No. 133
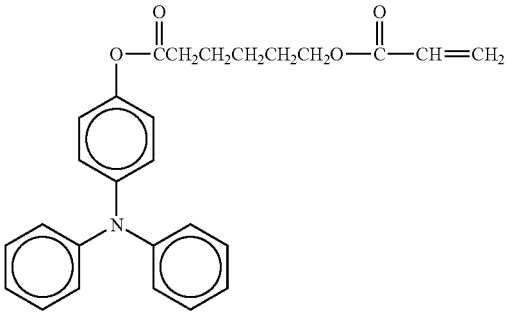
No. 134
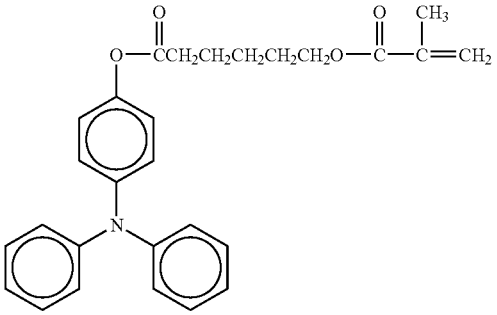
No. 135
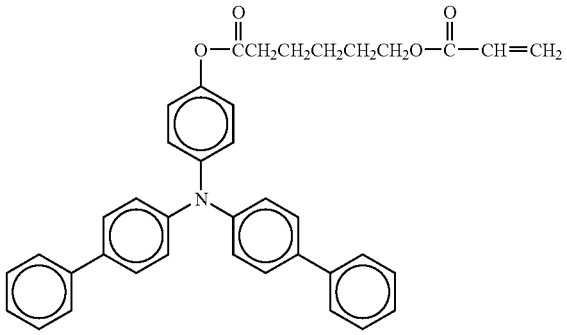
No. 136
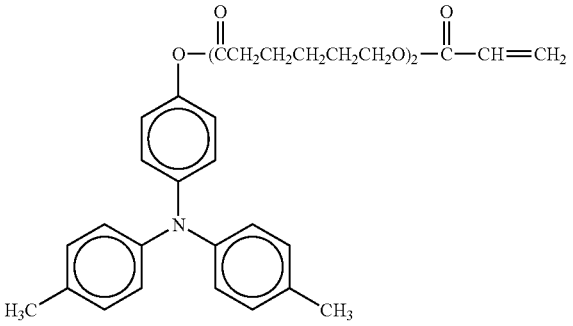
-continued
No. 137
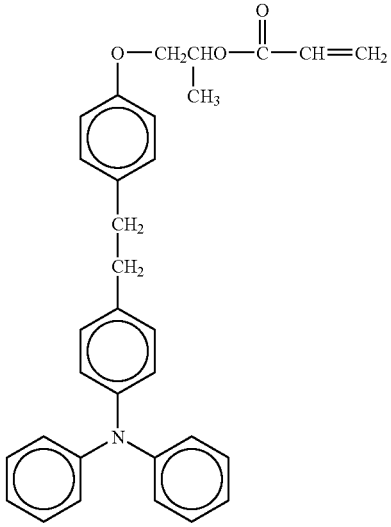
No. 138
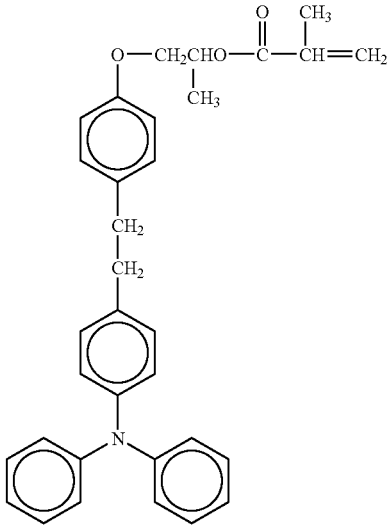
No. 139
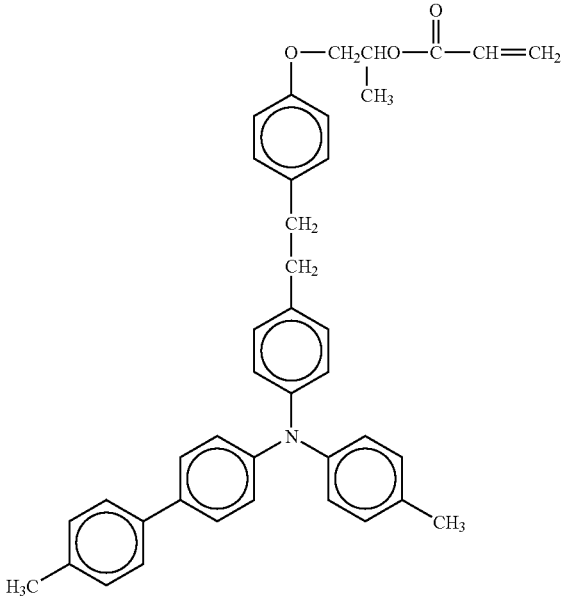

-continued
No. 140
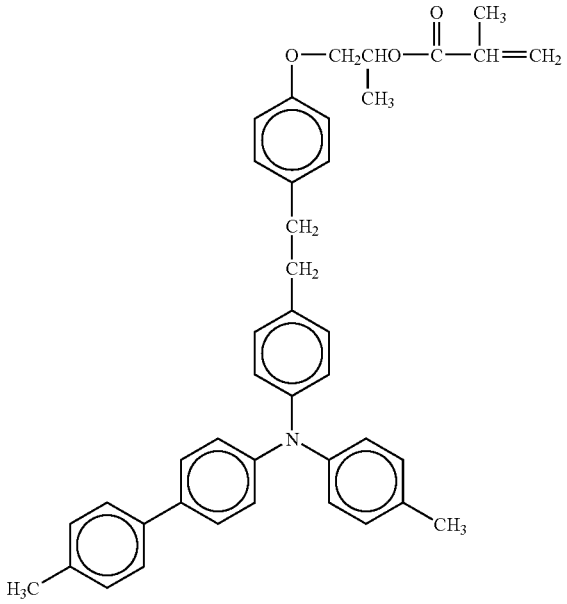
No. 141
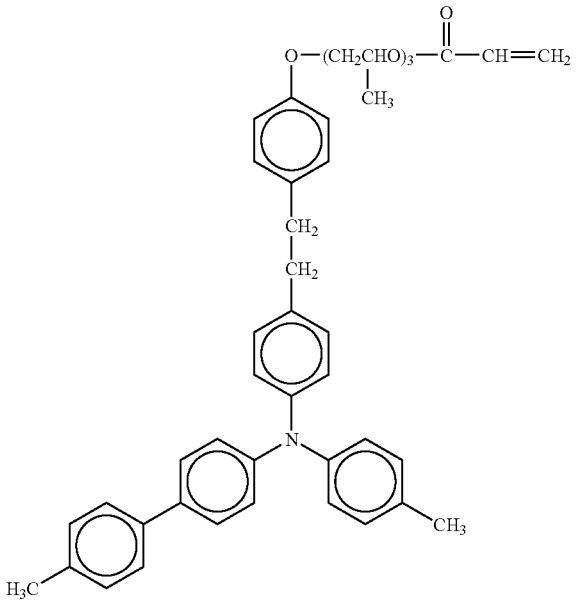
-continued
No. 142
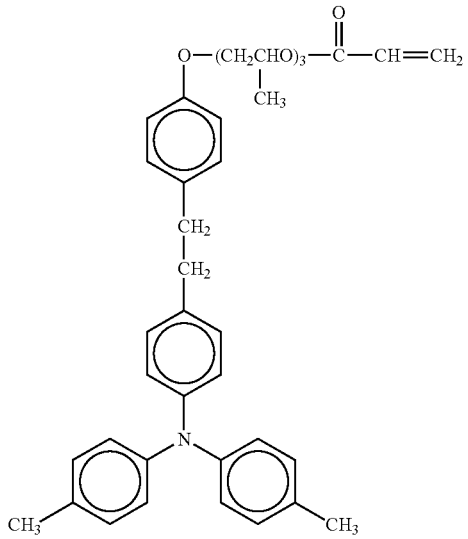
No. 143
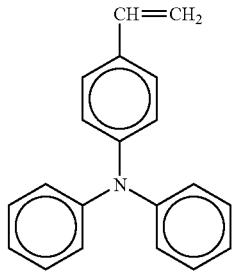
No. 144
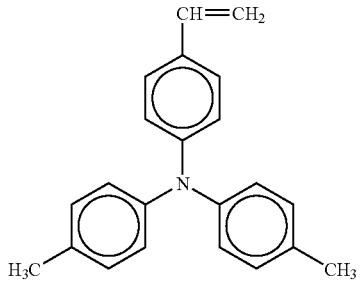
No. 145
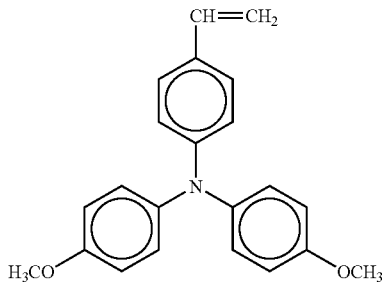

-continued
No. 146
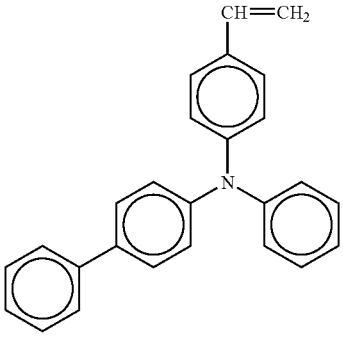
No. 147
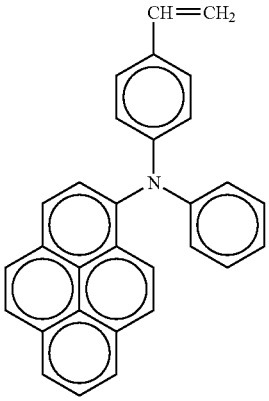
No. 148
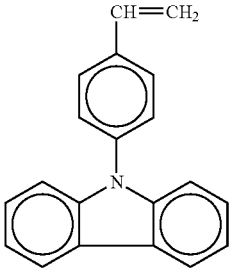
No. 149
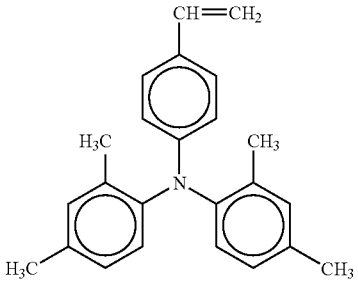
No. 150
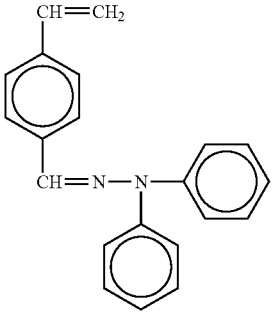
-continued
No. 151
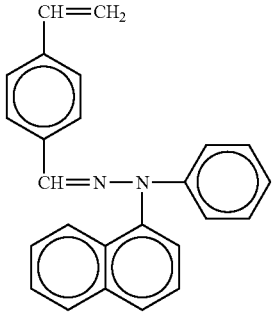
No. 152
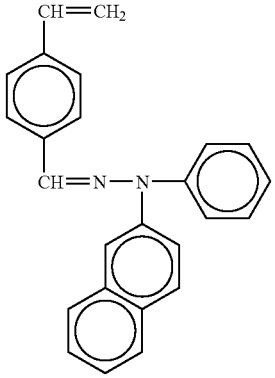
No. 153
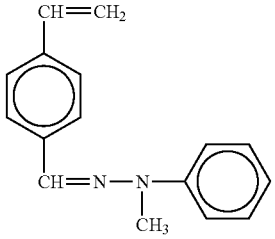
No. 154
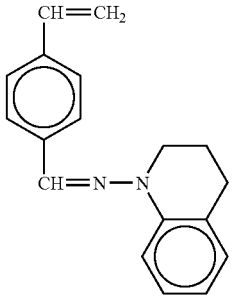
No. 155
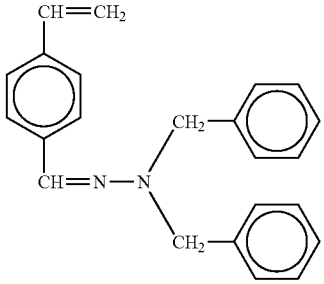

-continued

No. 156

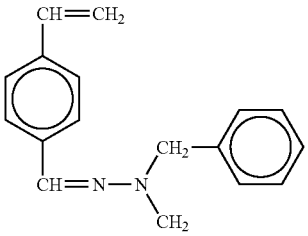

No. 157

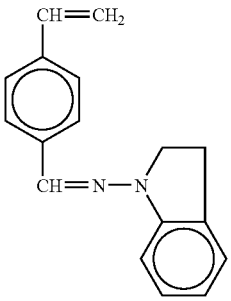

No. 158

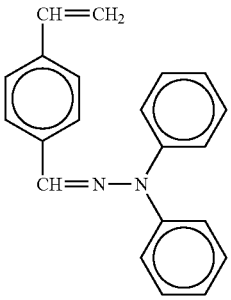

No. 159

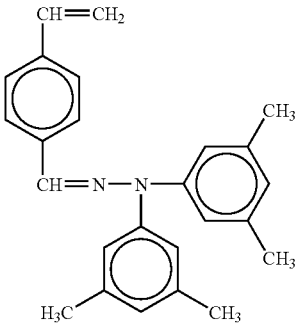

No. 160

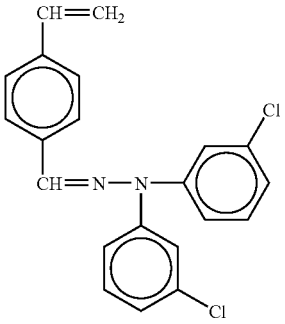

Also, the one-functional radical-polymerizable compound having a charge transporting structure used for the present invention is important for giving charge transportation ability to the surface layer and the content of the component is 20-80% by weight, preferably 30-70% by weight of the total weight of the surface layer. If the content of the component is less then 20% by weight, the charge transportation ability of the surface layer cannot be maintained sufficiently and the degradation of the electrical characteristics such as the lowering in the sensitivity and the elevation of the residual electric potential are caused in repeated use. On the other hand, if the content is greater than 80% by weight, the content of the three or more-functional monomer having no charge transporting structure is reduced. Consequently, the lowering in the density of cross-linkage is caused and the abrasive resistance is not exerted. Although required abrasive resistance and electrostatic characteristics depend on a used process, the content is most preferably in a range of 30-70% by weight, in view of the balance of abrasive resistance and electrostatic characteristics.

The surface layer in the present invention is preferably a surface layer obtained by curing at least the three or more-functional radical-polymerizable monomer having no charge transporting structure and the one-functional radical-polymerizable compound having a charge transporting structure but, of course, a one-functional or two functional radical-polymerizable monomer or radical-polymerizable oligomer can be used singularly or in combination. Then, a well-known radical-polymerizable monomer or oligomer can be used.

As the one-functional radical monomer, for example, 2-ethylhexyl acrylate, 2-hydroxyethyl acrylate, 2-hydroxypropyl acrylate, tetrahydrofurfuryl acrylate, 2-ethylhexyl-Carbitrol acrylate, 3-methoxybutyl acrylate, benzyl acrylate, cyclohexyl acrylate, isoamyl acrylate, isobutyl acrylate, methoxytriethylene glycol acrylate, phenoxytetraethylene glycol acrylate, cetyl acrylate, isostearyl acrylate, stearyl acrylate, styrene monomer, can be provided.

As two functional radical polymerizable monomer, for example, 1,3-butanediol diacrylate, 1,4-butanediol diacrylate, 1,4-butanediol dimethacrylate, 1,6-hexanediol diacrylate, 1,6-hexanediol dimethacrylate, diethyleneglycol diacrylate, neopentylglycol diacrylate, EO-modified bisphenol A diacrylate, EO-modified bisphenol F diacrylate, neopentylglycol diacrylate, can be provided.

As the functional monomer, for example, monomers substituted with a fluorine atom such as octafluoropentyl acrylate, 2-perfluorooctylethyl acrylate, 2-perfluorooctylethyl methacrylate, and 2-perfluoroisononylethyl acrylate, and vinyl monomer, acrylates and methacrylates which have a polysiloxane group, such as acryloyl poly(dimethylsiloxane)ethyl, methacryloyl poly(dimethylsiloxane)ethyl, acryloyl poly(dimethylsiloxane)propyl, acryloyl poly(dimethylsiloxane)butyl, and diacryloyl poly(dimethylsiloxane) diethyl, which have 20-70 siloxane repeated units, and are disclosed in Japanese Examined Patent Application No. 5-60503 and Japanese Examined Patent Application No. 6-45770, can be provided.

As the radical-polymerizable oligomer, for example, epoxyacrylate-type oligomer, urethane acrylate-type oligomer, and polyester acrylate-type oligomer can be provided.

Also, when the aforementioned curing-type resin is used for the surface layer in the present invention, a polymerization initiator may be used for the surface layer according to need, for example, for promoting the cross-linking reaction efficiently.

As a thermal polymerization initiator, peroxide-type initiators such as 2,5-dimethylhexane-2,5-dihydroperoxide, dicumylperoxide, benzoyl peroxide, t-butylcumylperoxide, 2,5-dimethyl-2,5-di(peroxybenzoyl)hexyne-3,3-di-t-butylperoxide, t-butylhydroperoxide, cumene hydroperoxide, and lauroyl peroxide, and azoic initiators such as azobis(isobutylnitrile), azobis(cyclohexanecarbonitrile), azobis(methyl isobutyrate), azobis(isobutylamidine hydrochloride), and 4,4'-azobis(4-cyanovaleric acid) can be provided.

As a photo-polymerization initiator, acetophenone-based or ketal-type photo-polymerization initiators such as diethoxyacetophenone, 2,2-dimethoxy-1,2-diphenylethane-1-one, 1-hydroxycyclohexyl-phenylketone, 4-(2-hydroxyethoxy)phenyl(2-hydroxy-2-propyl)ketone, 2-benzyl-2-dimethylamino-1-(4-morpholinophenyl)butanone-1,2-hydroxy-2-methyl-1-phenylpropane-1-one, 2-methyl-2-morpholino(4-methylthiophenyl)propane-1-one, and 1-phenyl-1,2-propanedione-2-(o-ethoxycarbonyl)oxime, benzoin ether-type photo-polymerization initiators such as benzoin, benzoin methyl ether, benzoin ethyl ether, benzoin isobutyl ether, and benzoin isopropyl ether, benzophenone-based photo-polymerization initiators such as benzophenone, 4-hydroxybenzophenone, methyl o-benzoylbenzoate, 2-benzoylnaphthalene, 4-benzoylbiphenyl, 4-benzoyl phenyl ether, acrylated benzophenone, and 1,4-benzoylbenzene, thioxanthone-based photo-polymerization initiators such as 2-isopropylthioxanthone, 2-chlorothioxanthone, 2,4-dimethylthioxanthone, 2,4-diethylthioxanthone, and 2,4-dichlorothioxanthone, and other photo-polymerization initiators such as ethylanthraquinone, 2,4,6-trimethylbenzoyldiphenylphosphine oxide, 2,4,6-trimethylbenzoylphenylethoxyphosphine oxide, bis(2,4,6-trimethylbenzoyl)phenylphosphine oxide, bis(2,4-dimethoxybenzoyl)-2,4,4-trimethylpentylphosphine oxide, methylphenylglyoxy ester, 9,10-phenanthrene, acridine-based compounds, triazine-based compounds, and imidazole-based compounds, can be provided. Also, additives having photo-polymerization promoting effect can be employed singularly or in combination with the photo-polymerization initiator. For example, triethanolamine, methyldiethanolamine, ethyl 4-dimethylaminobenzoate, isoamyl 4-dimethylaminobenzoate, (2-dimethylamino)ethyl benzoate, and 4,4'-dimethylaminobenzophenone can be provided.

The polymerization initiators may be used singularly or in combination as a mixture. The content of the polymerization initiator is 0.5-40 parts by weight, preferably 1-20 parts by weight per 100 parts by weight of the total of contents having a radical polymerizing property.

Moreover, coating liquid used for the present invention can contain an additive such as each kind of plasticizer (for the purpose of stress relaxation or the improvement of adhesive properties), a leveling agent, and a low-molecular-weight charge transportation material having no radical reactivity according to need. For such additives, well-known additives can be used.

As the plasticizer, a plasticizer used for a general resin, such as dibutyl phthalate, dioctyl phthalate, etc. can be used and the usage of the plasticizer is equal to or less than 20% by weight, preferably equal to or less than 10% by weight of total solid content contained in coating liquid. Also, as the leveling agent, silicone oils such as dimethylsilicone oil, methylphenylsilicone oil, etc. and a polymer or oligomer that contain a perfluoroalkyl group in a side chain thereof can be used and the usage of the leveling agent is appropriately equal to or less than 3% by weight of total solid content contained in coating liquid. As the content of the additive is more than necessary, the curing may be inhibited, the additive may be precipitated on the surface, and the applied film may become clouded. Accordingly, since the damage resistance and abrasive resistance of the photoconductor may be influenced significantly, the content is necessarily controlled to a necessary minimum quantity.

The surface layer is formed by applying and curing coating liquid containing each kind of radical-polymerizable compound, etc. in the present invention.

When the radical-polymerizable monomer is in a liquid state, such coating liquid in which another component can be dissolved can be coated but coating liquid diluted with solvent according to need is coated. Herein, as the used solvent, alcohols such as methanol, ethanol, propanol, and butanol, ketones such as acetone, ethyl methyl ketone, isobutyl methyl ketone, and cyclohexanone, esters such as ethyl acetate and butyl acetate, ethers such as tetrahydrofuran, dioxane, propylether, halogenated hydrocarbons such as dichloromethane, dichloroethane, trichloroethane, and chlorobenzene, aromatic hydrocarbons such as benzene, toluene, and xylene, and cellosolves such as methylcellosolve, ethylcellosolve, and cellosolve acetate can be provided. The solvents are used singularly or in combination as a mixture. The dilution rate of the coating liquid with the solvent is arbitrary and depends on the solubility of the composition, a coating method, and objective film thickness. The coating can be carried out by means of a dip coating method, a spray coat method, a bead coat method, or a ring coat method. Also, in the case of using a binder resin except a curing-type resin, the layer can be manufactured using a similar method.

With respect to the solvent for diluting coating liquid, if much quantity of a solvent that can easily dissolve an under layer (a photoconductive layer, a charge transportation layer, and a charge generation layer) is used, a composition such as a binder resin and a low-molecular-weight charge transportation material in the under layer is mixed into the surface layer so as to inhibit the curing reaction. In addition, a condition similar to the condition of containing much quantity of a non-curing material in the coating liquid previously is made, and ununiform curing of the surface occurs. On the contrary, when a solvent that cannot dissolve an under layer is used, the adhesion of the surface layer and the under layer is reduced and crater-like recesses is created on the surface layer due to the volume shrinkage thereof at the time of curing reaction. Accordingly, the surface roughness of the photoconductor may increase and the under layer with a low elastic displacement ratio is partially exposed. As a countermeasure against the above-mentioned matter, using a mixed solvent so as to control the solubility of the under layer, reducing the content of a solvent contained in an applied surface layer dependent on a liquid composition or an application method, suppressing the mixing of an under layer component by using a polymeric charge transportation material for the under layer, providing an intermediate layer with low solubility or an intermediate layer with good adhesion property between the under layer and the surface layer, etc. can be provided.

In the present invention, preferably, after such coating liquid is coated, the coated liquid is cured applying external energy and a surface layer is formed. Then, as the used external energy, thermal energy, light energy, and radiation energy can be provided. As a method for applying the thermal energy, the coated liquid is heated from the side of a coated surface or a support using gas such as air, nitrogen, a vapor, each kind of thermal medium, infrared rays, or electromagnetic waves. The heating temperature is preferably equal to or greater than 100° C. and equal to or less than 170° C. If the temperature is less than 100° C., the reaction rate of curing is low so that the reaction does not complete perfectly. If the temperature is greater than 170° C., the reaction promotes inhomogeneously, so that significant distortion is generated in the surface layer. In order to promote the curing reaction homogeneously, a method of heating at a comparatively low temperature less than 100° C. and subsequently heating up to a temperature equal to or greater then 100° C. so as to complete the reaction is useful. For providing the light energy, an UV light source such as a high-pressure mercury-vapor lamp and a metal halide lamp, which have emission wavelength mainly in a ultraviolet region can be used but a visible light source may be selected in accordance with absorption wavelength of a radical-polymerizable content or a photo-polymerization initiator. The illuminance of irradiating light is preferably equal to or greater than 50 mW/cm$^2$ and equal to or less than 1,000 mW/cm$^2$. If the illuminance is less than 50 mW/cm$^2$, it takes a long time to complete the curing reaction. If the illuminance is greater than 1,000 mW/cm$^2$, the reaction promotes inhomogeneously, so that the irregularity of the surface layer is enhanced. For providing the radiation energy, an electron beam can be used. Among the aforementioned energies, it is useful to employ thermal or light energy because of easy control of the reaction rate and the simplicity of an apparatus.

In a surface layer used for the present invention, it is necessary to contain a bulky charge transportation structure for maintaining the electrostatic characteristics and to raise a crosslinkage density for enhancing the strength. In the curing after the application of the surface layer, as very high energy is applied externally and the reaction is promoted rapidly, the curing promotes ununiformly and the dispersion of the elastic displacement ratio $\tau e$ increases, whereby the effectiveness of the present invention may be failed. Therefore, it is preferable to use external thermal or light energy that can control the reaction rate dependent on the condition of heating, illuminance of light, or the quantity of a polymerization initiator.

With respect to a specific example of a method for obtaining a surface layer with an elastic displacement ratio $\tau e$ of 40%, for example, when an acrylate monomer having three acryloyloxy groups and a triarylamine compound having one acryloyloxy group are used for a coating liquid for surface layer, the coating liquid is prepared by adding to the acrylate compound a 3-10% by weight of polymerization initiator per the total weight of the acrylate compound and further adding a solvent. For example, when a triarylamine-based donor as a charge transportation material and polycarbonate as a binder resin are used in a charge transportation layer as an under layer of the surface layer and the surface layer is formed by means of a spray coat method, the solvent of the coating liquid is preferably tetrahydrofuran, 2-butanone, or ethyl acetate and the quantity of the solvent is 2-8 times of the total weight of the acrylate compound.

Then, for example, the prepared coating liquid is applied, by means of a spray method, on a photoconductor obtained by stacking an underlying layer, a charge generation layer, the charge transportation layer on a support such as an aluminum cylinder, etc. in order. Subsequently, the coating liquid is dried at a comparatively low temperature for a short time (25-80° C., 1-10 minute(s)) and cured by means of UV irradiation or heating.

In the case of the UV irradiation, a metal halide lamp, etc. is used. The illuminance is preferably equal to or greater than 50 mW/cm$^2$ and equal to or less than 1,000 mW/cm$^2$. For example, when the irradiation of UV light with an illuminance of 200 mW/cm$^2$ is applied, the irradiation is carried out uniformly from multiple directions for approximately 20 seconds. Then, the drum temperature is controlled such that it does not exceed 50° C. In the case of thermosetting, the heating temperature is preferably 100-170° C. For example, when a blower-type oven is used as heating means and the heating temperature is set to 150° C., the heating time is 20 minutes-3 hours. After the end of curing, heating is performed at 100-150° C. for 10-30 minutes in order to reduce a residual solvent and a photoconductor used for the present invention is obtained.

When the surface layer is a surface portion of a charge transportation layer, as described in the aforementioned method of manufacturing a surface layer, the surface layer is formed by applying coating liquid that contains a radical-polymerizable composition for the present invention onto the under layer portion of the charge transportation layer, drying the applied coating liquid according to need, and initiating a curing reaction due to external thermal or light energy. Then, the film thickness of the surface layer is 1-20 μm, preferably 2-10 μm. If the film thickness is less than 1 μm, the durability of the surface layer is variable dependent on the ununiformity of the film thickness. On the other hand, if the film thickness is greater than 20 μm, the film thickness of the whole of charge transportation layer becomes large, whereby the diffusion of charges increases and the reproducibility of an image decreases.

(Intermediate Layer)

In a photoconductor according to the present invention, when the surface layer is a surface portion of a photoconductive layer, an intermediate layer can be provided for the purpose of suppressing the mixing of an under layer component into the surface layer or improving the adhesive property with the under layer.

The intermediate layer is generally based on a binder resin. As such binder resin, polyamide, alcohol-soluble nylon, water-soluble poly(vinyl butyral), poly(vinyl butyral), poly(vinyl alcohol), etc. can be provided. As a method for forming an intermediate layer, a commonly used coating method is employed as described above. Additionally, the thickness of the intermediate layer is appropriately 0.05-2 μm.

(Electrically Conductive Support)

As the electrically conductive support, an electrically conductive support obtained by applying to a film-shaped or cylindrical plastic or paper, an electrically conductive material with a volumetric resistivity equal to or less than $10^{10}$ Ωcm, for example, a metal such as aluminum, nickel, chromium, nichrome, copper, gold, silver, and platinum, and a metal oxide such as tin oxide and indium oxide by means of vapor-depositing or sputtering, an electrically conductive plate made of aluminum, aluminum alloy, nickel, or stainless, and an electrically conductive pipe produced by applying surface treatment such as cutting, super finishing, and polishing to an unfinished pipe obtained by extruding or drawing aluminum, aluminum alloy, nickel, or stainless can be used. Furthermore, an endless nickel belt and an endless stainless belt can be used as the electrically conductive support.

In addition, an electrically conductive support obtained by applying a liquid dispersion containing electrically conductive powder in a proper binder resin on the aforementioned electrically conductive support can be also used as the electrically conductive support used for the present invention. As the electrically conductive powder, carbon black powder, acetylene black powder, metal powder such as aluminum powder, nickel powder, iron powder, nichrome powder, copper powder, zinc powder, and silver powder, and metal oxide powders such as electrically conductive tin oxide powder and ITO (indium tin oxide) powder can be provided.

As a binder material that is simultaneously used with the electrically conductive powder, thermoplastic resins, thermosetting resins, and photo-setting resins, such as poly (styrene), styrene-acrylonitrile copolymer, styrene-butadiene copolymer, styrene-maleic anhydride copolymer, polyester, poly(vinyl chloride), vinyl chloride-vinyl acetate copolymer, poly(vinyl acetate), poly(vinylidene chloride), polyallylate resin, phenoxy resin, polycarbonate, cellulose acetate resin, ethylcellulose resin, poly(vinyl butyral), poly (vinyl formal), poly(vinyltoluene), poly(N-vinylcarbazole), acrylic resin, silicone resin, epoxy resin, melamine resin, urethane resin, phenol resin, and alkyd resin can be provided. Such electrically conductive layer can be provided by applying the dispersion liquid obtained by dispersing the electrically conductive powder and the binder resin in a proper solvent such as tetrahydrofuran, dichloromethane, ethyl methyl ketone, and toluene, onto the aforementioned electrically conductive support.

Further, an electrically conductive support obtained by providing an electrically conductive layer made of a heat-shrinkable tubing that contains the aforementioned electrically conductive powder in a material such as poly(vinyl chloride), poly(propylene), polyester, poly(styrene), poly (vinylidene chloride), poly(ethylene), chlorinated rubber, and a polytetrafluoroethylene-based fluorinated resin on a proper cylindrical substrate can be used advantageously as the electrically conductive support used for the present invention.

(Photoconductive Layer)

Next, a photoconductive layer is described. The photoconductive layer may have either the laminated structure or the single layer structure.

A photoconductive layer having the laminated structure includes a charge generation layer having a charge generation function and a charge transportation layer having a charge transportation function. On the other hand, a photoconductive layer having the single layer structure is a layer having both a charge generation function and a charge transportation function.

Both the photoconductive layer having a laminated layer structure and photoconductive layer having a single-layer-structure are described below.

(Charge Generation Layer)

A charge generation layer is a layer based on a charge generation material having a charge generation function, for which a binder resin can be used in combination according to need. As the charge generation material, an inorganic charge generation material and an organic charge generation material can be provided.

As the inorganic charge generation material, crystalline selenium, amorphous selenium, selenium-tellurium, a selenium-tellurium-halogen, a selenium-arsenic compound, and amorphous silicon, etc. can be provided. Advantageously, the dangling bond of the amorphous silicon may be terminated with a hydrogen atom or a halogen atom and the amorphous silicon may be doped with a boron atom, phosphorus atom, or the like.

On the other hand, as the organic charge generation material, well-known materials can be used. For example, phthalocyanine-based pigments such as a metal phthalocyanine and a no-metal phthalocyanine, an azulenium salt pigment, a methyl squarate pigment, an azo pigment containing a carbazole skeleton, an azo pigment containing a triphenylamine skeleton, an azo pigment containing a diphenylamine skeleton, an azo pigment containing a dibenzothiophene skeleton, an azo pigment containing a fluorenone skeleton, an azo pigment containing an oxadiazole skeleton, an azo pigment containing a bis(stilbene) skeleton, an azo pigment containing an distyryloxadiazole skeleton, an azo pigment containing an distyrylcarbazole skeleton, a perylene-based pigment, a polycyclic quinone-based pigment such as an anthraquinone-based pigment, a quinoneimine-based pigment, a diphenylmethane-based pigment, a triphenylmethane-based pigement, a benzoquinone-based pigment, a naphthoquinone-based pigment, a cyanine-based pigment, an azomethyne-based pigment, an indigoid-based pigment, and a bis(benzimidazole)-based pigment can be provided. The charge generation materials can be used singularly or in combination as a mixture.

As the binder resin used for the charge generation layer according to need, polyamide, polyurethane, epoxy resin, polyketone, polycarbonate, silicone resin, acrylic resin, poly (vinyl butyral), poly(vinyl formal), poly(vinyl ketone), polystyrene, poly(N-vinylcarbazole), polyacrylamide, poly(vinylbenzal), polyester, phenoxy resin, vinyl chloride-vinyl acetate copolymer, poly(vinyl acetate), poly(phenylene oxide), poly(vinylpyridine), cellulose-based resins, casein, poly(vinyl alcohol), poly(vinylpyrrolidone), etc. can be provided. The binder resins can be used singularly or in combination as a mixture. The content of the binder resin is appropriately 0-500 parts by weight, preferably 10-300 parts by weight, per 100 parts by weight of the charge generation material. The addition of the binder resin may be before the dispersion or after the dispersion.

As a method for forming the charge generation layer, generally, a method of producing a thin film in vacuum and a method of casting from solution or liquid dispersion can be provided. As the former method, a vapor deposition method, a glow discharge decomposition method, an ion plating method, a sputtering method, a reactive sputtering method, a CVD method, etc. can be provided and a charge generation layer that contains the inorganic charge generation material or the organic charge generation material can be formed well. For forming a charge generation layer by the latter casting method, the charge generation layer can be formed by dispersing the inorganic or organic charge generation material, if necessary, with the binder resin, into a solvent such as tetrahydrofuran, dioxane, dioxoran, toluene, dichloromethane, monochlorobenzene, dichloroethane, cyclohexanone, cyclopentanone, anisole, xylene, ethyl methyl ketone, acetone, ethyl acetate, and butyl acetate, by means of ball-mill, Attrlter, sand mill, or beads mill, then diluting the obtained liquid dispersion moderately and applying the diluted dispersion. Additionally, a leveling agent such as dimethylsilicone oil and methylphenylsilicone oil can be added according to need. The application of coating liquid can be carried out by means of a dip coating method, a spray coat method, a bead coat method, a ring coat method, or the like.

The film thickness of the charge generation layer provided as described above is appropriately 0.01-5 μm, preferably 0.05-2 μm.

(Charge Transportation Layer)

A charge transportation layer is a layer having a charge transportation function and is based on a charge transportation material and a binder resin.

As the charge transportation material, hole transportation materials and electron transportation materials can be provided.

As the electron transportation material, an electron accepting material such as chloroanil, bromoanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrodibenzothiophene-5,5-dioxide, and diphenoquinone derivatives can be provided. The electron transportation materials can be used singularly or in combination as a mixture.

As the hole transportation material, poly(N-vinylcarbazole) and derivatives thereof, poly(γ-carbazolylethyl glutamate) and derivatives thereof, pyrene-formaldehyde condensates and derivatives thereof, poly(vinylpyrene), poly(vinylphenanthrene), polysilane, oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bis(stilbene) derivatives, enamine derivatives, and other well-known materials can be provided. The hole transportation materials can be used singularly or in combination as a mixture.

As the binder resin, thermoplastic resins and thermosetting resins, such as poly(styrene), styrene-acrylonitrile copolymer, styrene-butadiene copolymer, styrene-maleic anhydride copolymer, polyester, poly(vinyl chloride), vinyl chloride-vinyl acetate copolymer, poly(vinyl acetate), poly(vinylidene chloride), polyallylate resin, phenoxy resin, polycarbonate, cellulose acetate resin, ethylcellulose resin, poly(vinyl butyral), poly(vinyl formal), poly(vinyltoluene), poly(N-vinylcarbazole), acrylic resin, silicone resin, epoxy resin, melamine resin, urethane resin, phenol resin, and alkyd resin can be provided. Also, as a binder resin, polymeric charge transportation materials having a charge transportation function, for example, a polymer material such as polycarbonate, polyester, polyurethane, polyether, polysiloxane, and an acrylic resin, all of which have an arylamine skeleton, a benzidine skeleton, a hydrazone skeleton, a carbazole skeleton, a stilbene skeleton, or a pyrazoline skeleton, and a polymer material containing a polysilane skeleton, can be also used and are useful.

The content of the charge transportation material is appropriately 20-300 parts by weight, preferably 40-150 parts by weight per 100 parts by weight of the binder resin. Additionally, when the polymeric charge transportation material is used, the polymeric charge transportation materials can be used singularly or in combination with the aforementioned binder resin.

As a solvent used herein, tetrahydrofuran, dioxane, dioxoran, toluene, dichloromethane, monochlorobenzene, dichloroethane, cyclohexanone, ethyl methyl ketone, acetone can be provided. The solvents may be used singularly or in combination as a mixture.

Additionally, a plasticizer or a leveling agent can be added according to need. As the palsticizer used for the charge transportation layer, a plasticizer used for a general resin, such as dibutyl phthalate and dioctyl phthalate, can be directly used and the usage of the plasticizer is appropriately 0-30 parts by weight per 100 parts by weight of the binder resin. As the leveling agent used for the charge transportation layer, silicone oils such as dimethylsilicone oil and methylphenylsilicone oil and a polymer and an oligomer which contain a perfluoroalkyl group in side chain thereof can be provided and the usage of the leveling agent is appropriately 0-1 parts by weight per 100 parts by weight of the binder resin.

Also, when a charge transportation layer has an elastic displacement ratio τe equal to or greater than 40%, the charge transportation layer that even includes the surface of a photoconductor is included in the present invention. Further, since the surface layer has charge transportation ability, the surface layer can be formed on a charge generation layer as a charge transportation layer.

The film thickness of a charge transportation layer is preferably equal to or less than 30 μm, more preferably equal to or less than 25 μm, in view of an image resolution and a responsibility. For the lower limit of the thickness, it depends on a used system (particularly, charging electric potential) but is preferably equal to or greater than 5 μm.

(Photoconductive Layer with a Single Layer Structure)

A photoconductive layer with a single layer structure is a layer having both a charge generation function and a charge transportation function. The photoconductive layer can be formed by dissolution or dispersion of a charge generation material, a charge transportation material, and a binder resin into a proper solvent, application and drying. Also, a plasticizer, a leveling agent, and an antioxidant can be added according to need.

As the binder resin, beside the binder resin provided for the charge transportation layer, the binder resin provided for the charge generation layer may be used in combination as a mixture. Of course, the aforementioned polymeric charge transportation material can be used well. The content of the charge generation material is preferably 5-40 parts by weight per 100 parts by weight of the binder resin. Also, the content of the charge transportation material is preferably 0-190 parts by weight, more preferably 50-150 parts by weight, per 100 parts by weight of the binder resin. The photoconductive layer can be formed by applying coating liquid that is obtained by dispersing a charge generation material, a charge transportation material, and a binder resin into a solvent such as tetrahydrofuran, dioxane, dichloroethane, and cyclohexane with the use of a dispersion machine, by means of a dip coating method, a spray coat method, a bead coat method, a ring coat method, or the like. The film thickness of the photoconductive layer is appropriately 5-25 μm.

Also, when a photoconductive layer has an elastic displacement ratio τe equal to or greater than 40%, the photoconductive layer that even includes the surface of a photoconductor is included in the present invention.

(Underlying Layer)

In the photoconductor according to the present invention, an underlying layer can be provided between an electrically conductive support and a photoconductive layer. Although the underlying layer is generally based on a resin, such resin is desirably a resin having a high solvent resistance against a general organic solvent, in view of the application of coating liquid for photoconductive layer in a solvent on the underlying layer. As such a resin, water-soluble resins such as poly(vinyl alcohol), casein, and poly(sodium acrylate), alcohol-soluble resins such as copolymerized nylon and methoxymethylated nylon, and curing-type resins in which a three-dimensional network structure such as polyurethane, melamine resin, phenol resin, alkyd-melamine resin, and epoxy resin can be provided. In addition, a fine powder pigment of a metal oxide such as titanium oxide, silica, alumina, zirconium oxide, tin oxide, and indium oxide, may be added into the underlying layer for preventing the generation of a moire pattern and reducing the residual electric potential.

The underlying layer can be formed using a proper solvent and a proper coating method as used for the aforementioned photoconductive layer. Further, a silane coupling agent, a titanium coupling agent, a chromium coupling agent, etc. can be used for the underlying layer in the present invention. Beside the aforementioned underlying layer, an underlying layer made of, anodized $Al_2O_3$ obtained by anodic oxidation, an organic material such as poly(para-xylylene) (parylene), or an inorganic material such as $SiO_2$, $SnO_2$, $TiO_2$, ITO, and $CeO_2$, by using a method of producing a thin film in vacuum, and a well-known underlying layer can be used well, as the underlying layer in the present invention. The thickness of the underlying layer is appropriately 0-5 μm.

(Addition of Antioxidant into Each Layer)

In the present invention, an antioxidant can be added into each layer such as the surface layer, the photoconductive layer, the charge generation layer, the charge transportation layer, the underlying layer, and the intermediate layer, for the purpose of improving an environmental resistance and, particularly, preventing the lowering in the sensitivity and the elevation of the residual electric potential.

As an antioxidant used for the present invention, the following antioxidants can be provided.

(Phenol-based Compounds) 2,6-di-t-butyl-p-crezol, butylated hydroxyanisole, 2,6-di-t-butyl-4-ethylphenol, stearyl μ-(3,5-di-t-butyl-4-hydroxyphenyl)propionate, 2,2'-methylene-bis(4-methyl-6-t-butylphenol), 2,2'-methylene-bis(4-ethyl-6-t-butylphenol), 4,4'-thiobis(3-methyl-6-t-butylphenol), 4,4'-butylidene-bis(3-methyl-6-t-butylphenol), 1,1,3-tris(2-methyl-4-hydroxy-5-t-butylphenyl)butane, 1,3,5-trimethyl-2,4,6-tris(3,5-di-t-butyl-4-hydroxybenzyl) benzene, tetrakis[methylene-3-(3',5'-di-t-butyl-4'-hydroxyphenyl)propionate]methane, bis[3,3'-bis(4'-hydroxy-3 '-t-butylphenyl)butyric acid]glycol ester, tocopherols.

(Paraphenylenediamines)

N-phenyl-N'-isopropyl-p-phenylenediamine, N,N'-di-sec-butyl-p-phenylenediamine,N N-phenyl-N-sec-butyl-p-phenylenediamine, N,N'-di-isopropyl-p-phenylenediamine, N,N'-dimethyl-N,N'-di-t-butyl-p-phenylenediamine.

(Hydroquinones)

2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone.

(Organic Sulfur Compounds)

dilauryl-3,3'-thiodipropionate, distearyl-3,3'-thiodipropionate, ditetradecyl-3,3'-thiodipropionate.

(Organic Phosphorus Compounds)

triphenylphosphine, tri(nonylphenyl)phosphine, tri(di-nonylphenyl)phosphine, tricresylphosphine, tri(2,4-dibutylphenoxy)phosphine.

These compounds are well-known as antioxidants for a rubber, a plastic, a fat and a fatty oil and a commercially available product thereof can be easily obtained.

In the present invention, the content of the antioxidant is 0.01-10% by weight of the total weight of a layer to which the antioxidant is added.

(Protective Material Feeding Device)

It is found that when proximity discharge is used for charging, component materials of a photoconductor surface are decomposed and deterioration is caused. It is also found that the deterioration is caused by exposing the photoconductor surface to the proximity discharge and occurs even if a member contacting the photoconductor surface. That is, it is considered that the deterioration mechanism of the photoconductor surface caused by the proximity discharge is different from that of mechanical friction. Accordingly, discharge deterioration preventing means for preventing the deterioration of the photoconductor surface caused by the proximity discharge are provided in this embodiment. The specific structure thereof is described below in detail.

An image formation apparatus of this embodiment is provided with a protective material application device 30 as a protective material feeding device for feeding a protective material 32 on a photoconductor surface as illustrated in FIG. 5. The protective material application device has a fur brush 31 as an application member, a protective material 32, and a pressurizing spring 33 for applying a pressure on the fur brush via the protective material. The protective material 32 is a solid protective material that is formed into a bar-like shape. The brush tip of the fur brush 31 contacts the photoconductor surface. The protective material 32 is once applied on the brush by rotating the brush around the axis thereof and carried to the contact position with the photoconductor surface while the protective material is held on the brush. Then, the protective material is applied on the photoconductor surface.

Also, even if the protective material 32 is scraped with and ground by the fur brush 31 and decrease, the protective material 32 is applied on the fur brush 31 with a predetermined pressure by using a pressurizing spring 33, in order to maintain the contact of the protective material 32 with the fur brush 31. Thereby, even if the quantity of the protective material 32 is small, the protective material is constantly applied on the fur brush 31.

Additionally, although a method for internally or externally adding the protective material 32 to toner so as to transfer the protective material onto the photoconductor surface is also considered, in this case, the quantity of the protective material 32 present on the photoconductor surface is changed dependent on image density or an image pattern and, thereby, the adjustment of the application quantity of the protective material is difficult. Accordingly, the effect of the present invention may not be exerted or a side effect of an image defect may be caused by excessive application. In this embodiment, since the protective material 32 is directly applied on the photoconductive surface, the quantity of the protective material on the photoconductor surface is not changed dependent on various conditions such as the image density or the image pattern and the protective material can be distributed on the photoconductor surface stably. Herein, this embodiment is merely one example. If the protective material is present on the photoconductor surface at a proper condition, the means for transferring the protective material onto the photoconductor surface is not limited to application means and any method can be employed.

The influence of the chemical deterioration of the photoconductor surface caused by the proximity discharge significantly increases, particularly when a voltage containing an alternating current component is applied to a charging member. However, when a necessary quantity of protective material is applied on and adheres to the photoconductor surface, the influence caused by the proximity discharge can be avoided. With respect to contact charging, when the protective material is applied on the photoconductor surface, the protective material adheres to the charging member as described above and the charging member is contaminated, whereby ununiformity of charging may be caused. Therefore, although it is preferable that the charging member does not contact the photoconductor in an image formation area, the stability of charging lowers and the ununiformity of charging is easily caused even if the charging member does not contact the photoconductor. However, the ununiformity of charging can be suppressed by applying a voltage containing an alternating current component to the charging member. Thus, in the present application, it is particularly preferable to apply a protective material on a photoconductor surface, to use a charging member that does not contact the photoconductor in an image formation area, and to apply a voltage containing an alternating current component to the charging member, for attaining both the long life of the photoconductor and the stabilization of an image.

The influence to a photoconductor in the case of applying a voltage with a superposed alternating current component to a charging member is described below. The reductions of the film thickness of a photoconductor were compared in the case of changing a peak-to-peak voltage value Vpp of an alternating voltage that is initially applied to a charging roller, to 2.2 [kV], 2,6 [kV], or 3.3 [kV], fixing a frequency f of the alternating voltage to be 1,350 [Hz], fixing a DC voltage to be −600 [V], and setting the movement speed v of a photoconductor surface to be 113 [mm/s]. The results are plotted in FIG. 10.

Figure 10:
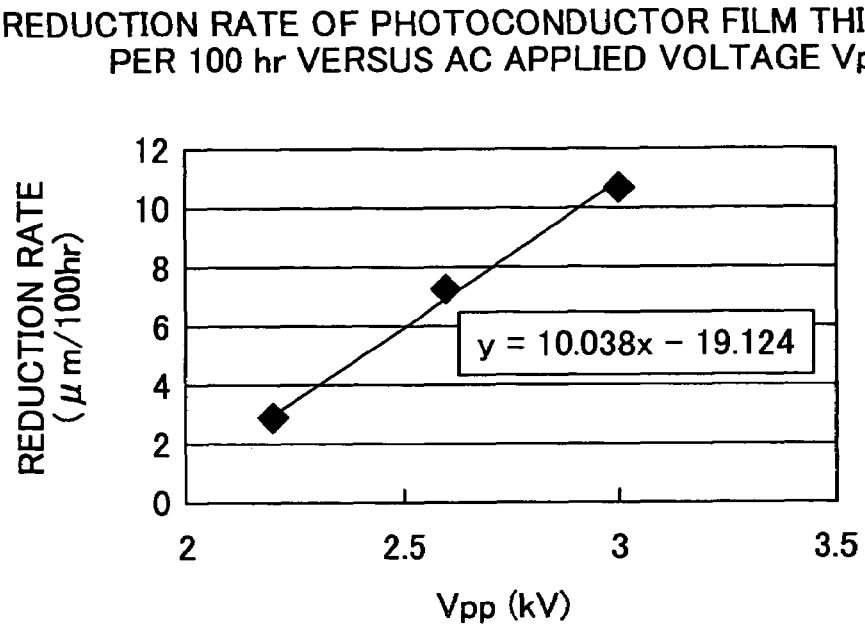
FIG. 10 is a graph showing a relationship of an applied AC voltage Vpp and a reduction rate of photoconductor film thickness per 100 hr.

From FIG. 10, it is found that the film thickness of the photoconductor linearly decreases with the increase of Vpp. Herein, it is noted that the reduction of the film thickness is 0 when Vpp is approximately 1.9 [kV]. The inventors consider this fact as follows.

It is known that when an alternating voltage is applied, discharge is not initiated between a charging member surface and a photoconductor surface unless a voltage applied to a charging member is equal to or greater than a predetermined value. Accordingly, in the case of non-contact charging, it is considered that as a voltage applied to a charging member is equal to or greater than a value shown below, discharge is initiated between a charging member surface and a photoconductor surface wherein a proximal distance between the charging member surface and the photoconductor surface is denoted by Gp [μm]. This value is referred to as a discharge initiation voltage Vth below.

$$Vth=312+6.2\times(d/\epsilon opc+Gp/\epsilon air)+\sqrt{(7737.6\times d/\epsilon)} \quad [V]$$

d [μm]: film thickness of photoconductor

ϵopc: relative dielectric constant of photoconductor

ϵair: relative dielectric constant of space between photoconductor and charging member Also, when Vpp is equal to or greater than 2 times of Vth, discharge is caused bidirectionally between the charging member and the photoconductor. Vth=962 [V] if a gap between a charging roller and a photoconductor is 50 μm, a relative dielectric constant of the photoconductor is approximately 3, the film thickness of the photoconductor is approximately 30 μm, and a relative dielectric constant of a space between the photoconductor and a charging member is approximately 3. Accordingly, it is considered that when a voltage applied to the charging member is equal to or greater than 962 [V], discharge is initiated between a charging member surface and a photoconductor surface. Also, it is considered that when Vpp is greater than approximately 1,924 [V], discharge caused by an alternating voltage is initiated. Since bidirectional discharge caused by an alternating voltage is dominant as a discharge phenomenon, it is considered that when Vpp is greater than approximately 1.9 [kV], the reduction of the film thickness of the photoconductor is caused significantly.

Next, the reductions of the film thickness of a photoconductor surface were compared in the case of changing a frequency f of an alternating voltage applied to a charging roller, to 500 [Hz], 900 [Hz], 1,400 [Hz], 2,000 [Hz] or 4,000 [Hz], fixing a peak-to-peak voltage value Vpp of an alternating voltage to be 2.2 [kV], fixing a DC voltage to be −600 [V], and setting the movement speed v of the photoconductor surface to be 104 [mm/s].

Figure 11:
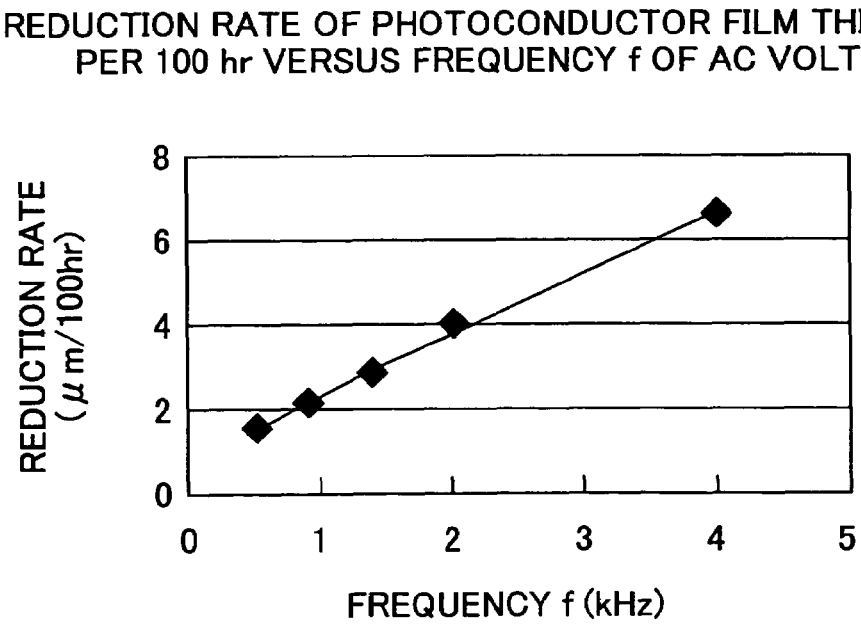
FIG. 11 is a graph showing a relationship of a frequency of AC voltage f and a reduction rate of photoconductor film thickness per 100 hr.

The results are plotted in FIG. 11. From FIG. 11, it is obviously found that the reduction of the film thickness of the photoconductor linearly increases with the increase of frequency f. Therefore, it is found that the reduction of the film thickness depends on the charging conditions, specifically, Vpp or f.

Also, it is expected that the reduction of the film thickness is proportional to Vpp−2×Vth or f and discharge energy applied on a unit area of the photoconductor surface is large when the movement speed of the photoconductor is slow even on the same charging conditions. Therefore, we considered that the reduction of the film thickness is inversely proportional to the movement speed v of the photoconductor surface. Accordingly, in order to obtain the quantity of a protective material necessary for preventing the deterioration of the photoconductor surface caused by discharge, the deterioration of the photoconductor surface was investigated while Vpp, f, or the quantity of an adhering protective material is changed. The result is shown in Table. 1

TABLE 1

| X(*) | Speed of photoconductor surface [mm/s] | Vpp [V] | f [Hz] | Rate of element from zinc stearate [%] | State of photoconductor surface 1. presence or absence of white turbidity (visually observation) 2. reduction of film thickness (μm/100 h) |
|---|---|---|---|---|---|
| 1544 | 125 | 2120 | 877.2 | 0.36 | 1. Absence 2. 0.00 |
| 1544 | 125 | 2120 | 877.2 | 0.29 | 1. Absence 2. 0.16 |
| 1544 | 125 | 2120 | 877.2 | 0.21 | 1. Presence 2. 0.52 |
| 1544 | 125 | 2120 | 877.2 | 0 | 1. Presence 2. 1.30 |
| 8027 | 185 | 3000 | 1350 | 0 | 1. Presence 2. 6.74 |
| 8027 | 185 | 3000 | 1350 | 0.24 | 1. Presence 2. 5.83 |
| 8027 | 185 | 3000 | 1350 | 0.60 | 1. Presence 2. 4.47 |
| 8027 | 185 | 3000 | 1350 | 1.19 | 1. Presence 2. 2.23 |
| 8027 | 185 | 3000 | 1350 | 1.25 | 1. Absence 2. 2.01 |
| 8027 | 185 | 3000 | 1350 | 1.70 | 1. Absence 2. 0.30 |
| 8027 | 185 | 3000 | 1350 | 1.87 | 1. Absence 2. 0.00 |
| 8027 | 185 | 3000 | 1350 | 2.40 | 1. Absence 2. 0.00 |

(*)X = {Vpp − 2 × Vth} × f/v

From the result, the quantification was made with respect to the quantity of the adhering protective material. Although it is difficult to measure the quantity of the protective material that is present on the photoconductor surface in sight amounts, the inventors made the quantification of the protective material necessary for the photoconductive surface by detecting a characteristic element in the protective material. Herein, since zinc stearate was employed as a protective material, the rate of Zn [%] from zinc stearate was measured using a scanning X-ray photoelectron spectrometer, PHI Quantum 2000 produced by ULVAC-PHI, Inc. on the conditions of a X-ray source of AlKα and an analysis area with 100 μmϕ.

In the photoconductor 1 used in this embodiment, since zinc is not present in the surface layer (charge transportation layer), all the detected Zn originates from zinc stearate as a protective material. From the viewpoint, it is considered that Zn is a characteristic element for indicating the quantity of the protective material. If a protective material except zinc stearate is used and a characteristic element that is not present in a photoconductor is contained in the protective material, the quantity of an adhering protective material can be quantified. The measurement value (rate of element) for Zn was a measurement value for the photoconductor surface obtained by applying zinc stearate continuously for 5 hours without the application of voltage to the charging member.

Meanwhile, since the molecular formula of zinc stearate is $[CH_3(CH_2)_{16}COO]$ Zn, 36 C, 4 O, and 70 H are present per 1 Zn. Since H is not detected by XPS among these elements, the rate of elements detected by XPS in zinc stearate is 41 times of the rate of Zn element.

Figure 12:
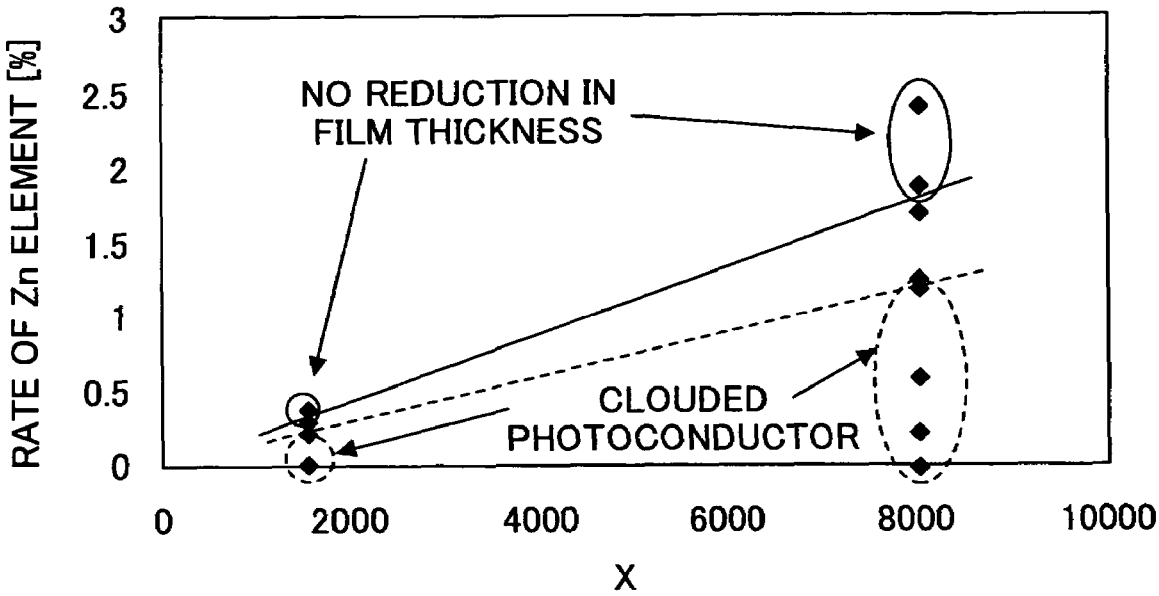
FIG. 12 is a graph showing a relationship of X, i.e. $\{(Vpp-2\times Vth)\times f/v\}$ and a rate of Zn element.

From the result shown in Table. 1, the relation of X and the rate of Zn element was plotted. The result is shown in FIG. 12.

As a straight line indicating a threshold for the presence and absence of white turbidity indicating the deterioration is derived, it is found that the quantity of zinc stearate necessary for preventing the deterioration (white turbidity) of the photoconductor surface caused by the discharge is equal to or greater than $$1.52\times10^{-4}\times\{Vpp-2\times Vth\}\times f/v[\%]$$

Vpp [V]: peak-to-peak value of alternating voltage applied to charging member f [Hz]: frequency of alternating voltage applied to charging member v [mm/s]: movement speed of photoconductor surface in the standard of the rate of Zn element.

Further, as a straight line indicating threshold for the reduction of the film thickness is derived, it is found that the quantity of zinc stearate necessary for preventing the reduction of the film thickness of the photoconductor surface caused by the discharge is equal to or greater than $$2.22\times10^{-4}\times\{Vpp-2\times Vth\}\times f/v[\%]$$

in the standard of the rate of Zn element.

As the rate of all the elements detected by XPS of the protective material is calculated base on the obtained rate of contained Zn element, it is considered that when the rate of elements is equal to or greater than $$6.23\times10^{-3}\times\{Vpp-2\times Vth\}\times f/v[\%]$$

the deterioration (white turbidity) of the photoconductor can be prevented and when the rate of elements is equal to or greater than $$9.10\times10^{-3}\times\{Vpp-2\times Vth\}\times f/v[\%]$$

the reduction of the film thickness is hardly generated. Thus, the quantification for the protective material necessary for suppressing the deterioration of the photoconductor could be attained.

The reason for suppressing the chemical deterioration of a photoconductor surface caused by proximity discharge, by applying a protective material such as zinc state, is considered as follows. When charging is carried out by the proximity discharge, energies of particles (for example, electron, an excited molecule, an ion, plasma, etc.) generated by the discharge are applied on a photoconductive surface layer near a discharge area over the photoconductor surface. The energy resonates a bonding energy of a molecule of a material composing the photoconductor surface and is absorbed. As the result, it is considered that the decrease of a molecular weight by cutting a chain of a resin molecule, the decrease of the entanglement of the chains of the polymer molecules, etc. occur in a surface layer and the chemical deterioration promotes the reduction of the film thickness of the photoconductor.

On the other hand, as a protective material is present on a photoconductor surface, the energies of particles generated by discharge are directly applied on the protective material. Thereby, it is considered that the protective material itself absorbs the energies of particles generated by discharge and the photoconductor itself can be free from the direct application of the particles generated by discharge, whereby the chemical deterioration is reduced. A result of indicating that a molecular chain of a resin composing the photoconductor has been cut or decomposed, was obtained by using a surface analysis with respect to the photoconductor surface area B with no protective material, of the photoconductor 1 as shown in FIG. 3. On the other hand, no result of analysis that indicates the cutting or decomposition of a molecular chain of a resin was obtained with respect to the photoconductor surface area A with a protective material. Consequently, it was demonstrated that the chemical deterioration of the photoconductor surface could be avoided by the use of the protective material. Then, it was also demonstrated from the result of analysis that zinc stearate fed as the protective material was chemically altered or decomposed on the surface area A with the protective material.

Thus, various kinds of materials can be employed as the protective material 32. Although zinc searate is used as the protective material 32 in the image formation apparatus of this embodiment, zinc searate is merely one example of the protective material 32. Any of protective material such as various kinds of salts of fatty acids, waxes, silicone oils, etc. can be used as the protective material 32 if the material can be uniformly applied on the photoconductor surface.

Among these, as a protective material, it is preferable to use lamellar crystal powder such as zinc stearate. A lamellar crystal has a layered structure in which amphipatic molecules are self-organized. If a shearing force is applied to the lamellar crystal, the crystal is easily broken or slipped along the longitudinal direction of a layer thereof. The function is useful for lowering a friction coefficient. Also, if a lamellar crystal is subjected to a shearing force, a photoconductor surface can be uniformly covered with the crystal. From the viewpoint of the protection of a photoconductor surface from discharge, the photoconductor surface can be covered with a small amount of a protective material effectively, due to such a characteristic of the lamellar crystal. Therefore, the lamellar crystal is much preferable as the protective material for the present invention. Also, among the salts of fatty acids, since a metal element is often a characteristic element measured by XPS, metal salts of fatty acids has merits such that measurement conditions of XPS such as application quantity thereof can be easily set. As a fatty acid, undecylic acid, lauric acid, tridecylic acid, myristic acid, palmitic acid, pentadecylic acid, stearic acid, heptadecylic acid, arachic acid, montanic acid, oleic acid, arachidonic acid, caprylic acid, capric acid, caproic acid, etc. can be provided. As a metal salt thereof, a salt of the fatty acid with a metal such as zinc, iron, copper, magnesium, aluminum, and calcium can be provided.

For protecting a photoconductor surface from discharge using the property of a lamellar crystal sufficiently, a protective material applying device 30 has a linear velocity difference with the photoconductor surface, which is particularly effective. Then, the protective material can be uniformly applied by subjecting the protective material to a shearing force. As the present invention, for the purpose of protecting a photoconductor surface from the deterioration caused by discharge, the protective material applying device 30 is desirably provided between a cleaning device and a charging device. Thereby, the elimination of the protective material by the cleaning device before the arrival of the material at the discharge area can be avoided.

In addition, an image formation apparatus of this embodiment has a temperature and humidity detector for detecting environmental conditions around the charging roller. Further, the image formation apparatus of this embodiment has a controller not shown in the figures, which includes the first table for relating the rotational speed of the fur brush to the quantity of the protective material fed onto the photoconductor surface, the second table for relating the environmental conditions around the charging roller detected by the temperature and humidity detector to a charging condition, an application control part for controlling the rotational speed of the fur brush, a charging control part for controlling the charging conditions, and a computer for calculating a necessary quantity of the protective material according to the charging conditions.

More specifically, the first table is a table for relating the rotational speed of the fur brush to the rate of Zn element measured by XPS. The second table is a table for relating the values of temperature and humidity to a Vpp value necessary for discharge in order to generate the discharge caused by an AC voltage certainly even if a discharge initiation voltage changes dependent on the change of the environment around the charging roller.

Furthermore, for calculating a necessary quantity of the protective material according to charging conditions, the computer calculates a necessary rate of Zn element of zinc stearate from the charging conditions according to the formula: $1.52\times10^{-4}\times\{Vpp-2\times Vth\}\times f/v$ [%] or $2.22\times10^{-4}\times\{Vpp-2\times Vth\}\times f/v$ [%].

In such configuration, the image formation apparatus of this embodiment detects the temperature and the humidity (environmental conditions) using the temperature and humidity detector when an instruction of starting image formation is inputted, gets a charging condition (Vpp value) using the second table from the detected temperature and humidity, calculates a necessary rate of Zn element based on the charging condition using the computer, and gets the rotational speed of the fur rush based on calculated rate of Zn element using the first table. According to the obtained charging condition (Vpp value), the application control part rotates the fur brush with the optimum rotational speed and the charging control part controls a voltage applied to a charging member and initiates charging.

Due to such controls, even if the charging condition varies according to the environment, the protective material can be fed optimally onto the photoconductive surface so as to prevent the deterioration of the photoconductor.

Additionally, when a necessary rate of Zn element of zinc stearate is calculated according to the formula: $1.52\times10^{-4}\times\{Vpp-2\times Vth\}\times f/v$ [%], it is necessary to calculate Vth taking the reduction of the film thickness of the photoconductor into consideration. Therefore, the controller has further storage means of storing a cumulative discharge time and the third table for deriving the film thickness of a photoconductor from the cumulative discharge time, and derives the film thickness of the photoconductor corresponding to the cumulative discharge time using the third table, so as to calculates Vth.

Next, the present invention is explained with examples in more detail but the present invention is not limited to the following examples. First, a synthesis example of a photoconductor material used for the present invention is described.

(Synthesis Example of One-functional Compound Having Charge Transporting Structure)

For example, a one-functional compound having a charge transporting structure used for the present invention can be synthesized by a method disclosed in Japanese Patent No. 3164426, one example of which is described below.

(1) The Synthesis of a Hydroxyl-group-substituted Triarylamine Compound (Represented by the Following Structural Formula B)

A 240 ml of sulfolane was added into a 113.85 g (0.3 mol) of a methoxy-group-substituted triarylamine compound (represented by the following structural formula A) and a 138 g (0.92 mol) of sodium iodide and the mixture was heated to 60° C. in nitrogen stream. A 99 g (0.91 mol) of chlorotrimethylsilane was dropped into the liquid for 1 hour and stirring for 4 and half hours was performed at the temperature of approximately 60° C. so as to complete the reaction. An approximately 1.5 L of toluene was added into the reaction liquid, which was cooled to the room temperature and washed with water or an aqueous solution of sodium carbonate repeatedly. Then, solvent was removed from the toluene solution and the purification by a column chromatographic treatment (adhesion medium; silica gel, developing solvent; toluene:ethyl acetate=20:1) was carried out. Cyclohexane was added into an obtained pale-yellow oil so as to precipitate a crystal. Thus, an 88.1 g (yield=80.4%) of white crystal represented by the following structural formula B was obtained.

Melting point: 64.0° C.-66.0° C.

TABLE 2

| Results of elemental analysis (%) | | | |
|---|---|---|---|
| | C | H | N |
| Found value | 85.06 | 6.41 | 3.73 |
| Calculated value | 85.44 | 6.34 | 3.83 |

Structural formula A

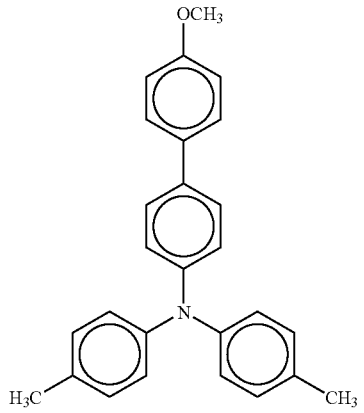

-continued

Structural formula B

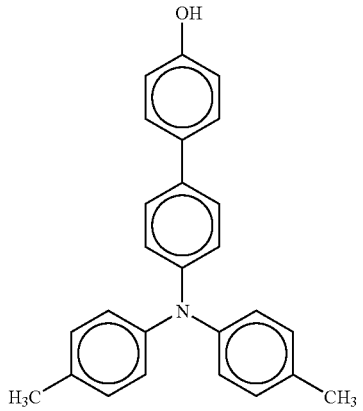

(2) Triarylamino-group-substituted Acrylate Compound (Illustrated Compound No. 54)

An 82.9 g (0.227 mol) of the hydroxyl-group-substituted triarylamine compound (structural formula B) obtained in (1) above was dissolved in a 400 ml of tetrahydrofuran and an aqueous solution of sodium hydroxide (NaOH: 12.4 g, water: 100 ml) was dropped into the terahydrofuran solution in nitrogen stream. The obtained solution was cooled to 5° C. and a 25.2 g (0.272 mol) of acryloyl chloride was dropped into the solution for 40 minutes. Then, stirring for 3 hours was performed at 5° C. to complete the reaction. Water was poured into the reaction liquid and extraction with toluene was performed. The extracted liquid was washed with an aqueous solution of sodium bicarbonate or water repeatedly. Then, solvent was removed from the toluene solution and the purification by a column chromatographic treatment (adhesion medium; silica gel, developing solvent; toluene) was carried out. n-hexane was added into an obtained colorless oil so as to precipitate a crystal. Thus, an 80.73 g (yield=84.8%) of a white crystal of illustrated compound No. 54 was obtained.

Melting point: 117.5° C.-119.0° C.

TABLE 3

| | Results of elemental analysis (%) | | |
|---|---|---|---|
| | C | H | N |
| Found value | 83.13 | 6.01 | 3.16 |
| Calculated value | 83.02 | 6.00 | 3.33 |

PHOTOCONDUCTOR MANUFACTURE EXAMPLE 1

Coating liquid for underlying layer, coating liquid for charge generation layer, and coating liquid for charge transportation layer, which had the following compositions, were applied on an aluminum cylinder with ϕ 30 mm in order and dried so as to form an underlying layer with 3.5 μm, a charge generation layer with 0.2 μm, and a charge transportation layer with 23 μm. Then, coating liquid for surface layer that had the following composition was spray-coated on the charge transportation layer and light irradiation was performed buy using a metal halide lamp 160 W/cm under the conditions of an irradiation distance of 120 mm, an illuminance of 200 mW/cm$^2$, and an irradiation time of 20 seconds. Further, the drying was performed at 130° C. for 20 minutes so as to form a surface layer with 4 μm. Thus, an electrophotographic photoconductor 1 was manufactured.

[Coating Liquid for Underlying Layer]

Alkyd resin: 6 parts (Beckosol 1307-60-EL produced by DAINIPPON INK AND CHEMICALS, INCORPORATED)

* Melamine resin: 4 parts (Superbeckamine G-821-60 produced by DAINIPPON INK AND CHEMICALS, INCORPORATED)

* Titanium oxide: 40 parts

* Ethyl methyl ketone: 50 parts

[Coating Liquid for Charge Generation Layer]

* Bisazo pigment having the following structure (I): 2.5 parts

Structural formula (I)

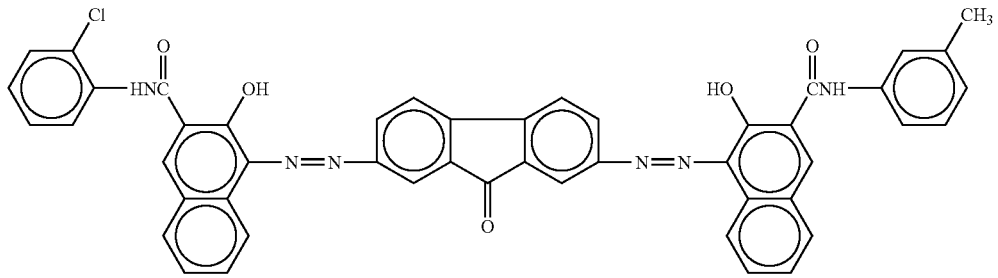

Polyvinyl butyral: 0.5 parts (XYHL produced by UCC)

* Cyclohexanone: 200 parts

* Ethyl methyl ketone: 80 parts

[Coating Liquid for Charge Transportation Layer]

* Bisphenol Z polycarbonate: 10 parts (Panlite TS-2050 produced by TEIJIN CHEMICALS LTD.)

* Low-molecular-weight charge transportation material (D-1) having the following structure (II): 7 parts Structural formula (II)

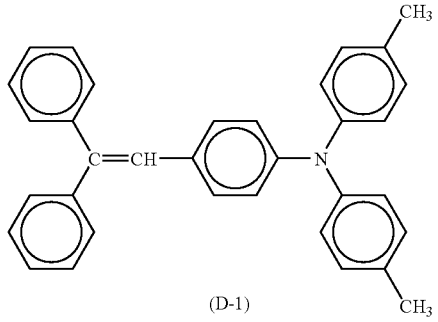

(D-1)

* Tetrahydrofuran: 100 parts
* Tetrahydrofuran solution with 1% of silicone oil: 1 part
(KF50-100CS produced by Shin-Etsu Chemical Co., Ltd.)
[Coating Liquid for Surface Layer]
* Three or more-functional radical-polymerizable monomer having no charge transporting structure
Trimethylolpropane triacrylate: 10 parts
(KAYARAD TMPTA produced by NIPPON KAYAKU CO., LTD.)
Molecular weight: 296
Number of functional groups: 3 functionalities
Molecular weight/umber of functional groups=99
* One-functional radical-polymerizable compound having a charge transporting structure: 10 parts
(Illustrated compound No. 54)
* Photo-polymerization initiator: 1 parts
1-hydroxy-cyclohexyl phenyl ketone
(Irgacure 184 produced by Ciba Specialty Chemicals)
* Tetrahydrofuran: 100 parts

PHOTOCONDUCTOR MANUFACTURE EXAMPLE 2

An electrophotographic photoconductor 2 was manufactured similar to photoconductor manufacture example 1 except that the three or more-functional radical-polymerizable monomer having no charge transporting structure contained in the coating liquid for surface layer in photoconductor manufacture example 1 was changed to the following monomer.
* Three or more-functional radical-polymerizable monomer having no charge transporting structure: 10 parts
Dimethylolpropane tetraacrylate
(SR-355, produced by Kayaku Sartomer Co., Ltd.)
Molecular weight: 466
Number of functional groups: 4 functionalities
Molecular weight/umber of functional groups=117

PHOTOCONDUCTOR MANUFACTURE EXAMPLE 3

An electrophotographic photoconductor 3 was manufactured similar to photoconductor manufacture example 1 except that the three or more-functional radical-polymerizable monomer having no charge transporting structure and the photo-polymrization initiator which were contained in the coating liquid for surface layer in photoconductor manufacture example 1 were changed to the following mixture of two kinds of monomers and the following compound, respectively.
* Three or more-functional radical-polymerizable monomer having no charge transporting structure: 6 parts
Penta-erythritol tetraacrylate
(SR-295, produced by Kayaku Sartomer Co., Ltd.)
Molecular weight: 352
Number of functional groups: 4 functionalities
Molecular weight/umber of functional groups=88
* Three or more-functional radical-polymerizable monomer having no charge transporting structure: 4 parts
Alkyl-modified di-penta-erythritol triacrylate
(KAYARAD D-330 produced by NIPPON KAYAKU CO., LTD.)
Molecular weight: 584
Number of functional groups: 3 functionalities
Molecular weight/umber of functional groups=195
* Photo-polymrization initiator: 1 part
2,2-dimethoxy-1,2-diphenylethane-1-one
(Irgacure 651 produced by Ciba Specialty Chemicals)

PHOTOCONDUCTOR MANUFACTURE EXAMPLE 4

An electrophotographic photoconductor 4 was manufactured similar to photoconductor manufacture example 1 except that the three or more-functional radical-polymerizable monomer having no charge transporting structure contained in the coating liquid for surface layer in photoconductor manufacture example 1 was changed to the following mixture of two kinds of monomers.
* Three or more-functional radical-polymerizable monomer having no charge transporting structure: 6 parts
di-penta-erythritol hexaacrylate
(KAYARAD DPHA produced by NIPPON KAYAKU CO., LTD.)
Molecular weight: 536
Number of functional groups: 5.5 functionalities
Molecular weight/umber of functional groups=97
* Three or more-functional radical-polymerizable monomer having no charge transporting structure: 4 parts
Alkyl-modified di-penta-erythritol triacrylate
(KAYARAD D-330 produced by NIPPON KAYAKU CO., LTD.)
Molecular weight: 584
Number of functional groups: 3 functionalities
Molecular weight/umber of functional groups=195

PHOTOCONDUCTOR MANUFACTURE EXAMPLE 5

An electrophotographic photoconductor 5 was manufactured similar to photoconductor manufacture example 1 except that the three or more-functional radical-polymerizable monomer having no charge transporting structure contained in the coating liquid for surface layer in photoconductor manufacture example 1 was changed to the following monomer.
* Three or more-functional radical-polymerizable monomer having no charge transporting structure: 10 parts
Caprolactone-modified di-penta-erythritol hexaacrylate
(KAYARAD DPCA-60 produced by NIPPON KAYAKU CO., LTD.)
Molecular weight: 1263
Number of functional groups: 6 functionalities
Molecular weight/umber of functional groups=211

PHOTOCONDUCTOR MANUFACTURE EXAMPLE 6

An electrophotographic photoconductor 6 was manufactured similar to photoconductor manufacture example 1 except that the three or more-functional radical-polymerizable monomer having no charge transporting structure contained in the coating liquid for surface layer in photoconductor manufacture example 1 was changed to the following monomer.

* Three or more-functional radical-polymerizable monomer having no charge transporting structure: 10 parts Caprolactone-modified di-penta-erythritol hexaacrylate (KAYARAD DPCA-120 produced by NIPPON KAYAKU CO., LTD.)

Molecular weight: 1947

Number of functional groups: 6 functionalities

Molecular weight/umber of functional groups=325

PHOTOCONDUCTOR MANUFACTURE EXAMPLE 7

An electrophotographic photoconductor 7 was manufactured similar to photoconductor manufacture example 1 except that the one-functional radical-polymerizable monomer having a charge transporting structure contained in the coating liquid for surface layer in photoconductor manufacture example 1 was changed to 10 parts of illustrated compound No. 127.

PHOTOCONDUCTOR MANUFACTURE EXAMPLE 8

An electrophotographic photoconductor 8 was manufactured similar to photoconductor manufacture example 1 except that the one-functional radical-polymerizable monomer having a charge transporting structure and the photopolymrization initiator which were contained in the coating liquid for surface layer in photoconductor manufacture example 1 were changed to 10 parts of illustrated compound No. 94 and the following thermal polymerization initiator, respectively, and after applying such a coating liquid for surface layer on the charge transportation layer, heating at 70° C. for 30 minutes by using a blower-type oven and further heating at 150° C. for 1 hour were performed so as to form a surface layer.

Thermal polymerization initiator 2,2-bis(4,4-di-t-butylperoxycyclohexyl)propane (Perkadox 12-EB20 produced by Kayaku Akzo corporation)

PHOTOCONDUCTOR MANUFACTURE EXAMPLE 9

An electrophotographic photoconductor 9 was manufactured similar to photoconductor manufacture example 1 except that the film thickness of the charge transportation layer in photoconductor manufacture example 1 was changed to 12 μm and the surface layer is changed to a surface layer with 10 μm formed from coating liquid for surface layer with the following composition by means of spray-coating and a light irradiation time of 40 seconds.

[Coating Liquid for Surface Layer]

* Three or more-functional radical-polymerizable monomer having no charge transporting structure: 6 parts Caprolactone-modified di-penta-erythritol hexaacrylate (KAYARAD DPCA-60 produced by NIPPON KAYAKU CO., LTD.)

Molecular weight: 1263

Number of functional groups: 6 functionalities

Molecular weight/umber of functional groups=211

* Three or more-functional radical-polymerizable monomer having no charge transporting structure: 4 parts Penta-erythritol tetraacrylate (SR-295, produced by Kayaku Sartomer Co., Ltd.)

Molecular weight: 352

Number of functional groups: 4 functionalities

Molecular weight/umber of functional groups=88

One-functional radical-polymerizable monomer having a charge transporting structure: 10 parts (Illustrated compound No. 54)

* Photo-polymerization initiator: 2 parts 1-hydroxy-cyclohexyl phenyl ketone (Irgacure 184 produced by Ciba Specialty Chemicals)

* Tetrahydrofuran: 60 parts

* Cyclohexanone: 20 parts

PHOTOCONDUCTOR MANUFACTURE EXAMPLE 10

An electrophotographic photoconductor 10 was manufactured similar to photoconductor manufacture example 1 except that the three or more-functional radical-polymerizable monomer having no charge transporting structure contained in the coating liquid for surface layer in photoconductor manufacture example 1 was changed to 10 parts of two functional radical-polymerizable monomer having no charge transporting structure represented by the following formula.

* Two-functional radical-polymerizable monomer having no charge transporting structure: 10 parts 1,6-hexanediol diacrylate (produced by Wako Pure Chemical Industries, Ltd.)

Molecular weight: 226

Number of functional groups: 2 functionalities

Molecular weight/umber of functional groups=113

PHOTOCONDUCTOR MANUFACTURE EXAMPLE 11

An electrophotographic photoconductor 11 was manufactured similar to photoconductor manufacture example 1 except that the following reactive silicone oil was further added into the coating liquid for surface layer in photoconductor manufacture example 1.

* Reactive silicone: 0.2 parts (Polyester-modified acryl group, BYK-UV357, produced by BYK-Chemie)

PHOTOCONDUCTOR MANUFACTURE EXAMPLE 12

An electrophotographic photoconductor 12 was manufactured similar to photoconductor manufacture example 1 except that the following reactive silicone oil was further added into the coating liquid for surface layer in photoconductor manufacture example 1.

* Reactive silicone: 0.2 parts (Both terminals: methacryl, X-22-164C produced by Shin-Etsu Silicones)

PHOTOCONDUCTOR MANUFACTURE EXAMPLE 13

An electrophotographic photoconductor 13 was manufactured similar to photoconductor manufacture example 1 except that the following reactive silicone oil was further added into the coating liquid for surface layer in photoconductor manufacture example 1.

* Methylphenylsilicone: 0.2 parts
(KF-50 produced by Shin-Etsu Silicones)

PHOTOCONDUCTOR MANUFACTURE EXAMPLE 14

An electrophotographic photoconductor 14 was manufactured similar to photoconductor manufacture example 1 except that the following fluorinated-resin fine particles were further added into the coating liquid for surface layer in photoconductor manufacture example 1.

* Polytetrafluoroethylene fine particles: 4 parts
(Lubron L-2 produced by DAIKIN Industries, Ltd.)

PHOTOCONDUCTOR MANUFACTURE EXAMPLE 15

An electrophotographic photoconductor 15 was manufactured similar to photoconductor manufacture example 1 except that the surface layer in photoconductor manufacture example 1 was not formed and, instead, a filler-containing surface layer was formed from coating liquid having the following composition.

[Coating Liquid for Filler-containing Surface Layer]

* α-alumina filler: 4 parts
(Sumicorundum AA-03 produced by SUMITOMO CHEMICAL CO., LTD.)

* Polymer solution of unsaturated polycarboxilic acid: 0.06 parts
(BYK-P104, 50% nonvolatile content, produced by BYK-Chemie)

* Bisphenol Z polycarbonate: 10 parts
(Panlite TS-2050 produced by TEIJIN CHEMICALS LTD.)

* Charge transportation material represented by the following formula: 7 parts

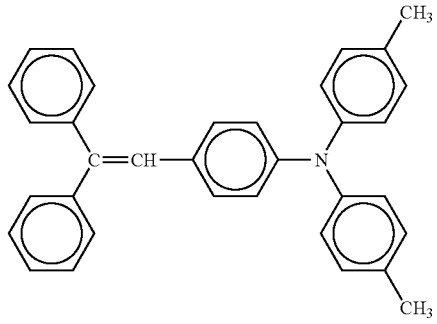

* Tetrahydrofuran: 500 parts

* Cyclohexanone: 150 parts

PHOTOCONDUCTOR MANUFACTURE EXAMPLE 16

An electrophotographic photoconductor 16 was manufactured similar to photoconductor manufacture example 15 except that the content of the filler was changed to as described below.

* α-alumina filler: 11 parts
(Sumicorundum AA-03 produced by SUMITOMO CHEMICAL CO., LTD.)

PHOTOCONDUCTOR MANUFACTURE EXAMPLE 17

An electrophotographic photoconductor 17 was manufactured similar to photoconductor manufacture example 1 except that the surface layer in photoconductor manufacture example 1 was not formed and, instead, a surface layer based on a polymeric charge transportation material (PD-1) described below was formed from coating liquid having the following composition.

[Coating Liquid for Filler-containing Surface Layer]

* Polymeric charge transportation material (PD-1) represented by the following structural formula: 15 parts (PD-1)

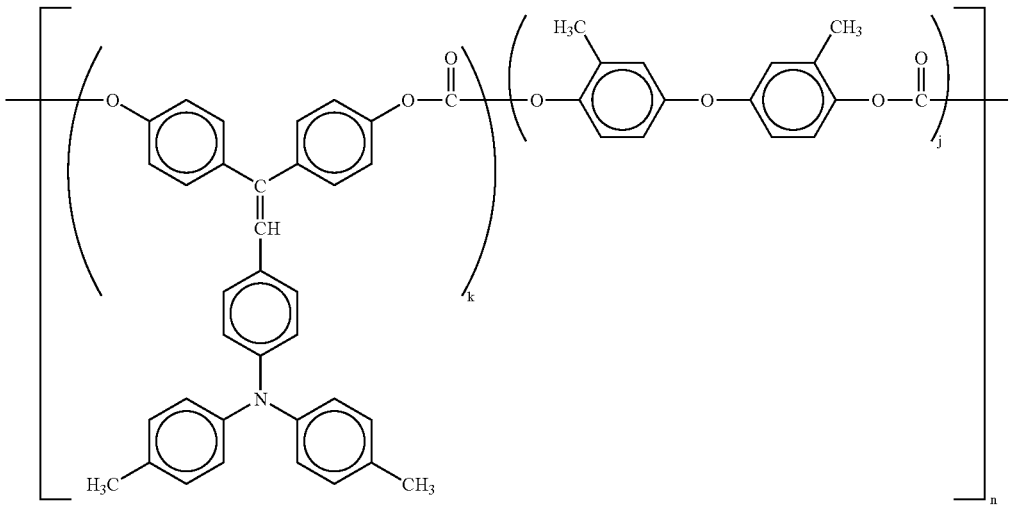

k = 0.40, j = 0.60

Mw=135,000 (polystyrene standard)
* Tetrahydrofuran: 100 parts

PHOTOCONDUCTOR MANUFACTURE EXAMPLE 18

An electrophotographic photoconductor 18 was manufactured similar to photoconductor manufacture example 1 except that the surface layer in photoconductor manufacture example 1 was not formed and the thickness of the charge transportation layer was changed to 22 μm.

Thus manufactured photoconductors 1-18 were cut out into samples with a proper size and the elastic displacement ratio τe and the dynamic hardness of each sample was measured by using a dynamic ultra-micro surface hardness meter DUH-201 (produced by Shimazu Seisakusho) and a triangular pyramid indenting tool (Berkovich 115°) under the environmental conditions of a temperature of 22° C. and relative humidity of 55%. Then, a set load was determined such that the maximum displacement is 1/10 of the thickness of the surface layer. Also, the speeds of load application and load removal were 0.0145 gf/sec and the time period of resting at the maximum displacement were 5 seconds. The elastic displacement ratio τe was calculated from the measured maximum displacement and plastic displacement according to the following formula:

Elastic displacement ratio τe(%)=[(maximum displacement)−(plastic displacement)]/(maximum displacement)×100.

Herein, each displacement was an average of values measured at arbitrary 10 points on the sample. The results are shown in Table 4-1.

Also, the visual appearance of the electrophotographic photoconductor samples was observed. Next, for tests of solubility against an organic solvent, a drop of tetrahydrofuran (referred to as THF, below) or dichloromethane (referred to as MDC, below) was dropped onto the samples. Then, the deformation of the surfaces of the samples was observed after air-drying was applied. The results are shown in Table 4-1. Herein, the classifications for the surface observation and the solubility test were made in accordance with the following criteria.

<Surface Observation>

A: Good level such that no defect was found on the entire surface

B: level such that a micro-defect was found on a portion of the surface but is no problematic C: Level such that a defect was easily found by visual observation D: Level such that a marked defect was found and will be detrimental to use <Solubility Test>

A: Level such that no alteration was found and perfect insolubility was exhibited B: Level such that slight alteration was found on a film but is not problematic C: Level such that alteration was found on a surface and solubility was exhibited D: Level such that obvious dissolution of a film was found Furthermore, the ten point height of irregularities Rz, friction coefficient, and contact angle of water were measured for the electrophotographic photoconductor samples.

For the measurement of surface roughness, the surface roughness Rz (ten point height of irregularities, JIS B0601-1982 standard) of each sample was measured under the conditions of a evaluation length of 2.5 mm and a gage length of 0.5 mm by using SURFCOM 1400D (produced by TOKYO SEIMITSU Co., Ltd.). The measurement was made at three points that were at 80 mm from both edges of the photoconductor drum and at the center of the drum along the axial direction thereof, for each of four radial directions of the drum which directions were perpendicular or parallel to each other. That is, the measurement for each sample was made at 12 points in total and the surface roughness Rz of the sample was an average of the measurement values at the 12 points. The friction coefficient of each sample was measured by using an apparatus illustrated in FIG. 9 in accordance with Euler-belt method. As described above, a PPC paper (Type 6200 produced by Ricoh Company, Ltd.) cut into a strip with a width of 3 cm contacted with a ¼ portion of the peripheral surface of the photocondcutor sample so that the direction of conveying the paper was the longitudinal direction thereof. Then, a load of 100 g was applied to one side (a lower side) of the paper and the other side was connected to a force gage. The force gage was moved with a constant speed, and when the paper started to move, a force (a peak value) was read by using the force gage. Finally, the frictional coefficient was calculated according to the following formula:

$$\mu s = 2/\pi \times \ln(F/W)$$

μs: static friction coefficient

F: read value on force gage

W: load (100 g).

The contact angle of water with the each photoconductor sample was measured on the environmental conditions of a temperature of 22° C. and relative humidity of 55% by using FACE Contact Angle Meter Model CA-W produced by KYOWA Interface Science Co., Ltd. For the measurement, ion-exchange water was used. Also, The measurement was made at three points that were at 80 mm from both edges of the photoconductor drum and at the center of the drum along the axial direction thereof, for each of five radial directions of the drum. That is, the measurement for each sample was made at 15 points in total and the contact angle of the sample was an average of the measurement values at the 15 points.

The results of the measurements described above are shown in Tables 4-1 and 4-2.

TABLE 4-1

| Photoconductor manufacture Example | τe (%) | Dynamic Hardness (Nm/μm$^2$) | Surface observation | Rz (μm) |
|---|---|---|---|---|
| 1 | 42.0 | 23.8 | A | 0.38 |
| 2 | 40.7 | 23.2 | A | 0.45 |
| 3 | 48.3 | 24.7 | A | 0.61 |
| 4 | 46.2 | 24.3 | A | 0.58 |
| 5 | 44.4 | 24.0 | A | 0.33 |
| 6 | 37.5 | 21.4 | A | 0.25 |
| 7 | 46.1 | 24.5 | A | 0.32 |
| 8 | 36.8 | 21.7 | A | 1.09 |
| 9 | 40.5 | 22.1 | B | 0.89 |
| 10 | 33.0 | 21.4 | A | 0.30 |
| 11 | 41.8 | 23.8 | A | 0.21 |
| 12 | 41.9 | 23.7 | A | 1.05 |
| 13 | 41.7 | 23.7 | A | 0.80 |
| 14 | 40.1 | 21.6 | A | 0.40 |
| 15 | 35.3 | 22.2 | A | 0.62 |
| 16 | 31.6 | 26.5 | B | 0.87 |
| 17 | 44.8 | 21.8 | A | 0.19 |
| 18 | 37.5 | 21.5 | A | 0.18 |

TABLE 4-2

| Photoconductor Manufacture example | Solubility Test THF | Solubility Test MDC | Friction coefficient | Contact angle (°) |
|---|---|---|---|---|
| 1 | A | A | 0.45 | 73.1 |
| 2 | A | A | 0.41 | 78.6 |
| 3 | A | A | 0.46 | 72.5 |
| 4 | A | A | 0.42 | 75.0 |
| 5 | A | A | 0.42 | 74.7 |
| 6 | A | A | 0.48 | 80.1 |
| 7 | A | A | 0.44 | 73.5 |
| 8 | A | A | 0.39 | 79.4 |
| 9 | A | A | 0.39 | 78.1 |
| 10 | C | C | 0.41 | 82.1 |
| 11 | A | A | 0.15 | 99.5 |
| 12 | A | A | 0.06 | 102.6 |
| 13 | A | A | 0.05 | 101.6 |
| 14 | A | A | 0.32 | 85.4 |
| 15 | D | D | 0.42 | 92.1 |
| 16 | D | D | 0.51 | 88.5 |
| 17 | D | D | 0.37 | 94.9 |
| 18 | D | D | 0.36 | 95.2 |

Examples 1-11 and Comparisons 1-24

Each electrophotographic photoconductor described above was inserted on a process cartridge for image formation apparatus and the process cartridge was installed into a remodeled full color printer IPSiO 8100 in which a semiconductor laser with a wavelength of 655 nm was installed as an light source for image exposure. For the process cartridge for image formation apparatus, both a remodeled process cartridge for image formation apparatus that includes a protective material application device between a cleaning blade and a charging device and a normal process cartridge for image formation apparatus with no protective material application device were prepared. In the remodeled process cartridge for image formation apparatus with a protective material application device, as illustrated in FIG. 5, a fur brush as a protective material application member was fixed so that an end of the brush contacted a photoconductor surface. Also, a bar-shaped solid protective material obtained by solidifying melted zinc stearate so as to match the length of the photoconductor was fixed so that the solid protective material contacted an end of the fur brush. Thereby, the protective material was fed on the photoconductor surface by the rotation of the fur brush. Herein, the degree of contact of the fur brush and the solid protective material could be arbitrarily controlled so as to control the quantity of the applied protective material.

Further, gap tapes with a thickness of 50 μm were applied on both ends of the charging roller so that the charging roller did not contact the photoconductor. Also, a alternation voltage obtained by superposing an AC voltage on a DC voltage was applied to the charging member. Herein, the peak-to-peak voltage Vpp and the frequency f of the alternating voltage applied to the charging member were approximately 1.9 [kV] and approximately 900 [Hz], respectively. Also, the DC voltage, the development bias, and the moving speed of the photocomductor were set to −750 [V], −500 [V], and 125 [mm/sec], respectively.

For each kind of the photoconductor sample described above, two identical photoconductor samples were prepared. One of the photoconductor samples was installed into the remodeled process cartridge with a protective material application device and the other was installed into the normal process cartridge with no protective material application device. Then, common developer was used for both process cartridges and each of the process cartridges was installed into a cyan station or a magenta station of the printer and 100,000 continuous printing test was carried out under the same condition as described above. After 100,000 printings, the abrasion loss was measured and the photoconductor surface was observed so as to compare the damage and filming conditions in the case of the presence of the protective material application to those in the case of the absence of the protective material application. The results are shown in Tables 5-1 and 5-2.

TABLE 5-1

| Photoconductor No. | Example Comparison | Protective material application | Abrasion loss (μm) |
|---|---|---|---|
| 1 | Example 1 | Presence | 0 |
| | Comparison 1 | Absence | 1.2 |
| 2 | Example 2 | Presence | 0 |
| | Comparison 2 | Absence | 1.4 |
| 3 | Example 3 | Presence | 0 |
| | Comparison 4 | Absence | 1.3 |
| 4 | Example 4 | Presence | 0 |
| | Comparison 4 | Absence | 1.3 |
| 5 | Example 5 | Presence | 0.2 |
| | Comparison 5 | Absence | 1.9 |
| 6 | Comparison 6 | Presence | 0.1 |
| | Comparison 7 | Absence | 2.8 |
| 7 | Example 6 | Presence | 0 |
| | Comparison 8 | Absence | 1.3 |
| 8 | Comparison 9 | Presence | 0.3 |
| | Comparison 10 | Absence | 2.8 |
| 9 | Example 7 | Presence | 0.2 |
| | Comparison 11 | Absence | 2 |
| 10 | Comparison 12 | Presence | 0.5 |
| | Comparison 13 | Absence | 3.8 (50,000 printings) |
| 11 | Example 8 | Presence | 0.1 |
| | Comparison 14 | Absence | 1.2 |
| 12 | Example 9 | Presence | 0.7 |
| | Comparison 15 | Absence | 1.7 |
| 13 | Example 10 | Presence | 0.3 |
| | Comparison 16 | Absence | 1.4 |
| 14 | Example 11 | Presence | 0.3 |
| | Comparison 17 | Absence | 1.3 |
| 15 | Comparison 18 | Presence | 0.1 (50,000 printings) |
| | Comparison 19 | Absence | 3.7 (50,000 printings) |
| 16 | Comparison 20 | Presence | 0.2 |
| | Comparison 21 | Absence | 3.5 |
| 17 | Example 12 | Presence | 0.6 |
| | Comparison 22 | Absence | Incapable measurement |
| 18 | Comparison 23 | Presence | Incapable measurement |
| | Comparison 24 | Absence | Incapable measurement |

TABLE 5-2

| Example Comparison | Image evaluation | Photoconductor surface observation |
|---|---|---|
| Example 1 | Good | Good |
| Comparison 1 | Stripe-like background contamination generation | Ineffective cleaning |

TABLE 5-2-continued

| Example Comparison | Image evaluation | Photoconductor surface observation |
|---|---|---|
| Example 2 | Good | Good |
| Comparison 2 | Stripe-like background contamination generation | Ineffective cleaning |
| Example 3 | Good | Good |
| Comparison 3 | Stripe-like background contamination generation | Ineffective cleaning |
| Example 4 | Good | Good |
| Comparison 4 | Stripe-like background contamination generation | Ineffective cleaning |
| Example 5 | Good | Good |
| Comparison 5 | Stripe-like background contamination generation | Ineffective cleaning |
| Comparison 6 | Resolution lowering | Filming generation |
| Comparison 7 | Background contamination & many black spots generation | Found damage & fixed matter |
| Example 6 | Good | Good |
| Comparison 8 | Stripe-like background contamination generation | Ineffective cleaning |
| Comparison 9 | Resolution lowering | Frequent filming generation |
| Comparison 10 | Background contamination & many black spots generation | Found damage & fixed matter |
| Example 7 | Good | Good |
| Comparison 11 | Stripe-like background contamination generation | Ineffective cleaning |
| Comparison 12 | Resolution lowering | Frequent filming generation |
| Comparison 13 | Much background contamination (discontinuation at 50,000 printings) | Found damage & fixed matter (discontinuation at 50,000 printings) |
| Example 8 | Initial image density lowering | Good |
| Comparison 14 | Stripe-like background contamination generation | Ineffective cleaning |
| Example 9 | Initial image density lowering & slight resolution lowering | Slightly frequent filming generation |
| Comparison 15 | Stripe-like background contamination generation | Ineffective cleaning |
| Example 10 | Initial image density lowering | Good |
| Comparison 16 | Stripe-like background contamination generation | Ineffective cleaning |
| Example 11 | Slight resolution lowering | Good |
| Comparison 17 | Stripe-like background contamination generation | Ineffective cleaning |

TABLE 5-2-continued

| Example Comparison | Image evaluation | Photoconductor surface observation |
|---|---|---|
| Comparison 18 | Resolution lowering (discontinuation at 50,000 printings) | Frequent filming generation (discontinuation at 50,000 printings) |
| Comparison 19 | Background contamination & many black spots generation (discontinuation at 50,000 printings) | Found damage & fixed matter (discontinuation at 50,000 printings) |
| Comparison 20 | Resolution lowering | Filming generation |
| Comparison 21 | Background contamination & many black spots generation | Found damage & fixed matter |
| Example 12 | Slight resolution lowering | Slightly frequent filming generation |
| Comparison 22 | many black spots generation after 30,000 printings (discontinuation at 30,000 printings) | Found fixed matter at 30,000 printings (discontinuation at 30,000 printings) |
| Comparison 23 | Resolution lowering after 10,000 printings (discontinuation at 10,000 printings) | Filming generation at 10,000 printings (discontinuation at 10,000 printings) |
| Comparison 24 | many black spots generation after 10,000 printings (discontinuation at 10,000 printings) | Found damage & fixed matter at 10,000 printings (discontinuation at 10,000 printings) |

As obvious from the examples, it was found that abrasion could be avoided without a side effect to an image by applying the protective material on the photoconductor surface. However, it was found that, with respect to the photoconductor having a surface with an elastic displacement ratio $\tau e$ less than 40%, the abrasion resistance thereof could be improved by the application of the protective material, but filming or fixing of toner or external additive for toner could be caused so as to lower the image stability.

Also, even if an elastic displacement ratio $\tau e$ of the photoconductor surface was equal to or greater than 40%, when no protective material was applied, the abrasion promoted and ineffective cleaning was also found, whereby the image stability degraded. Then, it was found that many micro-defects of a cleaning blade were observed and toner was not eliminated by cleaning but passed through the cleaning blade.

It was found that even if the protective material was applied on the photoconductor surface, when the dynamic hardness of the photoconductor surface was less than 22 $mN/\mu m^2$, the influence of a damage increased and filming was slightly easy to occur. Also, it was found that when the surface roughness Rz of the photoconductor surface was greater than 1.0 μm, a solid matter easily remained on the photoconductor surface and the image defect was easily caused. Also, when the friction coefficient of the photoconductor surface was less than 0.3, the abrasion of the photoconductor was markedly found, particularly after the start of the continuous printing test and lowering in the image density was also found. However, as the continuous printing for test was proceeded, the tendency of suppressing them was found. Similarly, when the contact angle of the photoconductor surface was equal to or greater than 100°, the abrasion of the photoconductor and the lowering in the image density was obviously recognized and the tendency of slight lowering in the resolution was also found.

Further, the present invention is not limited to these embodiments and examples, but various variations and modifications may be made without departing from the scope of the present invention.

The present application is based on Japanese priority applications No. 2004-057070 filed on Mar. 2, 2004, the entire contents of which are hereby incorporated by reference.

What is claimed is:

1. An image formation apparatus comprising at least a moving body to be charged, a charging device for charging the body to be charged using discharge caused by applying a voltage to a charging member provided in contact with or proximity to the body to be charged, a latent image formation device for forming a latent image on a surface of the body to be charged which is charged by the charging device, and a development device for depositing toner on an image portion of the latent image formed by the latent image formation device, wherein an elastic displacement ratio τe for the surface of the body to be charged is equal to or greater than 40% which is defined by the following formula elastic displacement ratio $\tau e(\%)=[(\text{maximum displacement})-(\text{plastic displacement})]/(\text{maximum displacement})\times 100$ and the image formation apparatus further comprises a protective material feeding device for depositing a protective material on at least a discharge area of the surface of the body to be charged.

2. The image formation apparatus as claimed in claim 1, wherein a dynamic hardness (HD) of the surface of body to be charged is equal to or greater than 22 $mN/\mu m^2$ by a measurement using a 115° triangular pyramid indenting tool (Berkovich 115 indenting tool).

3. The image formation apparatus as claimed in claim 1, wherein a surface roughness of the surface of the body to be charged is a ten point height of irregularities equal to or less than 1.0 μm.

4. The image formation apparatus as claimed in claim 1, wherein a friction coefficient on the surface of the body to be charged is equal to or greater than 0.3 by a measurement in accordance with an Euler—belt method.

5. The image formation apparatus as claimed in claim 1, wherein a contact angle of water containing the surface of the body to be charged is less than 100°.

6. The image formation apparatus as claimed in claim 1, wherein the body to be charged comprises a surface layer that is insoluble to an organic solvent and cured by means of heating or light energy irradiation.

7. The image formation apparatus as claimed in claim 1, wherein the surface layer of the body to be charged comprises at least a cross-linked layer obtained by curing a radical-polymerizable monomer having no charge transporting structure and a radical-polymerizable compound having a charge transporting structure.

8. The image formation apparatus as claimed in claim 7, wherein the radical-polymerizable monomer having no charge transporting structure has three or more-functionalities and the radical-polymerizable compound having a charge transporting structure has one-functionality.

9. The image formation apparatus as claimed in claim 8, wherein a ratio of molecular weight to the number of functional groups (molecular weight/number of functional groups) in the three or more-functional radical-polymerizable monomer having no charge transporting structure is equal to or less than 250.

10. The image formation apparatus as claimed in claim 7, wherein a functional group(s) of the radical-polymerizable monomer having no charge transporting structure is/are an acryloyloxy group or/and a methacryloyloxy group.

11. The image formation apparatus as claimed in claim 7, wherein a functional group(s) of the radical-polymerizable compound having a charge transporting structure is/are an acryloyloxy group or/and a methacryloyloxy group.

12. The image formation apparatus as claimed in claim 1, wherein a voltage with a superposed alternating current component is applied to the charging member.

13. The image formation apparatus as claimed in claim 12, wherein a proximal distance between the charging member and the body to be charged is in a range of 1-100 μm in an image formation area.

14. The image formation apparatus as claimed in claim 12, wherein the charging member has a surface layer made of a resin material.

15. The image formation apparatus as claimed in claim 1, wherein the protective material is lamellar crystal powder.

16. The image formation apparatus as claimed in claim 15, wherein the lamellar crystal powder is made of a metal salt of fatty acid.

17. The image formation apparatus as claimed in claim 16, wherein an element ratio of a metal element contained in the metal salt of fatty acid deposited on at least discharge area on the surface of the body to be charged is equal to or greater than $1.52\times10^{-4}\times\{Vpp-2\times Vth\}\times f/v$ [%] by a measurement of XPS, in which Vpp [V] is an amplitude of an alternating current component applied to the charging member, f [Hz] is a frequency of an alternating current component applied to the charging member, v [mm/sec] is a movement velocity of the surface of the body to be charged that opposes the charging member, and Vth [V] is a breakdown voltage, and the value of Vth is $312+6.2\times(d/\epsilon opc+Gp/\epsilon air)+\sqrt{(7737.6\times d/\epsilon)}$, in which Gp [μm] is a proximal distance between a surface of the charging member and the surface of the body to be charged, d [μm] is a film thickness of the body to be charged, εopc is a relative dielectric constant of the body to be charged, and εair is a relative dielectric constant of a space between the body to be charged and the charging member.

18. The image formation apparatus as claimed in claim 16, wherein the metal salt of fatty acid is zinc stearate.

19. The image formation apparatus as claimed in claim 1, wherein the protective material is one solid matter obtained by melting and solidification and has a length equal to or greater than an image formation area along an axial direction, of the body to be charged.

20. The image formation apparatus as claimed in claim 1, wherein the protective material feeding device is directly contact the body to be charged and the protective material and has a protective material applying member for applying the protective material indirectly to the surface of the body to be charged by rotating itself and a rotational speed of the protective material applying member is different from a rotational speed of the body to be charged.

21. The image formation apparatus as claimed in claim 20, wherein an application quantity of the protective material to the body to be charged can be adjusted by controlling the presence or absence of contact between the protective material applying member and the protective material or between the protective material applying member and the body to be charged.

22. The image formation apparatus as claimed in claim 1, further comprising a detector for detecting an environmental state around the charging member and a controller for controlling a feeding quantity of the protective material to the surface of the body to be charged based on the detected environmental state.

23. The image formation apparatus as claimed in claim 1, wherein a process cartridge for image formation apparatus is installed in which a body to be charged and at least one device selected from the group consisting of a charging device for charging the body to be charged using discharge caused by applying a voltage to a charging member provided in contact with or proximity to the body to be charged, a latent image formation device for forming a latent image on a surface of the body to be charged which is charged by the charging device, a development device for depositing toner on an image portion of the latent image formed by the latent image formation device, a toner elimination device for eliminating toner remaining on the surface of the body to be charged, and a protective material feeding device for depositing a protective material on at least a discharge area of the surface of the body to be charged are integrated, and the process cartridge for image formation apparatus is attachable and detachable with a main body of the image formation apparatus.

24. A process cartridge for image formation apparatus that is used in the image formation apparatus as claimed in claim 23, wherein a body to be charged and at least one device selected from the group consisting of a charging device for charging the body to be charged using discharge caused by applying a voltage to a charging member provided in contact with or proximity to the body to be charged, a latent image formation device for forming a latent image on a surface of the body to be charged which is charged by the charging device, a development device for depositing toner on an image portion of the latent image formed by the latent image formation device, a toner elimination device for eliminating toner remaining on the surface of the body to be charged, and a protective material feeding device for depositing a protective material on at least a discharge area of the surface of the body to be charged, are integrated.

* * * * *